US007567765B2

(12) United States Patent
Chiba

(10) Patent No.: US 7,567,765 B2
(45) Date of Patent: Jul. 28, 2009

(54) IMAGE FORMING APPARATUS

(75) Inventor: Satoshi Chiba, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 152 days.

(21) Appl. No.: 11/735,297

(22) Filed: Apr. 13, 2007

(65) Prior Publication Data

US 2007/0242968 A1 Oct. 18, 2007

(30) Foreign Application Priority Data

Apr. 14, 2006 (JP) ..... 2006-112364
Apr. 14, 2006 (JP) ..... 2006-112365
Apr. 14, 2006 (JP) ..... 2006-112366

(51) Int. Cl.
*G03G 15/16* (2006.01)
*G03G 21/00* (2006.01)

(52) U.S. Cl. ..... 399/66; 399/71; 399/101; 399/302; 399/308

(58) Field of Classification Search ..... 399/21, 399/66, 71, 101, 121, 124, 302, 308, 313, 399/314

See application file for complete search history.

(56) References Cited

U.S. PATENT DOCUMENTS 6,253,039 B1 * 6/2001 Nakano et al. ..... 399/53
6,477,340 B2 * 11/2002 Tomizawa et al. ..... 399/66
2003/0215269 A1 * 11/2003 Kayahara et al. ..... 399/297
2004/0018026 A1 * 1/2004 Katayanagi et al. ..... 399/66

FOREIGN PATENT DOCUMENTS

JP 05-297739 11/1993
JP 08-146794 6/1996
JP 11-038791 2/1999
JP 11-153912 6/1999

(Continued)

OTHER PUBLICATIONS

Machine Translation of JP 11282272 A.*

*Primary Examiner*—David M Gray
*Assistant Examiner*—Gregory H Curran
(74) *Attorney, Agent, or Firm*—Hogan & Hartson LLP

(57) ABSTRACT

An image forming apparatus includes a photoconductor capable of bearing developer; a rotatable intermediate transfer member serving as an intermediate medium when transferring the developer on the photoconductor to a medium; a voltage supply section supplying to the intermediate transfer member a transfer voltage for letting the developer on the photoconductor advance to the intermediate transfer member at a primary transfer location; a secondary transfer member for transferring to the medium the developer that has moved to a secondary transfer location through rotation of the intermediate transfer member; a removal member arranged downstream from the secondary transfer location, with respect to a rotation direction of the intermediate transfer member, the removal member abutting against the intermediate transfer member and removing remaining developer remaining on the intermediate transfer member; and a controller that controls the voltage supply section, which does not cause the supply of the transfer voltage with the voltage supply section during the removal, with the removal member, of the remaining developer located upstream from the secondary transfer location, with respect to the rotation direction of the intermediate transfer member, and located between the primary transfer location and the secondary transfer location when a situation has arisen in which an image forming operation is stopped midway, in order to resume the image forming operation.

10 Claims, 34 Drawing Sheets

FOREIGN PATENT DOCUMENTS

| | | | |
|---|---|---|---|
| JP | 11282272 A | * | 10/1999 |
| JP | 2000-147915 | | 5/2000 |
| JP | 2001-083818 | | 3/2001 |
| JP | 2001-337507 | | 12/2001 |
| JP | 2002-169389 | | 6/2002 |
| JP | 2003-057906 | | 2/2003 |

* cited by examiner

IMAGE FORMING APPARATUS

CROSS-REFERENCE TO RELATED APPLICATIONS

The present application claims priority upon Japanese Patent Application No. 2006-112364 filed on Apr. 14, 2006, Japanese Patent Application No. 2006-112365 filed on Apr. 14, 2006, and Japanese Patent Application No. 2006-112366 filed on Apr. 14, 2006, which are herein incorporated by reference.

BACKGROUND

1. Technical Field

The present invention relates to image forming apparatuses.

2. Related Art

Image forming apparatuses such as laser beam printers are well known. Such an image forming apparatus includes for example a photoconductor, which is an example of a rotatable image bearing member for bearing a latent image, a developing device for developing the latent image borne on the photoconductor with developer at a developing location, a rotatable intermediate transfer member serving as an intermediate transfer member when transferring the developer on the photoconductor to a medium to form the image, a voltage supply section supplying to the intermediate transfer member a transfer voltage for letting the developer on the photoconductor advance to the intermediate transfer member at a primary transfer location, and a secondary transfer member for transferring the developer that has moved to a secondary transfer location through rotation of the intermediate transfer member to the medium. The image forming apparatus further includes a removal member that is arranged on a downstream side, with respect to the rotation direction of the intermediate transfer member, from the secondary transfer location, and that removes remaining developer remaining on the intermediate transfer member by abutting against the intermediate transfer member.

When the image forming apparatus receives an image signal or the like from an external device, such as a host computer, the latent image borne by the photoconductor is developed with the developer in the developing device. Then, the developer on the photoconductor is transferred by primary transfer, such that it is attracted to the intermediate transfer member to which a transfer voltage is supplied with a voltage supply section, and then it is transferred by secondary transfer to a medium at a secondary transfer location. Then, the developer, which has been transferred by secondary transfer to the medium, is fixed to the medium with a fixing device, and the image is finally formed on the medium. On the other hand, the developer remaining on the intermediate transfer member without being transferred to the medium by the secondary transfer member is removed with the removal member.

Now, while carrying out the image forming operation, a situation may occur in which the image forming operation is stopped midway. An example of such a situation is a situation in which the medium becomes stuck while being transported in the image forming apparatus during the image forming operation (the medium becoming stuck is referred to as "jamming" in the following). In this case, the developer remaining on the intermediate transfer member is removed with the removal member after the operator has resolved the jamming by removing the medium that has become stuck in the image forming apparatus in order to resume the image forming operation.

When such a situation (jamming of the medium or the like) stopping the image forming operation midway has occurred, remaining developer may be located upstream, with respect to the rotation direction of the intermediate transfer member, from the secondary transfer location, between the primary transfer location and the secondary transfer location. In this case, the amount of remaining developer to be removed by the removal member tends to become large, since the remaining developer is removed by the removal member in order to resume the image forming operation.

Moreover, when the transfer voltage for letting the developer advance to the intermediate transfer member is supplied to the intermediate transfer member while a large amount of the remaining developer is removed by the removal member in order to resume the image forming operation (conventionally, the transfer voltage was supplied to the intermediate transfer belt while removing the remaining developer on the intermediate transfer member with the removal member after resolving the jamming), then the large amount of remaining developer remaining on the intermediate transfer member is attracted to the intermediate transfer member. In this situation, there is the risk that the remaining developer will remain on the intermediate transfer member without being suitably removed by the removal member.

Moreover, the following two aspects are desirable regarding the remaining developer remaining on the photoconductor and the intermediate transfer member (also referred to simply as "remaining developer" in the following) when a situation has occurred in which the image forming operation is stopped midway (such as jamming of the medium).

Firstly, it is desirable that the developer remaining on the photoconductor is suitably transferred to the intermediate transfer member. This is because if the remaining developer is transferred to the intermediate transfer member, then the configuration of the image forming apparatus can be made simpler than if the remaining developer is removed on the photoconductor without being transferred to the intermediate transfer member.

Secondly, it is desirable that the developer remaining on the photoconductor or the intermediate transfer member is suitably removed by the removal member in order to resume the image forming operation. For example, if the transfer voltage for letting the developer advance to the intermediate transfer member is supplied to the intermediate transfer member while the remaining developer is removed with the removal member, the remaining developer is attracted to the intermediate transfer member. In this situation, there is the risk that the remaining developer will remain on the intermediate transfer member without being suitably removed by the removal member.

Moreover, in an image forming apparatus, the image quality of the image can be adjusted by forming an adjustment pattern on the intermediate transfer member from the viewpoint of preventing a decrease of the image quality of the image formed on the medium. This adjustment pattern is constituted by developer that has advanced from the photoconductor to the intermediate transfer member at the primary transfer location. The image forming apparatus is provided with pattern detection members for detecting the adjustment pattern (developer) and adjusts the image quality based on a detection result of the adjustment pattern provided by the pattern detection member.

Furthermore, the removal member abuts against the intermediate transfer member and removes the adjustment pattern (more specifically, the developer constituting the adjustment pattern) at the developer removal location after detecting it with the pattern adjustment member. The image forming apparatus then can suitably carry out the following image formation by removing the adjustment pattern (developer) on the intermediate transfer member with the removal member.

Now, the following two aspects are desired when forming the adjustment pattern on the intermediate transfer member and removing the developer constituting this adjustment pattern.

Firstly, it is desirable that the developer on the photoconductor is suitably transferred to the intermediate transfer member when forming the adjustment pattern. The reason for this is that when the developer is not suitably transferred to the intermediate transfer member, the density of the adjustment pattern will not be suitable and the adjustment of the image quality of the image cannot be carried out in a suitable manner.

Secondly, it is desirable that the developer constituting the adjustment pattern formed on the intermediate transfer member is suitably removed by the removal member. For example, if the transfer voltage for letting the developer advance to the intermediate transfer member is supplied to the intermediate transfer member while the developer is being removed with the removal member, then the developer constituting the adjustment pattern is attracted to the intermediate transfer member. In this situation, there is the risk that the developer will remain on the intermediate transfer member without being suitably removed by the removal member.

It should be noted that JP-A-2002-169389 and JP-A-2001-337507 are examples of related technology.

SUMMARY

The present invention has been conceived in view of the above-explained circumstances, and it is an advantage thereof to provide an image forming apparatus with which the removal of remaining developer is suitably performed by a removal member in order to resume the image forming operation.

A main aspect of the invention is an image forming apparatus such as the following:

An image forming apparatus comprising:

a photoconductor capable of bearing developer;

a rotatable intermediate transfer member serving as an intermediate medium when transferring the developer on the photoconductor to a medium;

a voltage supply section supplying to the intermediate transfer member a transfer voltage for letting the developer on the photoconductor advance to the intermediate transfer member at a primary transfer location;

a secondary transfer member for transferring to the medium the developer that has moved to a secondary transfer location through rotation of the intermediate transfer member;

a removal member arranged downstream from the secondary transfer location, with respect to a rotation direction of the intermediate transfer member, the removal member abutting against the intermediate transfer member and removing remaining developer remaining on the intermediate transfer member; and a controller that controls the voltage supply section, which does not cause the supply of the transfer voltage with the voltage supply section during the removal, with the removal member, of the remaining developer located upstream from the secondary transfer location, with respect to the rotation direction of the intermediate transfer member, and located between the primary transfer location and the secondary transfer location when a situation has arisen in which an image forming operation is stopped midway, in order to resume the image forming operation.

It is also an advantage of an aspect of the invention to provide an image forming apparatus with which the developer remaining on the image bearing member is suitably transferred to the intermediate transfer member and the developer remaining on the image bearing member or the intermediate transfer member is suitably removed with the removal member in order to resume the image forming operation.

A main aspect of the invention is an image forming apparatus such as the following:

An image forming apparatus comprising:

a rotatable image bearing member for bearing a latent image;

a developing device for developing the latent image borne by the image bearing member with developer at a developing location;

a rotatable intermediate transfer member serving as an intermediate medium when transferring the developer on the image bearing member to a medium;

a voltage supply section supplying to the intermediate transfer member a transfer voltage for letting the developer on the image bearing member advance to the intermediate transfer member at a primary transfer location;

a secondary transfer member for transferring to the medium the developer that has moved to a secondary transfer location through a rotation of the intermediate transfer member;

a removal member arranged downstream from the secondary transfer location, with respect to a rotation direction of the intermediate transfer member, the removal member removing remaining developer remaining on the intermediate transfer member without being transferred by the secondary transfer member, by abutting against the intermediate transfer member, the removal member removing remaining developer that has remained on the image bearing member and the intermediate transfer member when a situation has arisen in which an image forming operation is stopped midway, and that has been moved through the rotation of the image bearing member and the intermediate transfer member and has reached a developer removal location at which the remaining developer is removed by the removal member, in order to resume the image forming operation; and a controller that controls the voltage supply section, the controller:

causing the supply of the transfer voltage with the voltage supply section until the remaining developer located at the developing location when the above referenced situation has arisen has been moved through the rotation of the image bearing member and has reached the primary transfer location, and stopping the supply of the transfer voltage with the voltage supply section after the remaining developer located at the developing location when the above referenced situation has arisen has reached the primary transfer location and before the remaining developer located at the secondary transfer location when the above referenced situation has arisen is moved to the developer removal location through the rotation of the intermediate transfer member and removed by the removal member.

It is a further advantage of an aspect of the invention to provide an image forming apparatus with which an adjustment pattern is formed on the intermediate transfer member and the developer constituting this adjustment pattern is suitably removed with the removal member.

A main aspect of the invention is an image forming apparatus such as the following:

An image forming apparatus comprising:

a rotatable photoconductor bearing developer;

a rotatable intermediate transfer member serving as an intermediate medium when transferring the developer on the photoconductor to a medium to form an image on the medium;

a voltage supply section supplying to the intermediate transfer member a transfer voltage for letting the developer on the photoconductor advance to the intermediate transfer member at a primary transfer location;

a pattern detection member for detecting an adjustment pattern for adjusting an image quality of the image, the adjustment pattern being constituted by developer that is transferred to the intermediate transfer member from the photoconductor at a primary transfer location through supply of a transfer voltage to the intermediate transfer member with the voltage supply section;

a removal member abutting against the intermediate transfer member and removing the developer constituting the adjustment pattern at a developer removal location after the adjustment pattern has been detected with the pattern detection member; and a controller that controls the voltage supply section, which causes supply of the transfer voltage with the voltage supply section until the developer constituting the adjustment pattern has moved and has reached the primary transfer location due to a rotation of the photoconductor, and which stops the supply of the transfer voltage with the voltage supply section after the developer constituting the adjustment pattern has reached the primary transfer location and before that developer has moved and has reached the developer removal location due to a rotation of the intermediate transfer member.

Other features of the invention will become clear through the accompanying drawings and the following description.

BRIEF DESCRIPTION OF THE DRAWINGS

For a more complete understanding of the invention and the advantages thereof, reference is now made to the following description taken in conjunction with the accompanying drawings.

DESCRIPTION OF EXEMPLARY EMBODIMENTS

Figure 1:
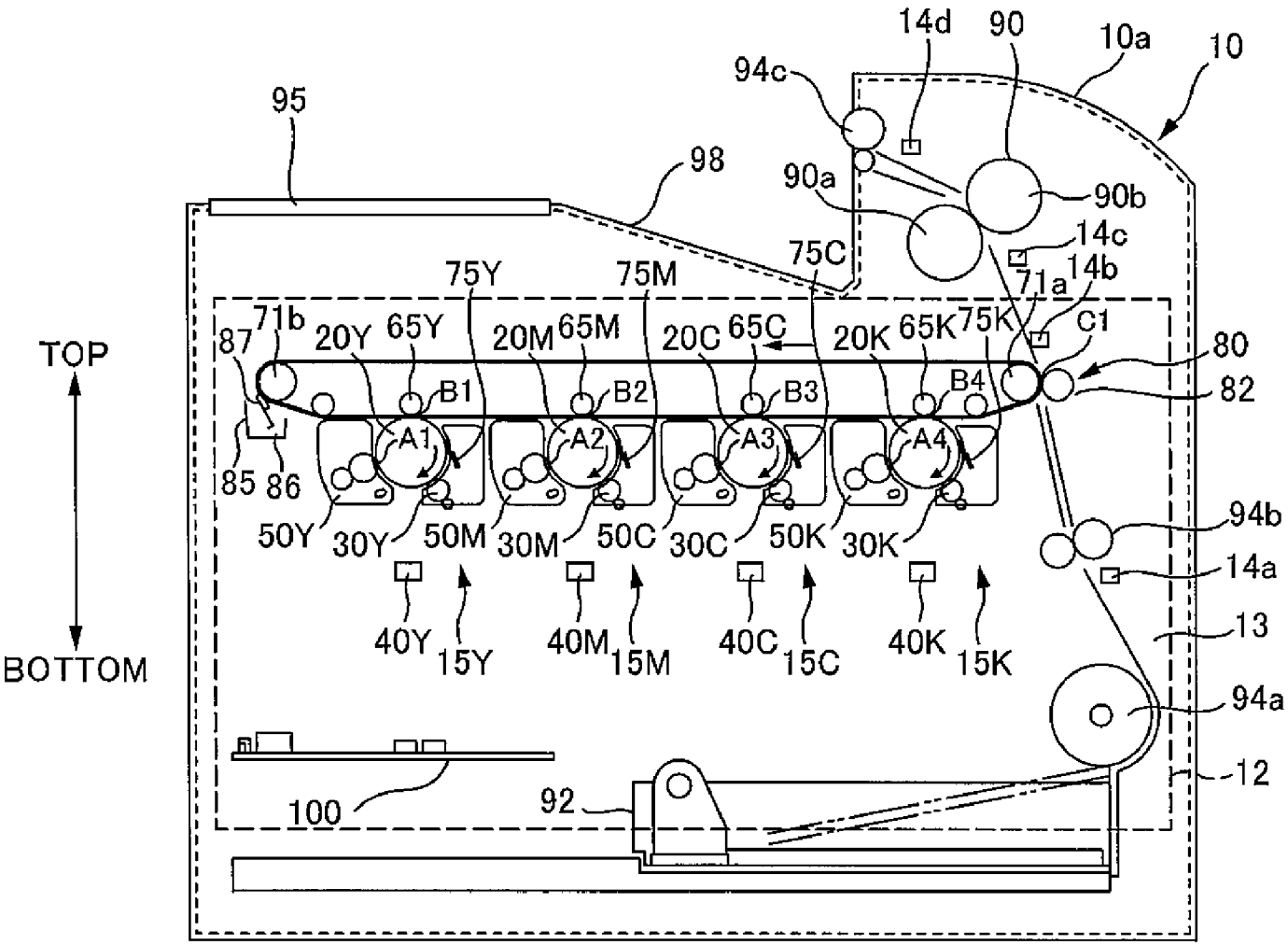
FIG. 1 is a diagram showing the main structural components constituting the printer 10.

At least the following matters will be made clear by the explanation in the present specification and the description of the accompanying drawings.

An image forming apparatus may include:

a photoconductor capable of bearing developer;

a rotatable intermediate transfer member serving as an intermediate medium when transferring the developer on the photoconductor to a medium;

a voltage supply section supplying to the intermediate transfer member a transfer voltage for letting the developer on the photoconductor advance to the intermediate transfer member at a primary transfer location;

a secondary transfer member for transferring to the medium the developer that has moved to a secondary transfer location through rotation of the intermediate transfer member;

a removal member arranged downstream from the secondary transfer location, with respect to a rotation direction of the intermediate transfer member, the removal member abutting against the intermediate transfer member and removing remaining developer remaining on the intermediate transfer member; and a controller that controls the voltage supply section, which does not cause the supply of the transfer voltage with the voltage supply section during the removal, with the removal member, of the remaining developer located upstream from the secondary transfer location, with respect to the rotation direction of the intermediate transfer member, and located between the primary transfer location and the secondary transfer location when a situation has arisen in which an image forming operation is stopped midway, in order to resume the image forming operation.

If the controller does not cause the supply of the transfer voltage with the voltage supply section during the removal, with the removal member, of the remaining developer located upstream from the secondary transfer location, with respect to the rotation direction of the intermediate transfer member, between the primary transfer location and the secondary transfer location when a situation has arisen in which an image forming operation is stopped midway, in order to resume the image forming operation, then a force attracting the remaining developer to the intermediate transfer member is not effected. Therefore, the remaining developer can be suitably removed with the removal member, in order to resume the image forming operation.

The voltage supply section may be capable of supplying to the intermediate transfer member the transfer voltage for letting the developer advance to the intermediate transfer member and of supplying to the intermediate transfer member a reverse transfer voltage for repelling the developer from the intermediate transfer member; and the controller may cause the supply of the reverse transfer voltage with the voltage supply section during the removal, with the removal member, of the remaining developer located upstream from the secondary transfer location, with respect to the rotation direction of the intermediate transfer member, between the primary transfer location and the secondary transfer location when a situation has arisen in which an image forming operation is stopped midway, in order to resume the image forming operation.

If the reverse transfer voltage is supplied with the voltage supply section during the removal, with the removal member, of the remaining developer located upstream from the secondary transfer location, with respect to the rotation direction of the intermediate transfer member, between the primary transfer location and the secondary transfer location when a situation has arisen in which an image forming operation is stopped midway, in order to resume the image forming operation, then a force repelling that remaining developer from the intermediate transfer member is effected. Therefore, it becomes easier to suitably remove the remaining developer with the removal member, in order to resume the image forming operation.

It is also possible that the controller does not cause the supply of the transfer voltage with the voltage supply section during the removal, with the removal member, of remaining developer located upstream, in the rotation direction of the intermediate transfer body, from a developer removal location at which the remaining developer is removed by the removal member and located between the primary transfer location and the developer removal location when a situation has arisen in which an image forming operation is stopped midway, in order to resume the image forming operation.

It occurs that when a situation arises in which the image forming operation is stopped midway, the remaining developer that remains on the intermediate transfer member without having been transferred to the medium at the secondary transfer location before this situation arises is located upstream, with respect to the rotation direction of the intermediate transfer member, from the developer removal location, between the secondary transfer location and the developer removal location. In this case, if no transfer voltage is supplied with the voltage supply section while the remaining developer is being removed with the removal member in order to resume the image forming operation, then this remaining developer is also suitably removed with the removal member.

The voltage supply section may supply the transfer voltage across the entire intermediate transfer member.

If the transfer voltage is supplied across the entire intermediate transfer member, then the effect of the fact that the supply of the transfer voltage is not caused during the removal of the remaining developer, that is, the effect that the remaining developer is suitably removed with the removal member in order to resume the image forming operation, can be displayed more effectively.

Furthermore, an electrode layer may be arranged at an end portion of the intermediate transfer member in a perpendicular direction that is perpendicular to the rotation direction of the intermediate transfer member; the image forming apparatus may further include a conductive member abutting the electrode layer; and the voltage supply section may supply the transfer voltage via the conductive member to the intermediate transfer member.

It is also possible to provide four photoconductors capable of bearing developer of four different colors, and the intermediate transfer member may serve as an intermediate medium when transferring the developer on each of these photoconductors to the medium.

In this case, developer of four colors is transferred to the intermediate transfer member, so that the amount of developer that is removed by the removal member directly after a situation has arisen in which the image forming operation is stopped midway tends to increase. Therefore, the effect of not supplying the transfer voltage during the removal of the remaining toner, that is, the effect that the remaining toner is suitably removed with the removal member in order to resume the image forming operation is achieved more effectively.

An image forming apparatus may include:

a rotatable image bearing member for bearing a latent image;

a developing device for developing the latent image borne by the image bearing member with developer at a developing location;

a rotatable intermediate transfer member serving as an intermediate medium when transferring the developer on the image bearing member to a medium;

a voltage supply section supplying to the intermediate transfer member a transfer voltage for letting the developer on the image bearing member advance to the intermediate transfer member at a primary transfer location;

a secondary transfer member for transferring to the medium the developer that has moved to a secondary transfer location through a rotation of the intermediate transfer member;

a removal member arranged downstream from the secondary transfer location, with respect to a rotation direction of the intermediate transfer member, the removal member removing remaining developer remaining on the intermediate transfer member without being transferred by the secondary transfer member, by abutting against the intermediate transfer member, the removal member removing remaining developer that has remained on the image bearing member and the intermediate transfer member when a situation has arisen in which an image forming operation is stopped midway, and that has been moved through the rotation of the image bearing member and the intermediate transfer member and has reached a developer removal location at which the remaining developer is removed by the removal member, in order to resume the image forming operation; and a controller that controls the voltage supply section, the controller:

causing the supply of the transfer voltage with the voltage supply section until the remaining developer located at the developing location when the above referenced situation has arisen has been moved through the rotation of the image bearing member and has reached the primary transfer location, and stopping the supply of the transfer voltage with the voltage supply section after the remaining developer located at the developing location when the above referenced situation has arisen has reached the primary transfer location and before the remaining developer located at the secondary transfer location when the above referenced situation has arisen is moved to the developer removal location through rotation of the intermediate transfer member and removed by the removal member.

If the controller causes the supply of the transfer voltage with the voltage supply section until the remaining developer located at the developing location when a situation has arisen in which the image forming operation is stopped midway has reached to the primary transfer location, then the remaining developer remaining on the image bearing member when this situation has occurred can be reliably transferred to the intermediate transfer member. Furthermore, if the controller stops the supply of the transfer voltage with the voltage supply section after the remaining developer located at the developing location when the above referenced situation has arisen has reached the primary transfer location and before the remaining developer located at the secondary transfer location when the above referenced situation has arisen is moved to the developer removal location through rotation of the intermediate transfer member and removed by the removal member, then a force attracting the remaining developer reaching the developer removal location to the intermediate transfer member is not effected. Therefore, the remaining developer is suitably removed with the removal member. Consequently, with the above-described image forming apparatus, the remaining developer that remains on the image bearing member when a situation has arisen in which the image forming operation is stopped midway can be suitably transferred to the intermediate transfer member, and the remaining developer remaining on the image bearing member or the intermediate transfer member can be more suitably removed with the removal member in order to resume the image forming operation.

The voltage supply section may be capable of supplying to the intermediate transfer member the transfer voltage for letting the developer advance to the intermediate transfer member and of supplying to the intermediate transfer member a reverse transfer voltage for repelling the developer from the intermediate transfer member, and the controller may stop the supply of the transfer voltage with the voltage supply section and cause the supply of the reverse transfer voltage with the voltage supply section after remaining developer located at the developing location when a situation has arisen in which an image forming operation is stopped midway has reached the primary transfer location and before remaining developer located at the secondary transfer location when the above referenced situation has arisen is moved to the developer removal location through rotation of the intermediate transfer member and is removed by the removal member.

In this case, the remaining developer is easily separated from the intermediate transfer member by supplying the reverse transfer voltage to the intermediate transfer member, so that the remaining developer remaining on the image bearing member and the intermediate transfer member when a situation has arisen in which the image forming operation is stopped midway can be easily removed by the removal member in order to resume the image forming operation.

The controller may let the voltage supply section maintain the stop of the supply of the transfer voltage until the remaining developer located at the developing location when a situation has arisen in which an image forming operation is stopped midway has been moved to the developer removal location through the rotation of the image bearing member and the intermediate transfer member and is removed by the removal member.

In this case, the removal member can effectively remove the remaining developer remaining on the image bearing member and the intermediate transfer member when a situation has occurred in which the image forming operation is stopped midway.

A length of the image bearing member, in its rotation direction, from the developing location to the primary transfer location may be shorter than a length of the intermediate transfer member, in its rotation direction, from the secondary transfer location to the developer removal location.

In this case, the remaining developer remaining on the image bearing member when a situation has arisen in which the image forming operation is stopped midway is reliably transferred to the intermediate transfer member.

It is possible to provide four of the image bearing members capable of bearing developer of different colors, and that the intermediate transfer member serves as an intermediate medium when transferring the developer on these image bearing members to a medium.

In this case, remaining developer is located on each of the four image bearing members when a situation has arisen in which the image forming operation is stopped midway, and the remaining developer transferred from these four image bearing members is located on the intermediate transfer member. Therefore, the effect that the remaining developer remaining on the image bearing members when that situation has occurred is suitably transferred to the intermediate transfer member and the remaining developer remaining on the image bearing members or the intermediate transfer member is suitably removed with the removal member in order to resume the image forming operation is displayed more effectively.

Furthermore, it is possible that the four image bearing members are provided along the rotation direction of the intermediate transfer member, and that the controller causes the supply of the transfer voltage with the voltage supply section until the remaining developer located at the developing location corresponding to a first image bearing member of the four image bearing members, which is furthest removed from the secondary image location on the upstream side, with respect to the rotation direction, of the intermediate transfer member when a situation has arisen in which an image forming operation is stopped midway is moved through the rotation of the image bearing members and the intermediate transfer member and passes the primary transfer location corresponding to a second image bearing member of the four image bearing members, which is closest to the secondary image location on the upstream side, with respect to the rotation direction, of the intermediate transfer member, and stops the supply of the transfer voltage with the voltage supply section after the remaining developer located at the developing location corresponding to the first image bearing member when the above referenced situation has arisen has passed the primary transfer location corresponding to the second image bearing member, and before the remaining developer located at the secondary transfer location when the above referenced situation has arisen is moved to the developer removal location through the rotation of the intermediate transfer member and removed with the removal member.

In this case, it is possible to prevent that remaining developer remaining on a first image bearing member when a situation has occurred in which the image forming operation is stopped midway is transferred back to another image bearing member.

Moreover, a total of a length, in a rotation direction, of the first image bearing member from the developing location to the primary transfer location and a length, in the rotation direction, of the intermediate transfer member from the primary transfer location corresponding to the first image bearing member to the primary transfer location corresponding to the second image bearing member may be shorter than a length, in the rotation direction, of the intermediate transfer member from the secondary transfer location to the developer removal location.

In this case, it can be prevented with a simple configuration that the remaining developer remaining on the first image bearing member when a situation has arisen in which the image forming operation is stopped midway is transferred back to another image bearing member.

An image forming apparatus may include:

a rotatable photoconductor bearing developer;

a rotatable intermediate transfer member serving as an intermediate medium when transferring the developer on the photoconductor to a medium to form an image on the medium;

a voltage supply section supplying to the intermediate transfer member a transfer voltage for letting the developer on the photoconductor advance to the intermediate transfer member at a primary transfer location;

a pattern detection member for detecting an adjustment pattern for adjusting an image quality of the image, the adjustment pattern being constituted by developer that is transferred to the intermediate transfer member from the photoconductor at a primary transfer location through supply of a transfer voltage to the intermediate transfer member with the voltage supply section;

a removal member abutting against the intermediate transfer member and removing the developer constituting the adjustment pattern at a developer removal location after the adjustment pattern has been detected with the pattern detection member; and a controller that controls the voltage supply section, which causes supply of the transfer voltage with the voltage supply section until the developer constituting the adjustment pattern has moved and has reached the primary transfer location due to a rotation of the photoconductor, and which stops the supply of the transfer voltage with the voltage supply section after the developer constituting the adjustment pattern has reached the primary transfer location and before that developer has moved and has reached the developer removal location due to a rotation of the intermediate transfer member.

If the controller causes supply of the transfer voltage with the voltage supply section until all of the developer constituting the adjustment pattern has reached the primary transfer location due to moving with the rotation of the photoconductor, then the developer is reliably transferred onto the intermediate transfer member, so that the adjustment pattern is suitably formed on the intermediate transfer member. And if the controller stops the supply of the transfer voltage with the voltage supply section after all of the developer constituting the adjustment pattern has reached the primary transfer location and before that developer has reached the developer removal location due to moving with the rotation of the intermediate transfer member, then a force attracting the developer reaching the developer removal location to the intermediate transfer member is not effected. Therefore, the developer constituting the adjustment pattern is suitably removed with the removal member. Consequently, with the above-described image forming apparatus, the adjustment pattern is suitably formed on the intermediate transfer member, and the developer constituting this adjustment pattern is suitably removed with the removal member.

The voltage supply section may be capable of supplying to the intermediate transfer member a transfer voltage for letting the developer advance to the intermediate transfer member and may be capable of supplying to the intermediate transfer member a reverse transfer voltage for repelling the developer from the intermediate transfer member, and the controller may stop the supply of the transfer voltage with the voltage supply section and cause the supply of the reverse transfer voltage with the voltage supply section after the developer constituting the adjustment pattern has reached the primary transfer section and before this developer moves and reaches the developer removal location and is moved through rotation of the intermediate transfer member.

In this case, the developer is easily separated from the intermediate transfer member by supplying the reverse transfer voltage to the intermediate transfer member, so that the developer constituting the adjustment pattern is easily removed with the removal member.

Moreover, the controller may maintain the stop of the supply of the transfer voltage with the voltage supply section until the developer constituting the adjustment pattern has moved and has reached the developer removal location due to a rotation of the intermediate transfer member.

In this case, the removal member can effectively remove the developer constituting the adjustment pattern.

Furthermore, the adjustment pattern may be a tone adjustment pattern for adjusting a tone of the image, and a longitudinal direction of the tone adjustment pattern may coincide with the rotation direction of the intermediate transfer member.

If the adjustment pattern is a tone adjustment pattern for adjusting the tone of the image, then the amount of developer constituting this adjustment pattern tends to be large. Therefore, the effect that the developer constituting this adjustment pattern is suitably removed is displayed more effectively.

Moreover, a density of the tone adjustment pattern may change gradually along its longitudinal direction, a density of the tone adjustment pattern at one end portion in the longitudinal direction, which moves and first reaches the developer removal location due to a rotation of the intermediate transfer member, may be lowest, and a density of the tone adjustment pattern at another end portion in the longitudinal direction, which is opposite from the above referenced one end portion in the longitudinal direction, may be highest.

If the density of one end portion in the longitudinal direction is low, that is, if the amount of developer constituting the adjustment pattern at one end portion side in the longitudinal direction is low, then the removal member can suitably remove the developer even when a transfer voltage is supplied to the intermediate transfer member while the developer is being removed with the removal member. And if the density at the other end portion in the longitudinal direction is high, that is, if the amount of developer constituting the adjustment pattern at the other end portion side in the longitudinal direction is high, then the removal member can suitably remove the developer, by stopping the supply of the transfer voltage to the intermediate transfer member during the removal of the developer with the removal member. Therefore, if a tone patch has a long length in the longitudinal direction, then, with the above-described configuration, the effect that the adjustment pattern on the intermediate transfer member is suitably formed and the developer constituting the adjustment pattern is more suitably removed with the removal member is displayed more effectively.

Furthermore, four of the photoconductors bearing developer of different colors may be provided, the intermediate transfer member may serve as an intermediate medium when transferring the developer on these photoconductors onto a medium to form an image on that medium, and the adjustment pattern may be formed for each color.

If the image forming apparatus is provided with four photoconductors, and an adjustment pattern is formed for each of these colors, then the effect that the adjustment pattern is suitably formed on the intermediate transfer member and the developer constituting the adjustment pattern is suitably removed with the removal member is displayed more effectively.

It is also possible that a secondary transfer member is provided for transferring developer that has been moved to the secondary transfer location through rotation of the intermediate transfer member to a medium, that the four photoconductors are provided along the rotation direction of the intermediate transfer member, and that the controller causes the supply of the transfer voltage with the voltage supply section until the developer constituting the adjustment pattern is moved through the rotation of the intermediate transfer member and has reached the primary transfer location of the one photoconductor of the four photoconductors that is closest to the secondary transfer location on the upstream side, with respect to the rotation direction of the intermediate transfer member, and stops the supply of the transfer voltage with the voltage supply section after the developer constituting the adjustment pattern has reached the primary transfer location and before that developer has moved and has reached the developer removal location due to rotation of the intermediate transfer member.

In this case, it can be prevented that the developer constituting the adjustment pattern is transferred back to the photoconductors at a primary transfer location while being moved due to the rotation of the intermediate transfer member, so that the adjustment pattern of the four colors is suitably formed on the intermediate transfer member.

Outline of Image Forming Apparatus

Figure 2:
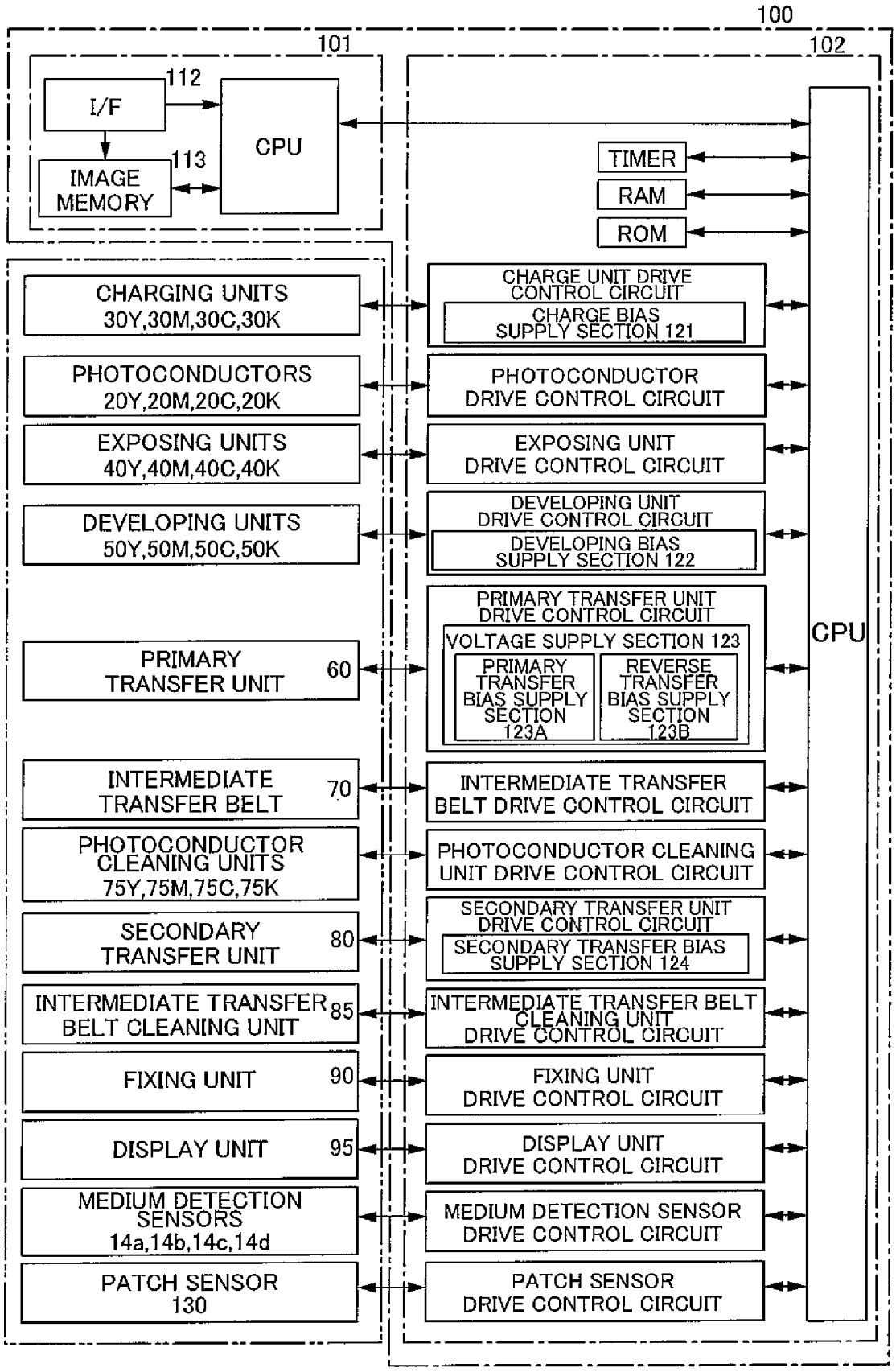
FIG. 2 is a block diagram showing the configuration of a control unit 100 of the printer 10.
Figure 3:
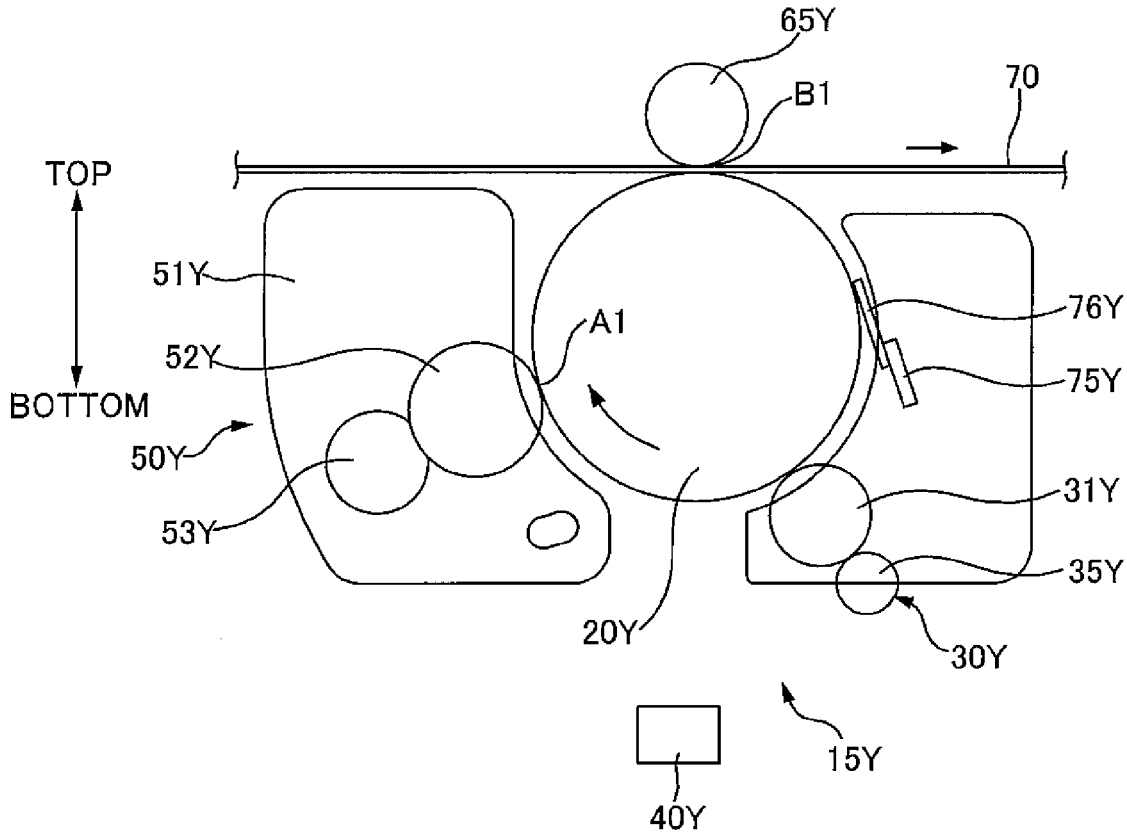
FIG. 3 is a diagram showing an image forming section 15Y.

Next, using FIGS. 1 to 3, a configuration example and an operation example of a laser beam printer (hereinafter, also referred to as "printer") 10 serving as an example of an image forming apparatus are described. FIG. 1 is a diagram showing the main structural components constituting the printer 10. FIG. 2 is a block diagram showing the configuration of a control unit 100 of the printer 10. FIG. 3 is a diagram showing an image forming section 15Y. It should be noted that in FIG. 1, the vertical direction is indicated by the arrows, and, for example, a paper supply tray 92 is arranged at a lower portion of the printer 10 and a fixing unit 90 is arranged at an upper portion of the printer 10. Similarly, also in FIG. 3, the arrows indicate the vertical direction.

Configuration of Printer 10

As shown in FIG. 1, the printer 10 according to the present embodiment includes image forming sections 15Y, 15M, 15C and 15K, an intermediate transfer belt 70 serving as an example of an intermediate transfer member, a primary transfer unit 60, backup rollers 65Y, 65M, 65C and 65K, a secondary transfer unit 80, an intermediate transfer belt cleaning unit 85, a fixing unit 90, a display unit 95, which is a liquid crystal panel constituting a means for making notifications to the user, and a control unit 100 controlling these units and letting them operate together as a printer.

The image forming sections 15Y, 15M, 15C and 15K have the function of forming a latent image or a toner image on photoconductors 20Y, 20M, 20C and 20K, which are examples of image bearing members. These four image forming sections 15Y, 15M, 15C and 15K are arranged in a row in a predetermined direction (the horizontal direction shown in FIG. 1). Of the four photoconductors 20Y, 20M, 20C and 20K, the photoconductor 20Y of the image forming section 15Y corresponds to a first image bearing member that is furthest removed from a secondary transfer location C1 on the upstream side with respect to the rotation direction of the intermediate transfer belt 70, and the photoconductor 20K of the image forming section 15K corresponds to a second image bearing member that is closest, of the four photoconductors, to the secondary transfer location C1 on the upstream side with respect to the rotation direction of the intermediate transfer belt 70.

The configuration of the image forming sections 15Y, 15M, 15C and 15K is similar, so that in the following, the image forming section 15Y is taken as an example of the four image forming sections. As shown in FIG. 3, the image forming section 15Y includes a charging unit 30Y, an exposing unit 40Y, a developing unit SOY, and a photoconductor cleaning unit 75Y, which are arranged in a rotation direction around the photoconductor 20Y.

The photoconductor 20Y includes a tubular base member (more specifically, an aluminum member) and a photoconductive layer formed on the outer circumferential surface of it, and carries a latent image on the surface of this photoconductive layer. The two axial end portions of this photoconductor 20Y are supported rotatively by the printer main unit, and in the present embodiment, the photoconductor 20Y rotate in a clockwise direction, as indicated by the arrow in FIG. 1.

The charging unit 30Y is a device for charging the photoconductor 20Y. As shown in FIG. 3, the charging unit 30Y includes a charging roller 31Y arranged in opposition of the photoconductor 20Y, for charging that photoconductor 20Y, and a cleaning roller 35Y abutting against the charging roller 31Y, for cleaning the surface of the charging roller 31Y. When a charge bias obtained by overlapping a DC voltage with an AC voltage is supplied to the charge roller 31Y from a charge bias supply section 121 (see FIG. 2), a discharge occurs between the charge roller 31Y and the photoconductor 20Y, and the photoconductor 20Y is charged as a result.

The charge roller 31Y is made by applying a conductive coating to the surface of a metal shaft. Moreover, a tape (not shown in the drawings) abutting against the photoconductor 20Y is attached to both axial end portions of the charge roller 31Y. The outer radius of this tape is larger than the outer radius of the central portion of the charge roller 31Y, so that a gap is formed between this central portion and the photoconductor 20Y. Therefore, the charge roller 31Y charges the photoconductor 20Y by so-called contactless charging.

The exposing unit 40Y is a device for forming a latent image on the charged photoconductor 20Y by irradiating it with a laser. The exposing unit 40Y includes, for example, a semiconductor laser, a polygon mirror, and an F-θ lens, and irradiates a modulated laser beam onto the charged photoconductor 20Y in accordance with image signals that have been input from a host computer, not shown in the drawings, such as a personal computer or a word processor.

The yellow developing unit 50Y is a device for visualizing the latent image formed on the photoconductor 20Y as a yellow toner image using yellow (Y) toner, which is an example of developer, at a developing location A1. As shown in FIG. 3, this yellow developing unit 50Y includes a toner container 51Y for containing yellow toner, a developing roller 52Y for bearing this yellow toner and developing a latent image on the photoconductor 20Y, a supply roller 53Y for supplying the toner in the toner container 51Y to the developing roller 52Y, and a regulating blade (not shown in the drawings) for charging the yellow toner borne by the developing roller 52Y (charging the toner negatively in the present embodiment).

Moreover, the developing roller 52Y and the photoconductor 20Y oppose each other via a gap, and when the developing bias obtained by overlapping a DC voltage and an AC voltage is supplied by a developing bias supply section 122 (see FIG. 2) to the developing roller 52Y, an electric field is formed between the developing roller 52Y and the photoconductor 20Y, and the latent image on the photoconductor 20Y is developed.

The intermediate transfer belt 70 serves as an intermediate medium when forming an image on a medium (such as paper, film or cloth) by transferring toner images (toner) of different colors borne by the four photoconductors 20Y, 20M, 20C and 20K, and moves the toner image by rotating in the direction indicated by the arrow in FIG. 1, in a state in which it carries the toner images. Moreover, the intermediate transfer belt 70 abuts against the photoconductors 20Y, 20M, 20C and 20K, which are arranged along the rotation direction of the intermediate transfer belt 70, and the locations where the intermediate transfer belt 70 abuts against the photoconductors form primary transfer locations B1, B2, B3 and B4 where the toner images on the photoconductors are transferred to the intermediate transfer belt 70. It should be noted that the configuration of the intermediate transfer belt 70 is described in detail later.

The primary transfer unit 60 (see FIG. 4) is an apparatus for transferring the toner images formed on the photoconductors 20Y, 20M, 20C and 20K onto the intermediate transfer belt 70 (this is referred to as primary transfer in the following), in cooperation with backup rollers 65Y, 65M, 65C and 65K, which are described later. This primary transfer unit 60 abuts against the intermediate transfer belt 70, and a primary transfer bias supply section 123*a* (see FIG. 2) of the voltage supply section 123 supplies to the intermediate transfer belt 70 a primary transfer bias serving as a transfer voltage, through this primary transfer unit 60.

Here, the primary transfer bias is a voltage for letting the toner on the photoconductors 20Y, 20M, 20C and 20K advance to the intermediate transfer belt 70 at the primary transfer locations B1, B2, B3 and B4. Moreover, the primary transfer bias is a voltage of the polarity opposite to that of the (negative) polarity with which the toner on the photoconductors is charged. When the primary transfer bias is supplied to the intermediate transfer belt 70, an electric field is formed at the primary transfer locations B1, B2, B3 and B4 between the photoconductors 20Y, 20M, 20C and 20K and the intermediate transfer belt 70. It should be noted that the primary transfer unit 60 and the voltage supply section 123 are explained in more detail further below.

The backup rollers 65Y, 65M, 65C and 65K abut against the photoconductors 20Y, 20K, 20C and 20K of the respective four image forming sections 15Y, 15M, 15C and 15K through the intermediate transfer belt 70. Moreover, when the backup rollers 65Y, 65M, 65C and 65K abut against the photoconductors 20Y, 20M, 20C and 20K through the intermediate transfer belt 70 and the electric field is formed between the intermediate transfer belt 70 and the photoconductors at the primary transfer locations B1, B2, B3 and B4 as explained above, a primary transfer of the toner images on the photoconductors 20Y, 20M, 20C and 20K at the primary transfer locations B1, B2, B3 and B4 onto the intermediate transfer belt 70 is performed. Thus, a full color toner image is formed on the intermediate image transfer belt 70.

The photoconductor cleaning unit 75Y is a device for removing and collecting toner that has remained on the photoconductor 20Y after the toner image on the intermediate transfer belt 70 has been transferred by the primary transfer unit 60. This photoconductor cleaning unit 75Y includes a photoconductor cleaning blade 76Y. The tip of this photoconductor cleaning blade 76Y abuts against the surface of the photoconductor 20Y and removes the toner image (toner) that has remained on the photoconductor 20Y without being transferred to the intermediate transfer belt 70.

The secondary transfer unit 80 is a device for transferring a single color toner image or a full color toner image formed on the intermediate image transfer belt 70 to a medium (this is also referred to as "secondary transfer" in the following). The secondary transfer unit 80 includes a secondary transfer roller 82, which is an example of the secondary transfer member that can be brought into contact with the intermediate transfer belt 70. This secondary transfer roller 82 is for transferring onto the medium the toner image (toner) that has been moved to a secondary transfer location C1 through the rotation of the intermediate transfer belt 70. More specifically, when the secondary transfer bias is supplied by the secondary transfer bias supply section 124 (FIG. 2) to the secondary transfer roller 82, an electric field is formed between the intermediate transfer belt 70 and the secondary transfer roller 82 at the secondary transfer location C1, and the toner image on the intermediate transfer belt 70 is transferred by secondary transfer to the medium.

The intermediate transfer belt cleaning unit 85 is a device for removing the toner that has remained on the intermediate transfer belt 70 without being transferred by secondary transfer to the medium at the secondary transfer location C1. The intermediate transfer belt cleaning unit 85 includes a container 86 for containing removed toner and an intermediate transfer belt cleaning blade 87 serving as an example of a removal member.

The intermediate transfer belt cleaning blade 87 is provided on the downstream side in the rotation direction of the intermediate transfer belt 70 with respect to the secondary transfer location C1, and is for removing the toner remaining on the intermediate transfer belt 70 without being transferred to the medium by the secondary transfer roller 82. The tip of this intermediate transfer belt cleaning unit 87 abuts against the surface of the intermediate transfer belt 70, and removes the toner that has remained on the intermediate transfer belt 70 without being transferred by secondary transfer to the medium at the secondary transfer location C1. The intermediate transfer belt cleaning blade 87 abuts in such a manner against the intermediate transfer belt 70, that its tip faces the upstream side in the rotation direction of the intermediate transfer belt 70.

The fixing unit 90 is a device for fusing the single-color toner image or the full-color toner image, which has been transferred to the medium, by applying heat and pressure onto the medium to turn it into a permanent image. The fixing unit 90 includes a fixing roller 90*a* and a pressure roller 90*b*. The fixing roller 90*a* is for heating the toner image on the medium and fusing the toner image onto the medium. The pressure roller 90*b* is for applying pressure to the toner image on the medium, through cooperation with the fixing roller 90*a*.

Moreover, a medium transport path 13 for transporting the medium from the paper supply tray 92 to the paper discharge tray 98 is formed extending from the lower portion to the upper portion of the printer 10. This medium transport path 13 is configured with a plurality of guide members. Moreover, along the medium transport path 13, a plurality of rollers, such as a paper supply roller 94*a*, registration rollers 94*b* and paper discharge rollers 94*c*, are arranged, which have the function to transport the medium. Along the medium transport path 13, there are also four medium detection sensors 14*a*, 14*b*, 14*c* and 14*d* for detecting the medium that is being transported along the medium transport path 13 by the plurality of rollers.

Moreover, a cover 12 that can be opened and closed is provided on the front side of the printer 10. For example, when the medium jams the medium transport path 13, the operator can remove the jammed medium by opening the cover 12 in the direction out of the paper plane in FIG. 1. Moreover, an open/closed detection sensor for detecting whether the cover 12 is open or closed (not shown in the drawings) is provided at the periphery of the cover 12.

The control unit 100 includes a main controller 101 and a unit controller 102, as shown in FIG. 2. An image signal and a control signal are input into the main controller 101, and in accordance with a command based on the image signal and the control signal, the unit controller 102 controls the various units, for example, to form the image.

Operation of the Printer 10

The color image forming operation of the printer 10 configured as above is described next, referring to other structural components thereof as well.

First, when an image signal and a control signal are input from a host computer (not shown in the drawings) via an interface (I/F) 112 into the main controller 101 of the printer 10, the photoconductors 20Y, 20M, 20C and 20K, the developing rollers 52Y, 52M, 52C and 52K provided in the developing units 50Y, 50M, 50C and 50K, and the intermediate transfer belt 70 are rotated under the control of the unit controller 102, based on commands from the main controller 101.

While rotating, the photoconductors 20Y, 20M, 20C and 20K are successively charged by the charging units 30Y, 30M, 30C and 30K (more specifically, the charge rollers 31Y, 31M, 31C and 31K to which the charge bias is supplied) at the charge positions. The charged regions of the photoconductors 20Y, 20M, 20C and 20K reach the exposing position due to the rotation of the photoconductors 20Y, 20M, 20C and 20K, and latent images corresponding to the yellow (Y), magenta (M), cyan (C) and black (K) image information are formed in the charged regions by the exposing units 40Y, 40M, 40C and 40K.

The latent images formed on the photoconductors 20Y, 20M, 20C and 20K reach the developing locations A1, A2, A3 and A4 due to the rotation of the photoconductors 20Y, 20M, 20C and 20K, and are made visible (developed) as toner images by developing units 50Y, 50M, 50C and 50K (more specifically, by developing rollers 52Y, 52M, 52C and 52K). Thus, single color toner images are formed on the photoconductors 20Y, 20M, 20C and 20K. It should be noted that during the development, a developing bias is supplied to the developing rollers 52Y, 52M, 52C and 52K.

The single color toner images formed on the photoconductors 20Y, 20M, 20C and 20K reach the primary transfer locations B1, B2, B3 and B4 due to the rotation of the photoconductors 20Y, 20M, 20C and 20K, and are transferred by primary transfer to the intermediate transfer belt 70 with the primary transfer unit 60 and the backup rollers 65Y, 65M, 65C and 65K. In this situation, the primary transfer bias is supplied to the intermediate transfer belt 70. As a result, the four colored toner images formed on the respective photoconductors 20Y, 20M, 20C and 20K are transferred by primary transfer such that they are overlapped sequentially on the intermediate transfer belt 70, and a full-color toner image is formed on the intermediate transfer belt 70.

The full-color toner image formed on the intermediate transfer belt 70 reaches the secondary transfer location C1 through the rotation of the intermediate transfer belt 70, and is transferred by secondary transfer with the secondary transfer unit 80 (more specifically, the secondary transfer roller 82) to the medium. It should be noted that the medium is transported from the paper supply tray 92 to the secondary image transfer location C1 via the paper supply roller 94*a* and the registration rollers 94*b*. Moreover, when the secondary transfer operation is performed, the secondary transfer roller 82 clamps the medium transported to the secondary transfer location C1 together with the intermediate transfer belt 70, and the secondary transfer bias is supplied to the secondary transfer roller 82.

When the medium onto which the full-color toner image has been transferred by secondary transfer is transported into the fixing unit 90, it passes between the fixing roller 90*a* and the pressure roller 90*b* while being clamped by the fixing roller 90*a* and the pressure roller 90*b*. In this situation, the fixing roller 90*a* and the pressure roller 90*b* fuse the full-color toner image to the medium by applying heat and pressure to the full-color toner image on the medium. Then, the medium onto which the full-color toner image has been fused, is transported to the paper discharge tray via the paper discharge rollers 94*c*.

On the other hand, the toner remaining on the photoconductors 20Y, 20M, 20C and 20K without being transferred by primary transfer to the intermediate transfer belt 70 at the primary transfer locations B1, B2, B3 and B4 is removed by the photoconductor cleaning blades 76Y, 76M, 76C and 76K. Moreover, the toner remaining on the intermediate transfer belt 70 without being transferred to the medium by secondary transfer at the secondary transfer location C1 is removed by the intermediate transfer belt cleaning blade 87.

Overview of the Control Unit

The configuration of the control unit 100 is described next, with reference to FIG. 2. The main controller 101 of the control unit 100 is connected to a host computer via an interface 112, and is provided with an image memory 113 for storing image signals that it receives from this host computer.

The unit controller 102 is electrically connected to the various units of the apparatus main body (the photoconductors 20Y, 20M, 20C, 20K, the charging units 30Y, 30M, 30C, 30K, the exposing units 40Y, 40M, 40C, 40K, the developing units SOY, 50M, 50C, 50K, the primary transfer unit 60, the intermediate transfer belt 70, the photoconductor cleaning units 75Y, 75K, 75C, 75K, the secondary transfer unit 80, the intermediate transfer belt cleaning unit 85, the fixing unit 90, and the display unit 95), and controls the various units, based on signals input from the main controller 101, while detecting the states of the units by receiving signals from the sensors with which these units are provided.

Intermediate Transfer Belt 70, Primary Transfer Unit 60 and Voltage Supply Section 123

Figure 4:
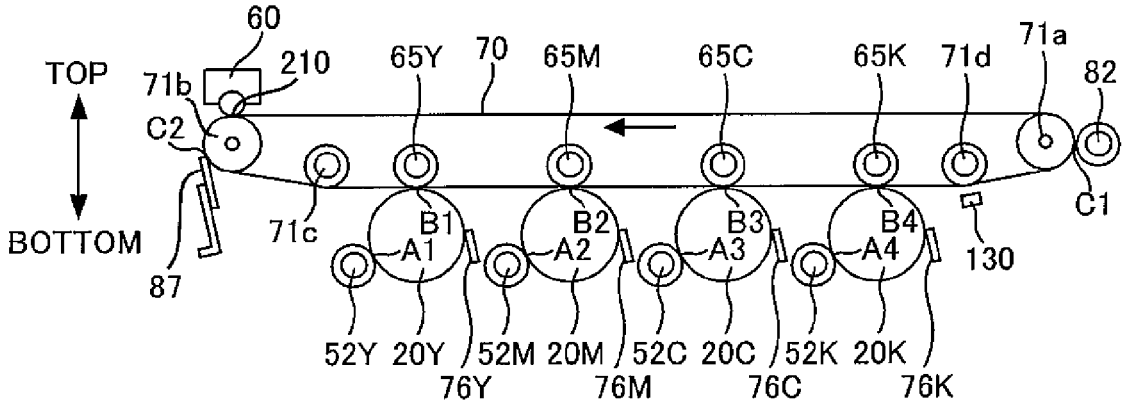
FIG. 4 is a drawing showing the intermediate transfer belt 70.
Figure 5:
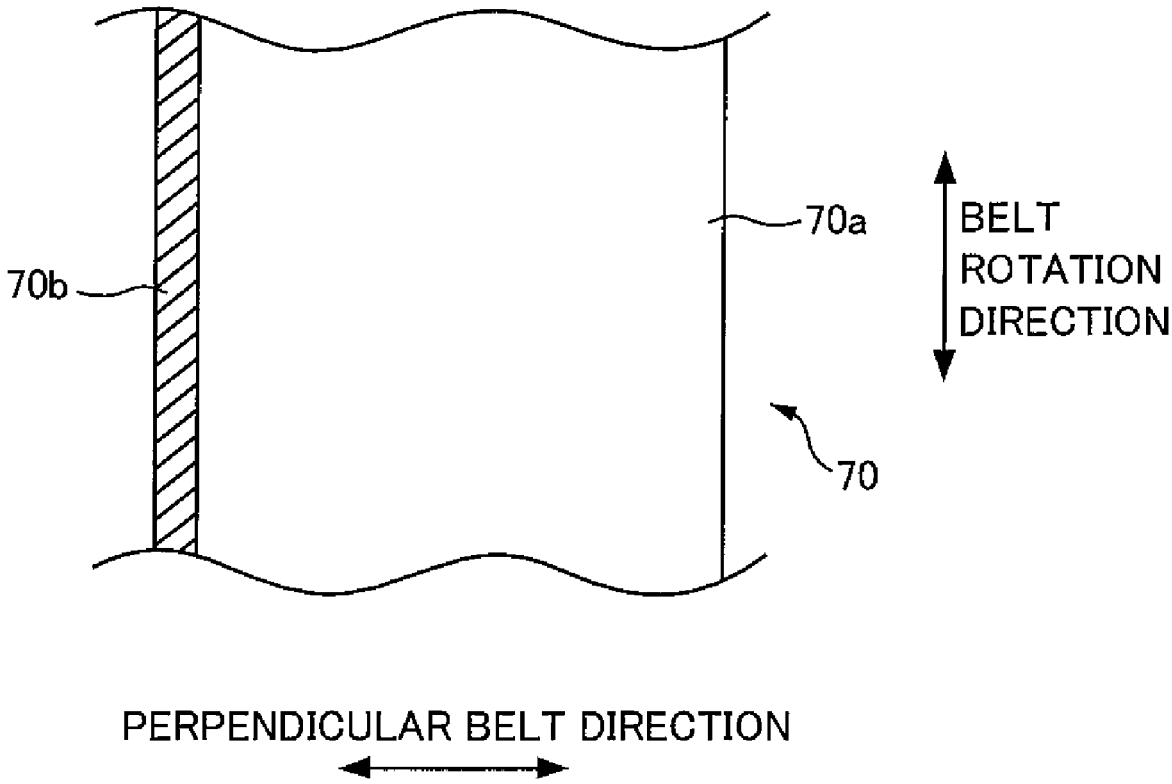
FIG. 5 is a diagrammatic view showing a portion of the outer peripheral surface of the intermediate transfer belt 70.
Figure 6:
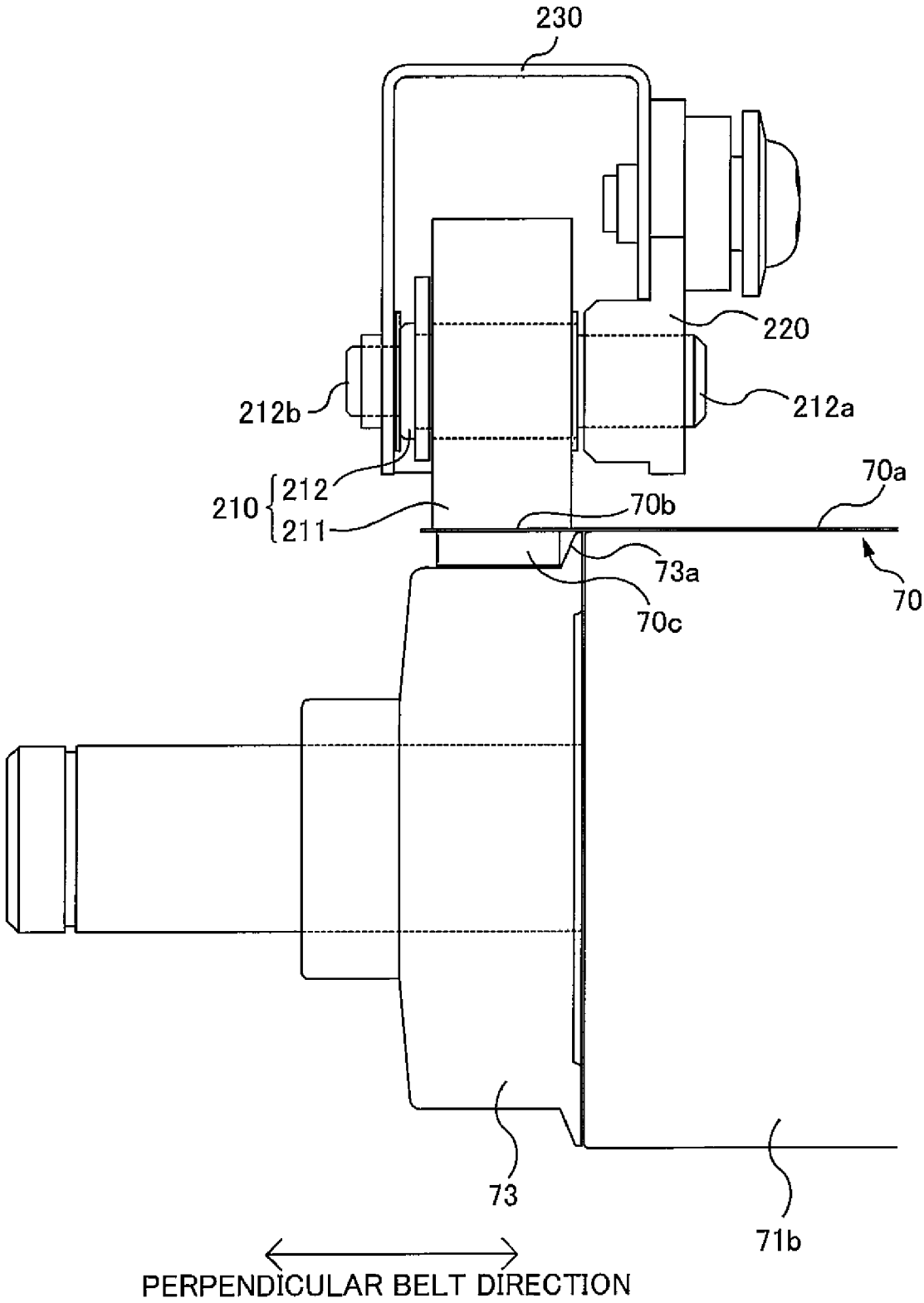
FIG. 6 is a drawing showing the state in which the intermediate transfer belt 70 abuts against the primary transfer unit 60.

Next, the intermediate transfer belt 70, the primary transfer unit 60 and the voltage supply section 123 are explained with reference to FIGS. 2 and 4 to 6. FIG. 4 is a drawing showing the intermediate transfer belt 70 and the like. FIG. 5 is a diagrammatic view showing a portion of the outer peripheral surface of the intermediate transfer belt 70. FIG. 6 is a drawing showing the state in which the intermediate transfer belt 70 abuts against the primary transfer unit 60.

Detailed Configuration of the Intermediate Transfer Belt 70

As mentioned before, the intermediate transfer belt 70 serves as an intermediate medium when transferring the toner (toner images) on the photoconductors 20Y, 20M, 20C and 20K to the medium (paper, film, cloth or the like), and moves the toner by rotating in a state in which it carries the toner, in order to transfer the toner to the medium.

This intermediate transfer belt 70 is a layered endless belt, made by forming a tin vapor deposition layer on the surface of a PET film and applying a semiconductive coating to this surface layer (in the following, this layer of semiconductive coating is also referred to as resistive layer 70*a* (see FIG. 5)). Moreover, at one end portion in the perpendicular direction (also referred to as "perpendicular belt direction" in the following) perpendicular to the rotation direction of the intermediate transfer belt 70 (the direction indicated by the arrows in FIG. 5), an electrode layer 70*b* is formed along the rotation direction of the intermediate transfer belt 70, instead of the resistive layer 70*a*. The toner on the photoconductors 20Y, 20M, 20C and 20K is transferred by primary transfer to the resistive layer 70*a* at the primary transfer locations B1, B2, B3 and B4.

Beads 70*c* (see FIG. 6) are fixed at the inner circumferential surface of the intermediate transfer belt 70 at both end portions in the perpendicular belt direction, protruding inward from the intermediate transfer belt 70. The beads 70*c* are arranged substantially over the entire circumference of the intermediate transfer belt 70, along the rotational direction of the intermediate transfer belt 70.

On the inner side of the intermediate transfer belt 70, a driving roller 71*a*, a driven roller 71*b*, a roller 71*c* and a roller 71*d* are arranged, in addition to the backup rollers 65Y, 65M, 65C and 65K mentioned before. Abutting against the inner circumferential surface of the intermediate transfer belt 70, the driving roller 71*a* has the function of rotatively driving the intermediate transfer belt 70 at substantially the same circumferential speed as the photoconductors 20Y, 20M, 20C and 20K. The driven roller 71*b*, the roller 71*c* and the roller 71*d* suspend the intermediate transfer belt 70 in a rotatable manner, abutting against the inner circumferential surface of the intermediate transfer belt.

The driven roller 71*b* abuts against a central portion, with respect to the perpendicular belt direction, of the intermediate transfer belt 70, and rotating members 73 that can rotate with respect to the driven roller 71*b* are arranged at both its axial end portions. The rotating members 73 each have a tapered section 73*a* on the side of the driven roller 71*b*, and the tapered section 73*a* restricts the movement of the intermediate transfer belt 70 in the perpendicular belt direction by contacting the beads 70*c*.

Moreover, a patch sensor 130, which is an example of a pattern detection member for detecting an adjustment pattern (described in detail further below) formed on the intermediate transfer belt 70, is arranged near the intermediate transfer belt 70. The printer 10 performs an operation for adjusting the image quality of the images at predetermined times (this is explained in detail below), and at those times, the patch sensor 130, which is a reflective optical sensor, is used.

Detailed Configuration of the Primary Transfer Unit 60

As mentioned above, the intermediate transfer belt 70 abuts against the primary transfer unit 60. As shown in FIG. 6, this primary transfer unit includes an electrode roller 210, which is an example of a conductive member, a roller bearing 220 rotatively supporting the electrode roller 210, a roller support metal plate 230 rotatively supporting the electrode roller 210 and the like.

The electrode roller 210 abuts against the electrode layer 70*b* of the intermediate transfer belt 70, as shown in FIG. 6. Moreover, the electrode roller 210 is adapted to rotate together with the rotation of the intermediate transfer belt 70 when abutting against the electrode layer 70*b*. That is to say, the electrode roller 210 is a driven roller that follows the rotation of the intermediate transfer belt 70. Moreover, the electrode roller 210 is provided at a position facing the bead 70*c* arranged on the other side of the intermediate transfer belt 70.

As shown in FIG. 6, the electrode roller 210 includes an abutting section 211 that abuts against the electrode layer 70*b* of the intermediate transfer belt 70, and a roller shaft 212, whose outer diameter is smaller than that of the abutting section 211. The abutting section 211 is an elastic conductive roller and is made of a single foam obtained by dispersing carbon as a conductive agent into urethane, for example. The roller shaft 212 is made of metal and is arranged such that its one axial end 212*a* is positioned towards the center of the intermediate transfer belt 70 in the perpendicular belt direction, and its other axial end 212*b* is positioned at the edge of the intermediate transfer belt 70 in the perpendicular belt direction.

As shown in FIG. 6, the roller bearing 220 is attached to the roller support metal plate 230 and rotatively receives the one end 212*a* of the roller shaft 212 of the electrode roller 210. The roller support metal plate 230 is made of metal, and as shown in FIG. 6, it supports the one end 212*a* of the roller shaft 212 of the electrode roller 210 via the roller bearing 220, and directly supports the other end 212*b* of the roller shaft 212.

Voltage Supply Section 123

As noted above, a primary transfer bias is supplied to the intermediate transfer belt 70 from the voltage supply section 123 via the primary transfer unit 60. The voltage supply section 123 supplies the primary transfer bias to the intermediate transfer belt 70, and is also capable of supplying to the intermediate transfer belt 70 a reverse transfer bias, which is a reverse transfer voltage, for repelling the toner on the intermediate transfer belt 70 from the intermediate transfer belt 70. Moreover, the voltage supply section 123 supplies the primary transfer bias or the reverse transfer bias across the entire intermediate transfer belt 70 via the primary transfer unit 60.

As shown in FIG. 2, the voltage supply section 123 includes a primary transfer bias supply section 123*a* and a reverse transfer bias supply section 123*b*. The primary transfer bias supply section 123*a* is for supplying the primary transfer bias to the intermediate transfer belt 70. The reverse transfer bias supply section 123*b* is for supplying the reverse transfer bias to the intermediate transfer belt 70. Moreover, during the operation of the printer 10, either the primary transfer bias supply section 123*a* or the reverse transfer bias supply section 123*b* supply the primary transfer bias or the reverse transfer bias to the intermediate transfer belt 70, or neither the primary transfer bias supply section 123*a* nor the reverse transfer bias supply section 123*b* supply the primary transfer bias or the reverse transfer bias to the intermediate transfer belt 70.

First Embodiment

Operation of the Printer 10 in the Case of a Jam During the Image Formation According to the First Embodiment In the printer 10, a situation may arise in which the image forming operation is stopped while carrying out the image forming operation. This may be the case when the operator and the like opens the cover 12 during the image forming operation or when the medium is jammed in the medium transport path 13 during the image forming operation (so-called jamming of the medium). This is explained for the example of jamming of the medium.

While carrying out an image forming operation, the medium may become jammed while being sandwiched between the intermediate transfer belt 70 and the secondary transfer roller 82 at the secondary transfer location C1. When there is a jamming of the medium during the image forming operation, the printer 10 stops the image forming operation while it is still midway. Therefore, in order to resume the image forming operation, it is necessary to resolve the jam by removing the jammed medium.

Now, when the operation of the printer 10 is stopped during the image formation due to jamming of the medium, remaining toner is located between the primary transfer locations (for example, the primary image location B1) and the secondary image location C1. Moreover, remaining toner may be located between the developing location A1 (A2, A3, A4) and the primary transfer location B1 (B2, B3, B4) on the photoconductor 20Y (20M, 20C, 20K) (see FIG. 9A). In this situation, it is necessary that the remaining toner is removed with the photoconductor cleaning blades 76Y, 76M, 76C and 76K and the intermediate transfer belt cleaning blade 87, such that the image formation can be resumed after the jamming has been resolved.

Accordingly, when jamming of the medium has occurred, the printer 10 carries out the following operation: The printer 10 notifies the operator and the like that jamming has occurred, in order to let the operator remove the jammed medium. After this, the photoconductors 20Y, 20M, 20C and 20K and the intermediate transfer belt 70 are caused to rotate after the jammed medium has been removed (that is, after the jamming has been resolved), and the remaining toner is removed by the photoconductor cleaning blades and the intermediate transfer belt cleaning blade.

Figure 7:
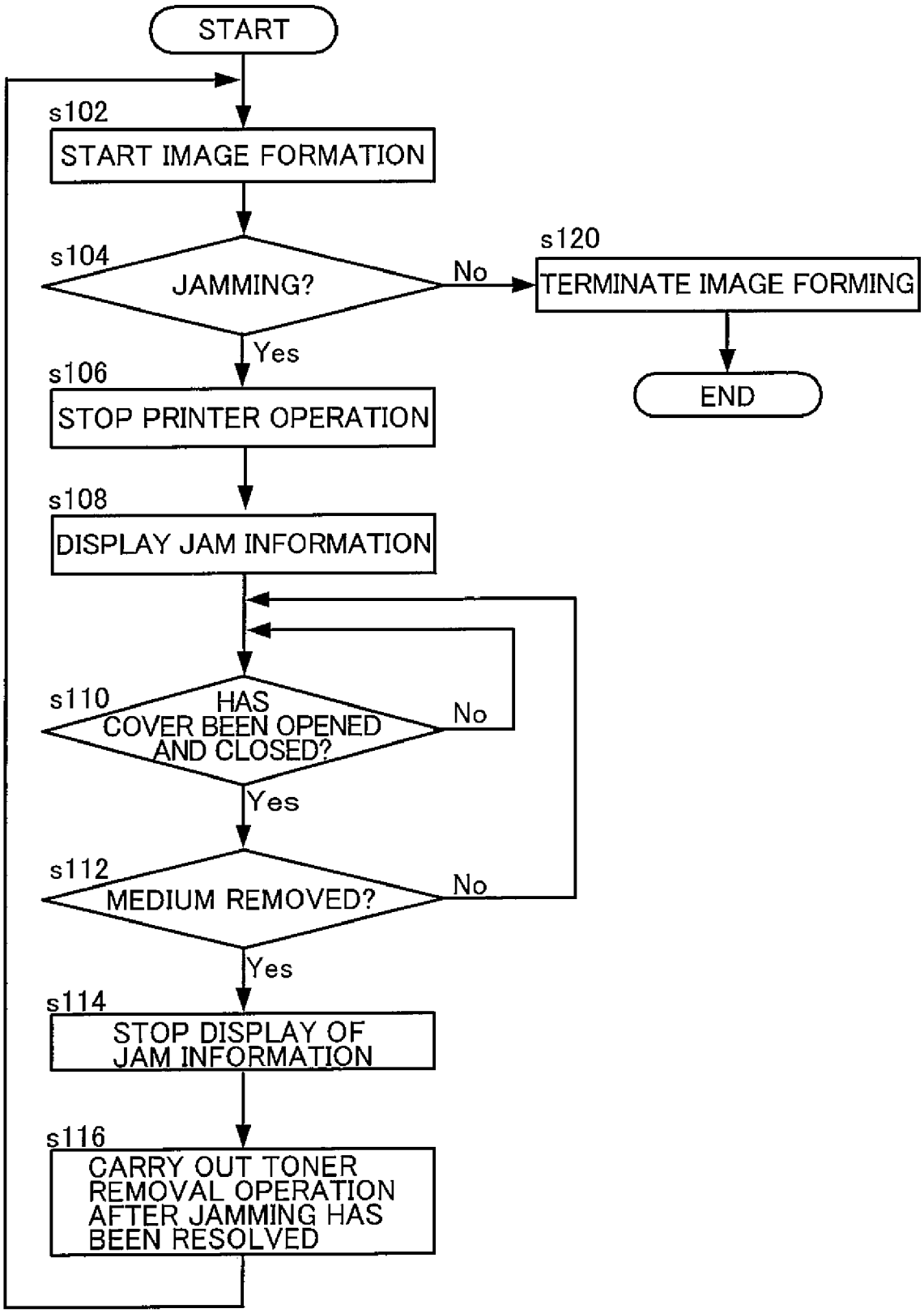
FIG. 7 is a flowchart illustrating the operation of the printer 10 in the case that jamming has occurred during the image formation, according to a first embodiment.

Working Example of the Operation of the Printer 10 According to the First Embodiment In the foregoing, the regular image forming operation without jamming has been explained, and in the following, the operation of the printer 10 in the case that jamming occurs during the image forming is explained with reference to FIG. 7. FIG. 7 is a flowchart illustrating the operation of the printer 10 in the case that jamming has occurred during the image formation.

The various operations that are carried out by the printer 10 are realized mainly by the control unit 100, which is an example of a controller (see FIG. 2). In particular, in the present embodiment, this is achieved by the CPU executing a program stored in a ROM. Also, this program is constituted by code for performing the various operations described below.

The control unit 100 begins the above-noted image forming operation when it receives image signals and control signals from the host computer (Step s102). Here, it is assumed that a color image is to be formed on one sheet of medium.

Then, the control unit 100 stops the operation of the printer 10 (Step s106) when it is judged with the medium detection sensors 14*a*, 14*b*, 14*c*, 14*d* that jamming of the medium has occurred in the medium transport path 13 during the color image formation (Step s104: Yes). In the present embodiment, it is assumed that the medium is jammed while being sandwiched by the intermediate transfer belt 70 and the secondary transfer roller 82 (see FIG. 9A). Then, the control unit 100 stops the rotation of the photoconductors 20Y, 20M, 20C and 20K and the intermediate transfer belt 70 (see FIGS. 8 and 10) and separates the secondary transfer roller 82 from the intermediate transfer belt 70. Moreover, the control unit 100 interrupts the supply of the developing bias to the developing rollers 52Y, 52M, 52C and 52K, the supply of the primary transfer bias to the intermediate transfer belt 70 and the supply of the secondary transfer bias to the secondary transfer roller 82.

Furthermore, the control unit 100 displays on the display unit 95 a jam information indicating the occurrence of jamming (Step s108), to let the operator know that jamming has occurred.

Figure 9A:
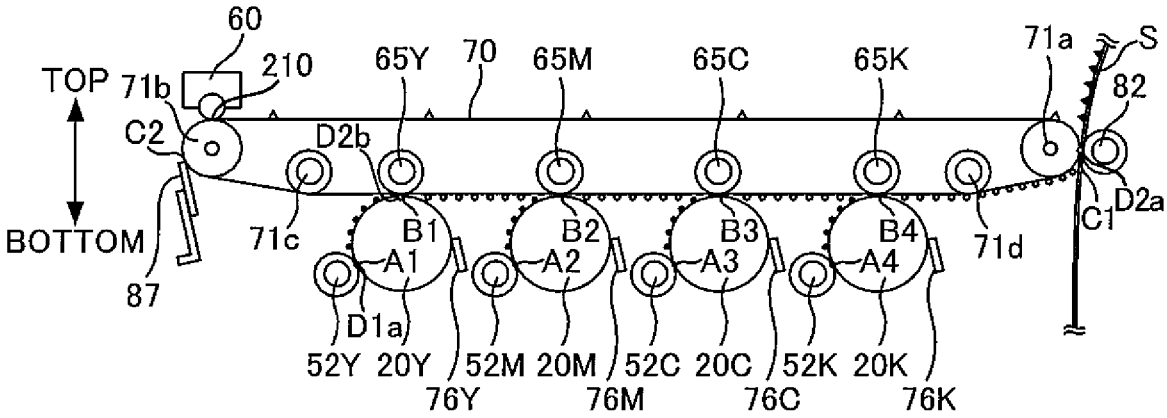
FIG. 9A is a diagram showing the state of the remaining toner when jamming has occurred, in accordance with the first embodiment.

Now, when jamming occurs (more specifically, when jamming occurs and the operation of the printer 10 has stopped), toner is located on the medium S, as indicated by the black triangles (▲) in FIG. 9A, but toner is also located on the photoconductors 20Y, 20M, 20C and 20K and on the intermediate transfer belt 70. More specifically, when jamming occurs, remaining toner (also referred to as "toner D1 remaining on the photoconductor") is located between the developing locations and the primary transfer locations on the photoconductors 20Y, 20M, 20C and 20K, as indicated by the black circles (•) in FIG. 9A. Moreover, as indicated by the white circles (○) in FIG. 9A, remaining toner (also referred to as "remaining toner D2 not yet transferred by secondary transfer" is located upstream from the secondary transfer location C1, with respect to the rotation direction of the intermediate transfer belt 70, between the primary transfer location B1 and the secondary transfer location C1. Moreover, as indicated by the white triangles (Δ) in FIG. 9A, remaining toner (also referred to as "remaining toner D3 not transferred by secondary transfer" is located downstream from the secondary transfer location C1, with respect to the rotation direction of the intermediate transfer belt 70, between the secondary transfer location C1 and the toner removal location C2.

Returning to the flowchart in FIG. 7, the explanation of the operation of the printer 10 is now continued. If the control unit 100 has detected with the above-noted open/closed detection sensor that the cover 12 has been opened and closed again after the jamming (Step s110: Yes), then it lets the medium detection sensors 14*a*, 14*b*, 14*c*, 14*d* detect whether medium is present in the medium transport path 13 (Step s112).

Figure 8:
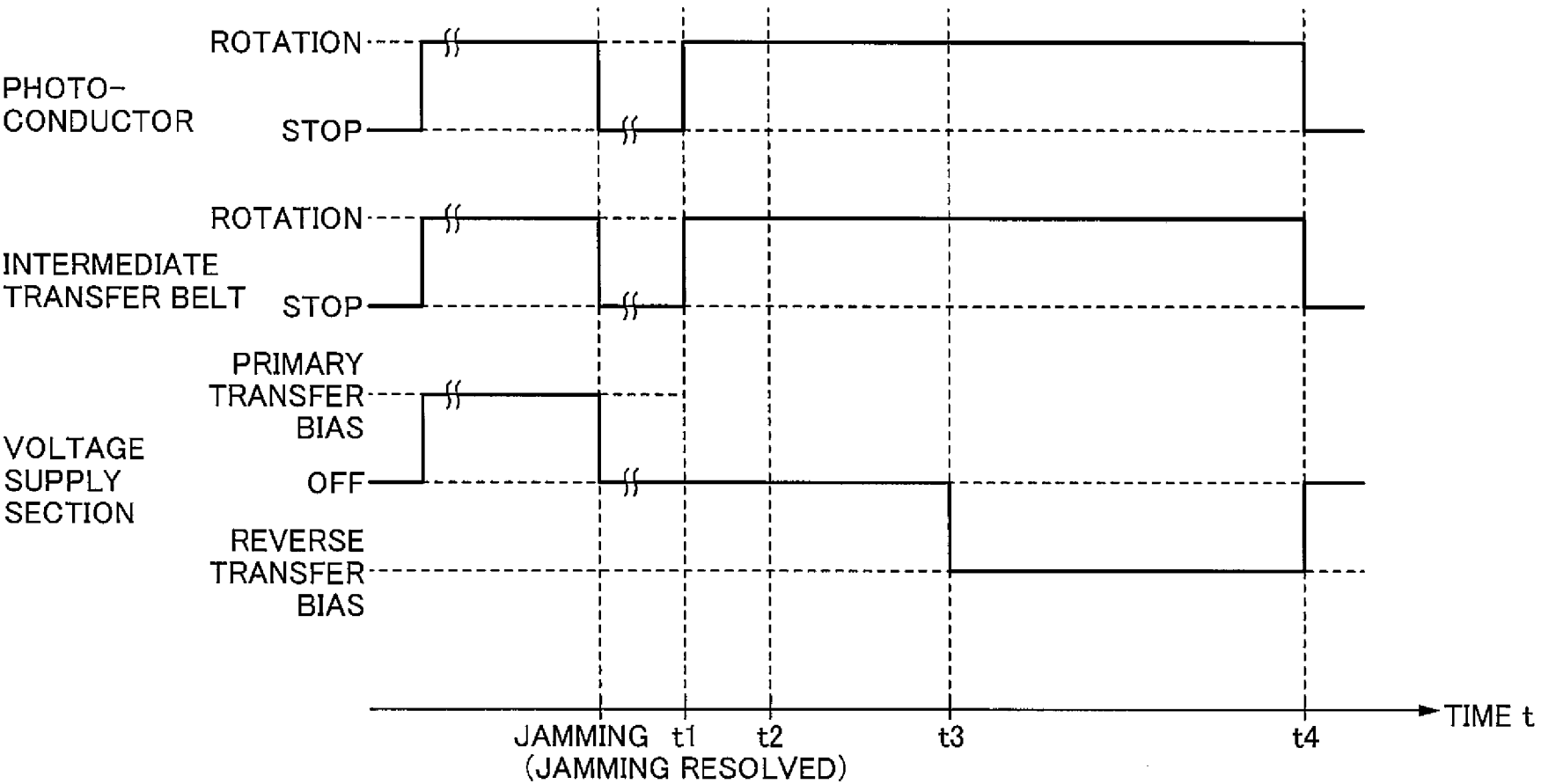
FIG. 8 is a timing chart illustrating the toner removal operation after jamming has been resolved according to a first working example of this first embodiment.
Figure 9B:
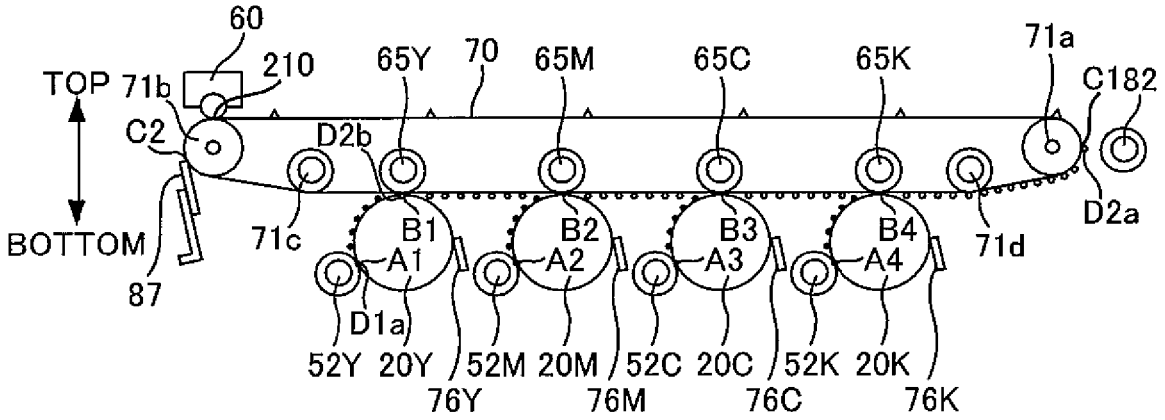
FIG. 9B is a diagram showing the state of the remaining toner at the time t1 in FIG. 8.

In the present working example, it is assumed that the medium has been removed, as shown in FIG. 9B, between the opening and the closing of the cover 12. Accordingly, since the medium detection sensors 14*a*, 14*b*, 14*c* and 14*d* do not detect the medium anymore (Step s112: No), the control unit 100 judges that the jammed medium has been removed. That is to say, the control unit 100 judges that the jamming has been resolved (see FIGS. 8 and 10).

When the control unit 100 judges that the jamming has been resolved, it first interrupts the display of the jam information on the display unit 95 (Step s114). Then, the control unit 100 begins the execution of the operation (also referred to as "toner removal operation after jamming has been resolved") for removing the remaining toner that remains on the photoconductors 20Y, 20M, 20C and 20K and the intermediate transfer belt 70 when the jamming occurred (Step s116). By executing this "toner removal operation after jamming has been resolved", the remaining toner is removed by the photoconductor cleaning blades 76Y, 76M, 76C and 76K and the intermediate transfer belt cleaning blade 87. The details of this "toner removal operation after jamming has been resolved" are explained further below.

After the control unit 100 has terminated the "toner removal operation after jamming has been resolved", the formation of the color image that could not be formed on the medium due to the jamming is executed again (Step s102). Then, if there is no jamming of a medium during the color image forming operation (Step s104: no), the printer 10 carries out the next image formation after the formation of the color image has been terminated (Step s120).

Toner Removal Operation after Jamming has been Resolved According to the First Embodiment The following is an explanation of two working examples of the toner removal operation after jamming has been resolved. It should be noted that in these working examples, mainly the operations of the photoconductors 20Y, 20M, 20C, 20K, the intermediate transfer belt 70 and the voltage supply section 123, as well as the state of the remaining toner on the photoconductors 20Y, 20M, 20C, 20K and the intermediate transfer belt 70 during the toner removal operation after jamming has been resolved are explained.

First Working Example According to the First Embodiment

Figure 9C:
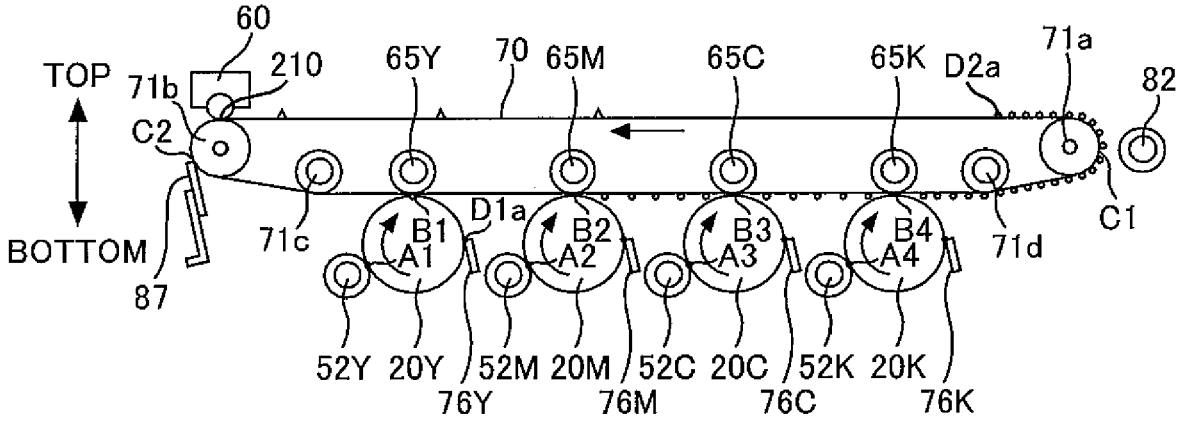
FIG. 9C is a diagram showing the state of the remaining toner at the time t2 in FIG. 8.
Figure 9D:
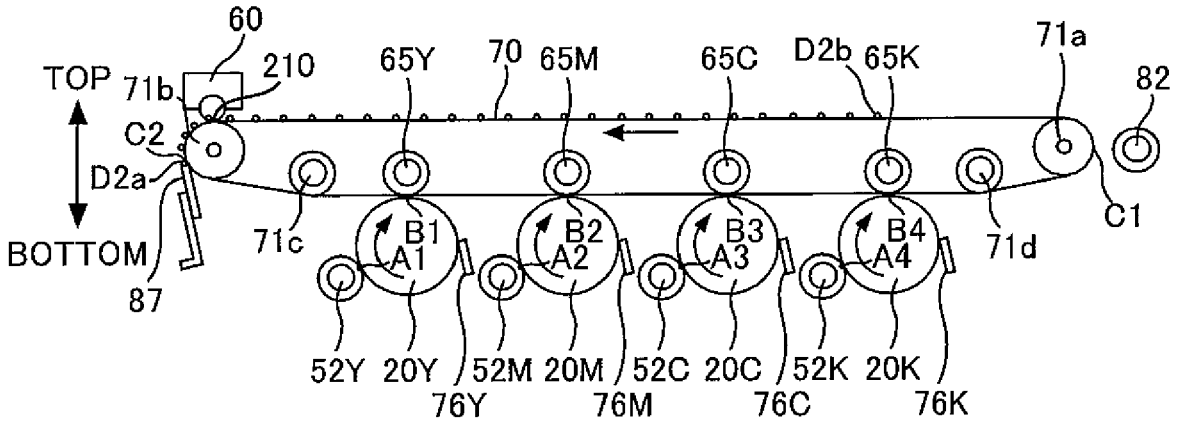
FIG. 9D is a diagram showing the state of the remaining toner at the time t3 in FIG. 8.

The first working example of the toner removal operation after jamming has been resolved is explained with reference to FIGS. 8 and 9A and 9D. FIG. 8 is a timing chart illustrating the toner removal operation after jamming has been resolved according to this first working example. FIGS. 9A to 9D are diagrammatic views showing the state of the remaining toner on the photoconductors 20Y, 20M, 20C and 20K and on the intermediate transfer belt 70. FIG. 9A shows the state of the remaining toner when jamming occurs, FIG. 9B shows the state of the remaining toner at the time t1 in FIG. 8, FIG. 9C shows the state of the remaining toner at the time t2 in FIG. 8, and FIG. 9D shows the state of the remaining toner at the time t3 in FIG. 8. It should be noted that in FIG. 8, the arrow indicates time t. The white and black circles and triangles (○, •, Δ, ▲) in FIGS. 9A to 9D represent toner.

As mentioned above, the control unit 100 begins the execution of the toner removal operation after jamming has been resolved when it has judged that the jamming has been resolved (at the time t1 in FIG. 8). More specifically, at the time t1, the control unit 100 lets the photoconductors 20Y, 20M, 20C and 20K and the intermediate transfer belt 70 rotate simultaneously. On the other hand, at the time t1, the control unit 100 does not cause the charging units 30Y, 30M, 30C and 30K, the exposing units 40Y, 40M, 40C and 40K or the developing units 50Y, 50M, 50C and 50K to operate. Therefore, no new latent image or toner image is formed on the photoconductors 20Y, 20C, 20M and 20K (see FIGS. 9C and 9D).

When the photoconductors 20Y, 20M, 20C and 20K are rotated at the time t1, also the toner D1 remaining on the photoconductors as the jamming occurred (the remaining toner represented by the black circles (•) in FIG. 9A) is moved. The movement of the toner D1 remaining on each of the photoconductors is substantially the same, so that it is explained for the movement of the toner D1 remaining on the photoconductor D1.

When the photoconductor 20Y is rotated, the toner D1 remaining on the photoconductor between the developing location A1 and the primary transfer location B1 is moved through the rotation of the photoconductor 20Y and successively removed with the photoconductor cleaning blade 76Y. Then, the toner remaining on the photoconductor at the developing location A1 when the jamming occurred (also referred to as "toner D1*a* remaining on the photoconductor") is moved through the rotation of the photoconductor 20Y and is removed at the time t2 with the cleaning blade 76Y.

It should be noted that in the toner removal operation after jamming has been resolved according to this working example, the control unit 100 does not cause the supply of the primary transfer bias with the primary transfer bias supply section 123*a* from the time t1 to the time t2. Therefore, the toner D1 remaining on the photoconductor that reaches the primary transfer location B1 is not transferred to the intermediate transfer belt 70, but passes the primary transfer location B1 remaining on the photoconductor 20Y.

The intermediate transfer belt 70 continues to rotate from the time t1 to the time t2. Consequently, the remaining toner D2 not yet transferred by secondary transfer (the remaining toner represented by white circles (O) in FIG. 9A) and the remaining toner D3 not transferred by secondary transfer (the remaining toner represented by white triangles (Δ) in FIG. 9A) is moved due to this rotation of the intermediate transfer belt 70. Then, as the intermediate transfer belt 70 is rotated, the remaining toner D3 not transferred by secondary transfer reaches the toner removal location C2 and is removed by the intermediate transfer belt cleaning blade 87. On the other hand, the remaining toner D2 not yet transferred by secondary transfer does not reach the toner removal location C2 during the period from time t1 to time t2.

The intermediate transfer belt 70 continues to rotate even after the time t2, and as the intermediate transfer belt 70 rotates, the intermediate transfer belt cleaning blade 87 continues to remove the remaining toner D3 not transferred by secondary transfer that moves and reaches the toner removal location C2. Then, the remaining toner not yet transferred by secondary transfer located at the secondary transfer section C1 when the jamming occurred (also referred to hereinbelow as "remaining toner D2*a* not yet transferred by secondary transfer") is moved as the intermediate transfer belt 70 rotates, and reaches the toner removal location C2 at the time t3 (FIG. 9D).

The control unit 100 lets the reverse transfer bias supply section 123*b* supply the reverse transfer bias to the intermediate transfer belt 70 when the remaining toner D2*a* not yet transferred by secondary transfer reaches the toner removal location C2 (at the time t3). Moreover, until the intermediate transfer belt 70 has rotated about once since the jamming, the control unit 100 continues to supply the reverse transfer bias with the reverse transfer bias supply section 123*b*.

Then, while supplying the reverse transfer bias with the reverse transfer bias supply section 123*b*, all of the remaining toner D2 not yet transferred by secondary transfer is removed by the intermediate transfer belt cleaning blade 87. Here, as mentioned above, the remaining toner D2 not yet transferred by secondary transfer is charged negatively, and the reverse transfer bias supplied to the intermediate transfer belt 70 is a voltage of the same polarity as the charge polarity of the remaining toner D2 not yet transferred by secondary transfer. Therefore, a force attempting to separate the remaining toner D2 not yet transferred by secondary transfer from the intermediate transfer belt 70 acts on the remaining toner D2 not yet transferred by secondary transfer at the toner removal location C2. Therefore, the remaining toner D2 not yet transferred by secondary transfer is suitably removed by the intermediate transfer belt cleaning blade 87.

It should be noted that in the present working example, the polarities of the reverse transfer bias and the primary transfer bias are different, but the absolute values of the magnitude of the biases are the same. More specifically, the magnitude of the primary transfer bias is −250 V and the magnitude of the reverse transfer bias is 250 V. However, the magnitudes of the reverse transfer bias and the primary transfer bias are not limited to this, and it is also possible to set them such that the absolute value of the magnitude of the reverse transfer bias is smaller than the absolute value of the magnitude of the primary transfer bias. For example the magnitude of the primary transfer bias can be −250 V and the magnitude of the reverse transfer bias can be −50 V.

The control unit 100 stops the supply of the reverse transfer bias with the reverse transfer bias supply section 123*b* at the time t4. Moreover, at the time t4, the control unit 100 stops the rotation of the photoconductors 20Y, 20M, 20C and 20K and the intermediate transfer belt 70. Thus, the toner removal operation after jamming has been resolved according to the first working example is terminated. Here, the time t4 corresponds to the time at which the intermediate transfer belt 70 has rotated once after the jamming. However, there is no limitation to this, and it is also possible that, for example, the time t4 corresponds to the time by which the intermediate transfer belt 70 has rotated twice after the jamming.

Second Working Example According to the First Embodiment

Figure 10:
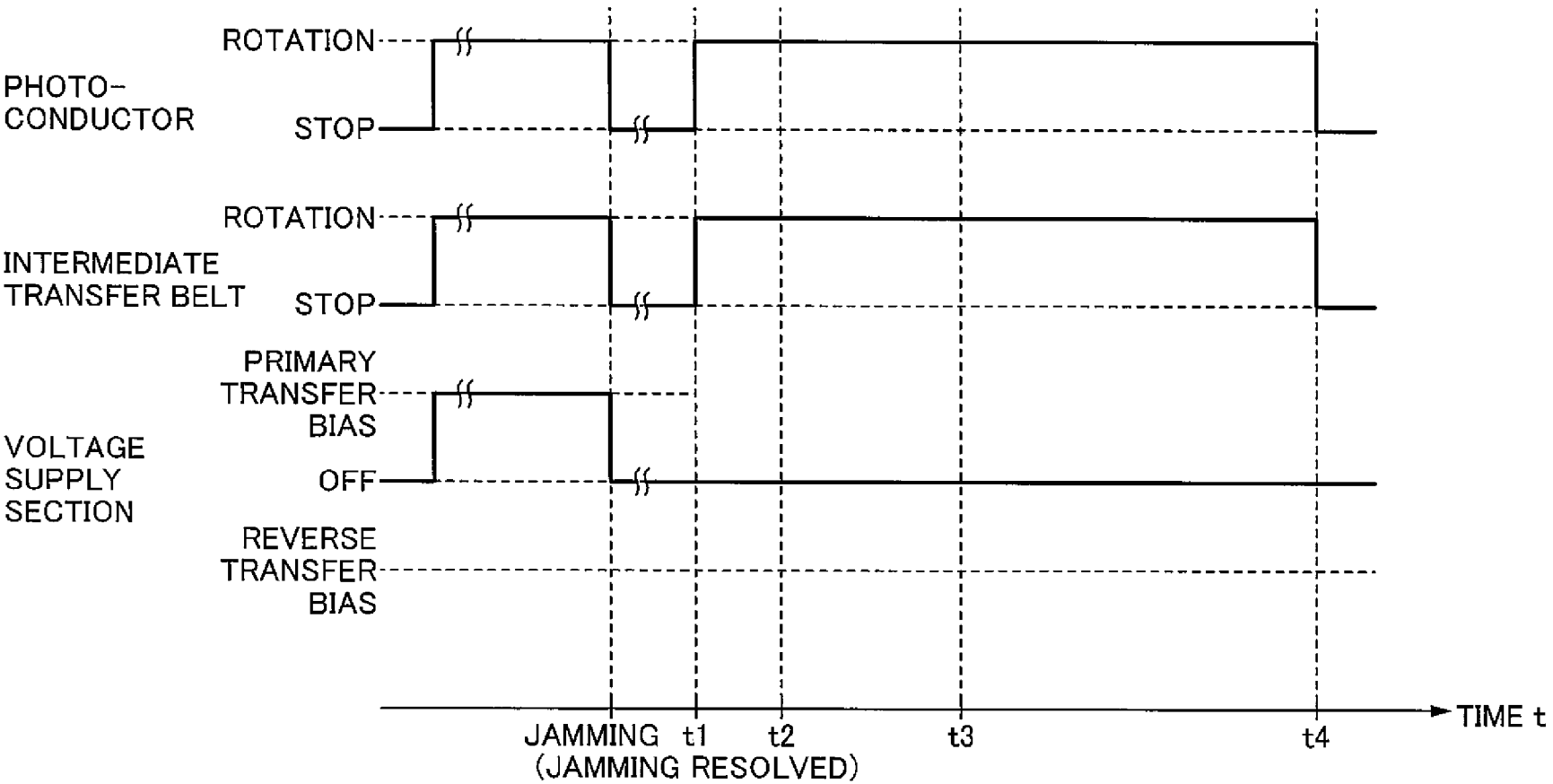
FIG. 10 is a timing chart illustrating the toner removal operation after jamming has been resolved according to a second working example of the first embodiment.

The second working example of the toner removal operation after jamming has been resolved is explained with reference to FIGS. 9A to 9D and 10. FIG. 10 is a timing chart illustrating the toner removal operation after jamming has been resolved according to this second working example. It should be noted that the times t1 to t4 in FIG. 10 represent the same times as the times t1 to t4 in FIG. 8.

Also in the second working example, the control unit 100 starts the execution of the toner removal operation after jamming has been resolved at the time t1. Then, after the execution of the toner removal operation after jamming has been resolved has been started until immediately before the remaining toner D2*a* not yet transferred by secondary transfer reaches the toner removal location C2 (that is, immediately prior to the time t3), the same operation as in the toner removal operation after jamming has been resolved according to the first working example is carried out.

That is to say, the toner D1 remaining on the photoconductors on the photoconductors 20Y, 20M, 20C and 20K (the remaining toner represented by the black circles (•) in FIG. 9A) is moved as the photoconductors rotate and is removed by the photoconductor cleaning blades 76Y, 76M, 76C and 76K (see FIGS. 9B and 9C). Moreover, the remaining toner D3 not transferred by secondary transfer and remaining on the intermediate transfer belt 70 is moved to the toner removal location C2 as the intermediate transfer belt 70 rotates and is removed by the intermediate transfer belt cleaning blade 87 (see FIGS. 9B and 9C).

On the other hand, the operation of the printer 10 from the time on when the remaining toner D2*a* not yet transferred by secondary transfer reaches the toner removal location C2 (FIG. 9D) differs from the operation of the printer 10 according to the first working example. Accordingly, the following is an explanation of the operation of the printer 10 from the time on when the remaining toner D2*a* not yet transferred by secondary transfer reaches the toner removal location C2.

Different to the toner removal operation after jamming has been resolved according to the first working example, the control unit 100 does not cause the supply of the primary transfer bias with the primary transfer bias supply section 123*a* and does not cause the supply of the reverse transfer bias with the reverse transfer bias supply section 123*b* at the time when the remaining toner D2*a* not yet transferred by secondary transfer reaches the toner removal location C2 (at the time t3). That is to say, the voltage supply section 123 does not supply any voltage to the intermediate transfer belt 70. Moreover, the voltage supply section 123 does not supply any voltage to the intermediate transfer belt 70 until the intermediate transfer belt 70 has rotated about once after the jamming.

Then, while no voltage is supplied by the voltage supply section 123, all of the remaining toner D2 not yet transferred by secondary transfer is removed by the intermediate transfer belt cleaning blade 87. Here, no voltage (primary transfer bias) from the voltage supply section 123 is supplied to the intermediate transfer belt 70, so that no force attracting the remaining toner D2 not yet transferred by secondary transfer to the intermediate transfer belt 70 acts on the remaining toner D2 not yet transferred by secondary transfer located at the toner removal location C2. Therefore, the remaining toner D2 not yet transferred by secondary transfer is suitably removed by the intermediate transfer belt cleaning blade 87.

At the time t4 after the remaining toner D2 not yet transferred by secondary transfer has been removed by the intermediate transfer belt cleaning blade 87, the control unit 100 stops the photoconductors 20Y, 20M, 20C and 20K and the intermediate transfer belt 70. Thus, the toner removal operation after jamming has been resolved is terminated.

Advantageous Effects of the Printer 10 According to the First Embodiment

As explained above, the image forming apparatus (printer 10) according to the present embodiment comprises photoconductors 20Y, 20M, 20C and 20K capable of bearing developer (toner), a rotatable intermediate transfer member (intermediate transfer belt 70) serving as an intermediate medium when transferring the toner on the photoconductors 20Y, 20M, 20C and 20K onto a medium, a voltage supply section 123 supplying to the intermediate transfer belt 70 a transfer voltage (primary transfer bias) for causing the toner on the photoconductors 20Y, 20M, 20C and 20K to advance to the intermediate transfer belt 70 at the primary transfer locations B1, B2, B3 and B4, a secondary transfer member (secondary transfer rollers 82) for transferring the toner that has been moved to a secondary transfer location C1 through the rotation of the intermediate transfer belt 70 to the medium, a removal member (intermediate transfer belt cleaning blade 87) that is provided downstream from the secondary transfer location C1, with respect to the rotation direction of the intermediate transfer belt 70 and removes the remaining developer (remaining toner) that has remained on the intermediate transfer belt 70 by abutting against the intermediate transfer belt 70, and a controller (control unit 100) that controls the voltage supply section 123. As shown in FIG. 9B, in a situation in which the image forming operation is stopped midway (in the following, this situation is explained by taking jamming of a medium as an example), the control unit 100 supplies no primary transfer bias with the voltage supply section 123, as shown in FIGS. 8 and 10, when the remaining toner D2 not yet transferred by secondary transfer (the toner represented by white circles (O) in FIG. 9B) that is located upstream, with respect to the rotation direction of the intermediate transfer belt 70, from the secondary transfer location C1 and between a primary transfer location (for example the primary transfer location B1) and the secondary transfer location C1, is removed by the intermediate transfer belt cleaning blade 87 in order to resume the image forming operation. Thus, the removal of the remaining toner D2 not yet transferred by secondary transfer is suitably carried out by the intermediate transfer belt cleaning blade 87 in order to resume the image forming operation. This is described in greater detail in the following.

As explained above, when jamming occurs, remaining toner (that is, the remaining toner D2 not yet transferred by secondary transfer) may be located upstream, with respect to the rotation direction of the intermediate transfer belt 70, from the secondary transfer location C1, between the primary transfer location B1 and the secondary transfer location C1, as shown in FIG. 9A, for example. In this case, in order to resume the image forming operation after the jamming has been resolved, the remaining toner D2 not yet transferred by secondary transfer is removed with the intermediate transfer belt cleaning blade 87, so that the amount of remaining toner that is to be removed by the intermediate transfer belt cleaning blade 87 is larger than during the image formation.

Then, when a large amount of remaining toner D2 not yet transferred by secondary transfer is removed, after resolving the jamming, by the intermediate transfer belt cleaning blade 87, and the primary transfer bias for letting the toner advance to the intermediate transfer belt 70 is supplied to the intermediate transfer member, a large amount of remaining toner D2 not yet transferred by secondary transfer remaining on the intermediate transfer belt 70 is attracted to the intermediate transfer belt 70. In this situation, there is the risk that the remaining toner D2 not yet transferred by secondary transfer is not suitably removed by the intermediate transfer belt cleaning blade 87, and remains on the intermediate transfer belt 70.

Figure 11A:
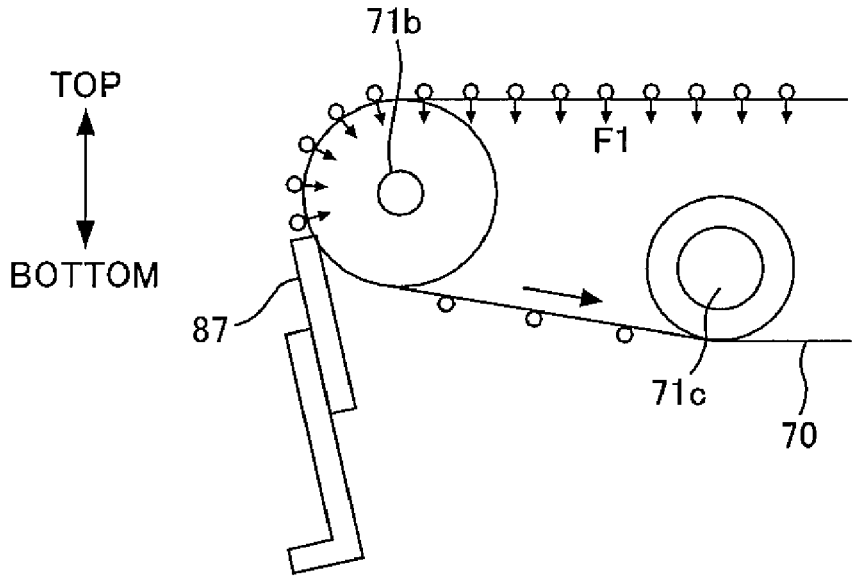
FIG. 11A is a diagram illustrating a comparative example according to the first embodiment.

This is explained in more detail with reference to FIG. 11A. As shown in FIG. 11A, when the primary transfer bias is supplied to the intermediate transfer belt 70, a force attracting the remaining toner D2 not yet transferred by secondary transfer located at the toner removal location to the intermediate transfer belt 70 (see force F1 in FIG. 11) acts on that toner. The reason why this force F1 acts is that the remaining toner D2 not yet transferred by secondary transfer is negatively charged, and the polarity of the primary transfer bias is opposite to that charge polarity of the remaining toner D2 not yet transferred by secondary transfer. Therefore, at the toner removal location C2, a portion of the large amount of remaining toner D2 not yet transferred by secondary transfer is not removed by the intermediate transfer belt cleaning blade 87 and this portion passes the toner removal location. Thus, the toner is not properly removed with the intermediate transfer belt cleaning blade 87. It should be noted that FIG. 11A is a diagram illustrating a comparative example.

On the other hand, in the present embodiment, as shown in FIGS. 8 and 10, when the remaining toner D2 not yet transferred by secondary transfer remaining on the intermediate transfer belt 70 when jamming of the medium has occurred, is removed by the intermediate transfer belt cleaning blade 87 in order to resume the image forming operation, the primary transfer bias is not supplied with the voltage supply section 123 (the primary transfer bias supply section 123*a*). More specifically, in the first working example shown in FIG. 8, when the remaining toner D2 not yet transferred by secondary transfer is removed by the intermediate transfer belt cleaning blade 87 in order to resume the image forming operation, no primary transfer bias is supplied with the primary transfer bias supply section 123*a*, but a reverse transfer bias is supplied with the reverse transfer bias supply section 123*b*. Moreover, in the second working example shown in FIG. 10, when the remaining toner D2 not yet transferred by secondary transfer is removed by the intermediate transfer belt cleaning blade 87 in order to resume the image forming operation, no primary transfer bias is supplied with the primary transfer bias supply section 123*a*, and no reverse transfer bias is supplied with the reverse transfer bias supply section 123*b*.

Thus, if no primary transfer bias is supplied with the primary transfer bias supply section 123*a* when the remaining toner D2 not yet transferred by secondary transfer is removed, the force F1 attracting the remaining toner D2 not yet transferred by secondary transfer located at the toner removal location C2 to the intermediate transfer belt 70 is not generated. Therefore, the remaining toner D2 not yet transferred by secondary transfer is suitably removed by the intermediate transfer belt cleaning blade 87.

Figure 11B:
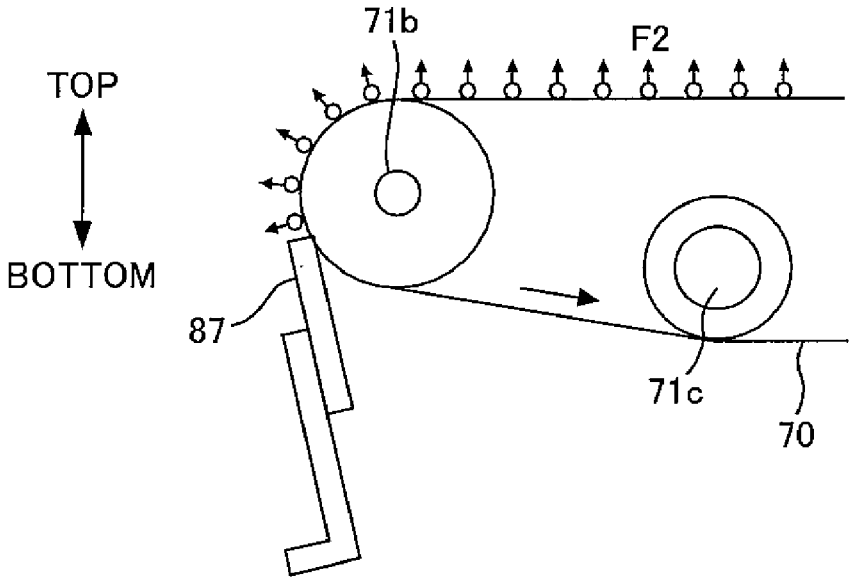
FIG. 11B illustrates the advantageous effect of the printer 10 according to the first embodiment.

It should be noted that in the first working example shown in FIG. 8, when the remaining toner D2 not yet transferred by secondary transfer is removed by the intermediate transfer belt cleaning blade 87 after the jamming has been resolved, in order to resume the image forming operation, the reverse transfer bias (voltage of the same polarity as the charge polarity of the remaining toner D2 not yet transferred by secondary transfer) is supplied by the voltage supply section 123 (reverse transfer bias supply section 123*b*), so that the following effects are displayed. If the reverse transfer bias is supplied to the intermediate transfer belt 70, a force F2 repelling the remaining toner located at the toner removal location C2 from the intermediate transfer belt 70 is effected, as shown in FIG. 11B. Therefore, the remaining toner tends to be removed by the intermediate transfer belt cleaning blade 87. It should be noted that FIG. 11B illustrates the advantageous effect of the printer 10 according to the present embodiment.

Other Working Examples According to the First Embodiment

In the foregoing, an image forming apparatus according to the invention was explained based on the first embodiment, but the above-described embodiments of the invention are merely to facilitate the understanding of the invention, and are in no way meant to limit the invention. The invention can of course be altered and improved without departing from the gist thereof and equivalents are intended to be embraced therein.

In the foregoing first embodiment, the photoconductor was explained as having a photoconductive layer on the outer circumferential surface of a tubular conductive member, but there is no limitation to this. For example, it may also be a so-called photoconductive belt, in which a photoconductive layer is provided on the surface of a belt-shaped photoconductive member.

According to the first embodiment, the intermediate transfer member was explained to be a belt, but there is no limitation to this, and the intermediate transfer member may also be a drum, for example. Moreover, the removal member was explained to be a blade, but there is no limitation to this, and the removal member may also be a roller or the like, for example.

Furthermore, in the foregoing first embodiment, as shown in FIGS. 8 and 10, it was explained that when a situation occurs in which the image forming operation is stopped midway (such as jamming of the medium), and remaining toner that is located upstream, with respect to the rotation direction of the intermediate transfer belt 70, from the developer removal location (toner removal location C2) performing the removal of the remaining toner (that is, the remaining toner D2 not yet transferred by secondary transfer and the remaining toner D3 not transferred by secondary transfer) with the intermediate transfer belt cleaning blade 87 and remaining toner located between a primary transfer location (for example the primary transfer location B1) and the toner removal location C2 is removed by the intermediate transfer belt cleaning blade 87 in order to resume the image forming operation, then the control unit 100 does not cause the supply of the primary transfer bias with the voltage supply section 123, but there is no limitation to this. For example, it is also possible that when the remaining toner D2 not yet transferred by secondary transfer is removed, it does not cause the supply of the primary transfer bias with the voltage supply section 123, but when the remaining toner D3 not transferred by secondary transfer is being removed, it may cause the supply of the primary transfer bias with the voltage supply section 123.

As explained above, when jamming occurs, remaining toner D3 not transferred by secondary transfer, which remains on the intermediate transfer belt 70 without being transferred by secondary transfer to the medium at the secondary transfer location C1 prior to the jamming, is located between the secondary transfer location C1 and the toner removal location C2 (see FIG. 9A). In this case, if the primary transfer bias is not supplied with the voltage supply section 123 when the remaining toner D3 not transferred by secondary transfer is being removed, then not only the remaining toner D2 not yet transferred by secondary transfer but also the remaining toner D3 not transferred by secondary transfer is suitably removed by the intermediate transfer belt cleaning blade 87. For this reason, the first embodiment is preferable.

Furthermore, in the first embodiment, the voltage supply section 123 (primary transfer bias supply section 123*a*) supplies the primary transfer bias across the entire intermediate transfer belt 70, but there is no limitation to this. For example, it is also possible that the intermediate transfer belt 70 is an annular belt having a joint section of a constant width extending in the perpendicular belt direction (see FIG. 5), and that the primary transfer bias supply section 123*a* does not supply the primary transfer bias at this joint section of the intermediate transfer belt 70 (that is to say, the primary transfer bias supply section 123*a* does not supply the primary transfer bias across the entire intermediate transfer belt 70).

However, if the configuration is such that the primary transfer bias is supplied across the entire intermediate transfer belt 70, then the force attracting the remaining toner D2 not yet transferred by secondary transfer located at the toner removal location C2 to the intermediate transfer belt 70 (the force F1 shown in FIG. 11A) is reliably effected when the primary transfer bias is supplied to the intermediate transfer belt 70. Therefore, the effect of the fact that the primary transfer bias is not supplied when the remaining toner D2 not yet transferred by secondary transfer is removed, that is, the effect that the remaining toner D2 not yet transferred by secondary transfer is suitably removed with the intermediate transfer belt cleaning blade 87 in order to resume the image forming operation is achieved more effectively. For this reason, the first embodiment is preferable.

Furthermore, in the above-described first embodiment, it was explained that the electrode layer 70*b* is provided at the end portion of the intermediate transfer belt 70 in the perpendicular direction perpendicular to the rotation direction of the intermediate transfer belt 70, as shown in FIG. 6. Moreover, it was explained that the printer 10 is provided with a conductive member (electrode roller 210) abutting against this electrode layer 70*b*. Moreover, it was explained that the voltage supply section 123 supplies the primary transfer bias via the electrode roller 210 to the intermediate transfer belt 70. However, there is no limitation to this, and any configuration is possible, as long as the primary transfer bias can be supplied from the voltage supply section 123 to the intermediate transfer belt 70.

Furthermore, in the first embodiment, it was explained that the printer 10 is provided with four photoconductors 20Y, 20M, 20C and 20K capable of bearing toners of different colors (that is, yellow toner, magenta toner, cyan toner and black toner), as shown in FIG. 1. And it was explained that the intermediate transfer belt 70 serves as an intermediate medium when transferring the toner on each of these photoconductors 20Y, 20M, 20C and 20K onto the medium. However, there is no limitation to this. For example, it is also possible that the printer 10 is provided only with one photoconductor (for example, the photoconductor 20K), in order to form images of a single color.

However, if the printer 10 is provided with four photoconductors 20Y, 20M, 20C and 20K, then the toner on the photoconductors is transferred successively to the intermediate transfer belt 70 at the primary transfer locations B1, B2, B3 and B4, so that there tends to be more remaining toner D2 not yet transferred by secondary transfer that remains on the intermediate transfer belt 70 when the jamming occurred. Therefore, the effect of the fact that the primary transfer bias is not supplied when the remaining toner D2 not yet transferred by secondary transfer is removed, that is, the effect that the remaining toner D2 not yet transferred by secondary transfer is suitably removed with the intermediate transfer belt cleaning blade 87 in order to resume the image forming operation is achieved more effectively. For this reason, the first embodiment is preferable.

Second Embodiment

Operation of the Printer 10 in the Case of a Jam During the Image Formation According to the Second Embodiment In the printer 10, a situation may arise in which the image forming operation is stopped midway while carrying out the image forming operation. This may be the case when the operator opens the cover 12 during the image forming operation or when the medium is jammed in the medium transport path 13 during the image forming operation (so-called jamming of the medium). This is explained for the example of jamming of the medium.

While carrying out an image forming operation, the medium may become jammed while being sandwiched between the intermediate transfer belt 70 and the secondary transfer roller 82 at the secondary transfer location C1. When there is a jamming of the medium during the image forming operation, the printer 10 stops the image forming operation while it is still midway. Therefore, in order to resume the image forming operation, it is necessary to resolve the jam by removing the jammed medium.

Now, when the operation of the printer 10 is stopped during the image formation due to jamming of the medium, remaining toner is located between the primary transfer locations (for example, the primary image location B1) and the secondary image location C1. Moreover, remaining toner may be located between the developing location A1 (A2, A3, A4) and the primary transfer location B1 (B2, B3, B4) on the photoconductor 20Y (20M, 20C, 20K) (see FIG. 14A). In this situation, it is necessary that the remaining toner is removed with the photoconductor cleaning blades 76Y, 76M, 76C and 76K and the intermediate transfer belt cleaning blade 87, such that the image formation can be resumed after the jamming has been resolved.

Accordingly, when jamming of the medium has occurred, the printer 10 carries out the following operation. That is, the printer 10 notifies the operator that jamming has occurred, in order to let the operator remove the medium. After this, the photoconductors 20Y, 20M, 20C and 20K and the intermediate transfer belt 70 are caused to rotate after the jammed medium has been removed (that is, after the jam has been resolved), and the remaining toner is removed by the photoconductor cleaning blades and the intermediate transfer belt cleaning blade.

Figure 12:
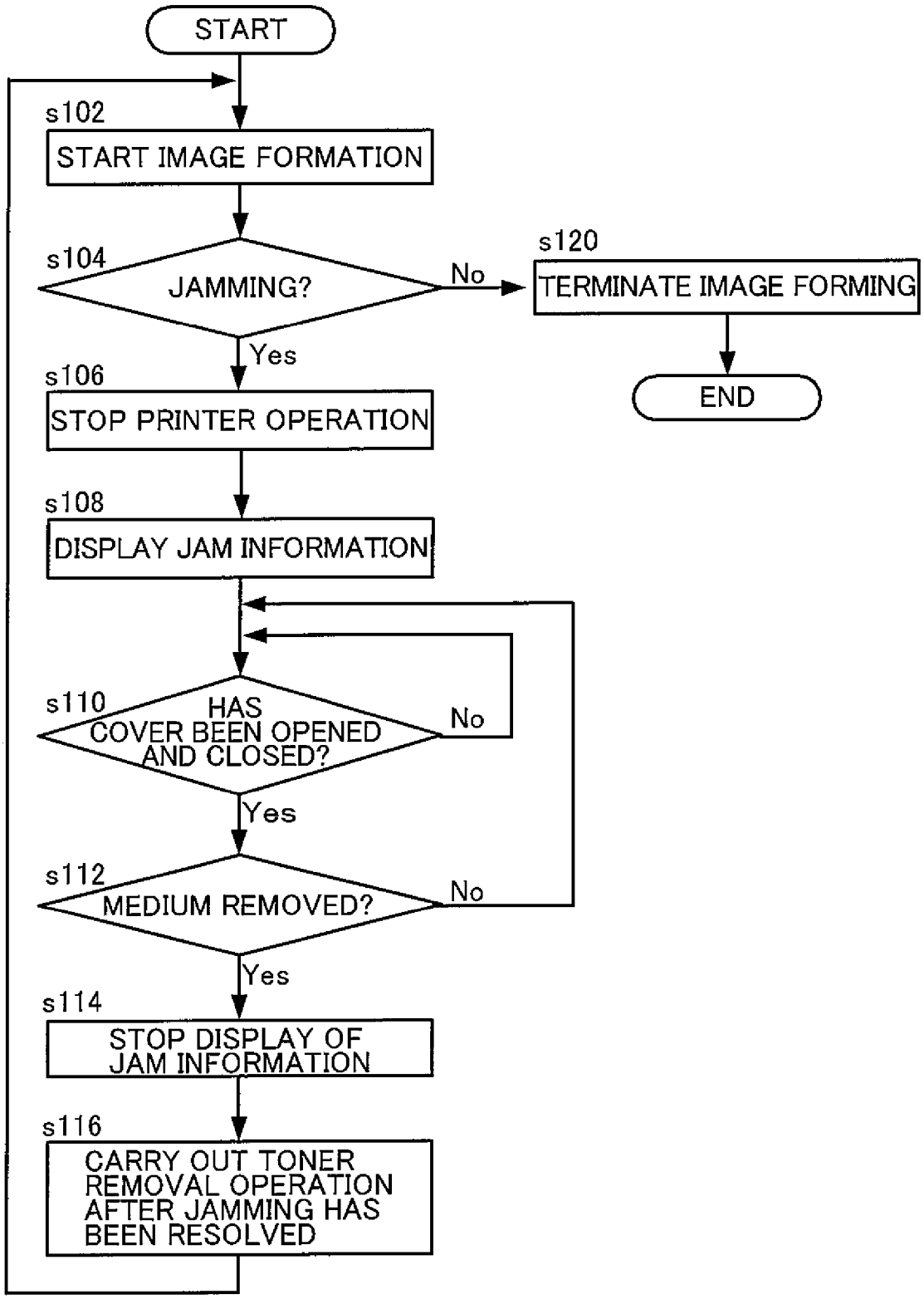
FIG. 12 is a flowchart illustrating the operation of the printer 10 in the case that jamming has occurred during the image formation, in accordance with a second embodiment.

Working Example of the Operation of the Printer 10 According to the Second Embodiment In the foregoing, the regular image forming operation without jamming has been explained, and in the following, the operation of the printer 10 in the case that jamming occurs during the image forming is explained with reference to FIG. 12. FIG. 12 is a flowchart illustrating the operation of the printer 10 in the case that jamming occurs during the image formation.

The various operations that are carried out by the printer 10 are realized mainly by the control unit 100, which is an example of a controller (see FIG. 2). In particular, in the present embodiment, this is achieved by the CPU executing a program stored in a ROM. Also, this program is constituted by code for performing the various operations described below.

The control unit 100 begins the above-noted image forming operation when it receives image signals and control signals from the host computer (Step s102). Here, it is assumed that a color image is to be formed on one sheet of medium.

Then, the control unit 100 stops the operation of the printer 10 (Step s106) when it is judged with the medium detection sensors 14*a*, 14*b*, 14*c*, 14*d* that jamming of the medium has occurred in the medium transport path 13 during the color image formation (Step s104: Yes). In the present embodiment, it is assumed that the medium is jammed while being sandwiched by the intermediate transfer belt 70 and the secondary transfer roller 82 (see FIG. 14A). Then, the control unit 100 stops the rotation of the photoconductors 20Y, 20M, 20C and 20K and the intermediate transfer belt 70 (see FIGS. 13 and 15) and separates the secondary transfer roller 82 from the intermediate transfer belt 70. Moreover, the control unit 100 interrupts the supply of the developing bias to the developing rollers 52Y, 52M, 52C and 52K, the supply of the primary transfer bias to the intermediate transfer belt 70 and the supply of the secondary transfer bias to the secondary transfer roller 82.

Furthermore, the control unit 100 displays on the display unit 95 jam information indicating the occurrence of jamming (Step s108), to let the operator know that jamming has occurred.

Figure 14A:
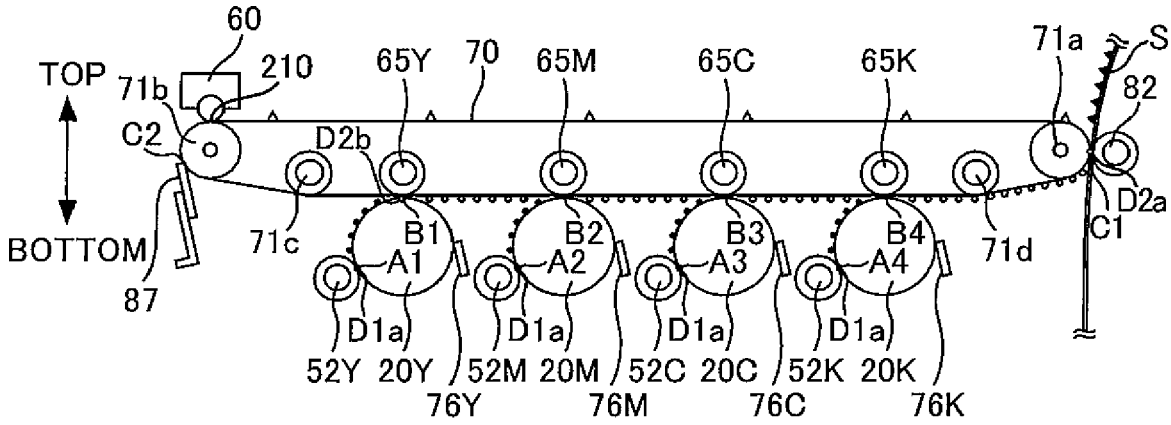
FIG. 14A is a diagram showing the state of the remaining toner when jamming has occurred, in accordance with the second embodiment.

Now, when jamming occurs (more specifically, when jamming occurs and the operation of the printer 10 has stopped), toner is located on the medium S, as indicated by the black triangles (▲) in FIG. 14A, but toner is also located on the photoconductors 20Y, 20M, 20C and 20K and on the intermediate transfer belt 70. More specifically, when jamming occurs, remaining toner (also referred to as "toner D1 remaining on the photoconductor") is located between the developing locations and the primary transfer locations on the photoconductors 20Y, 20M, 20C and 20K, as indicated by the black circles (•) in FIG. 14A. Moreover, as indicated by the white circles (○) in FIG. 14A, remaining toner (also referred to as "remaining toner D2 not yet transferred by secondary transfer" is located upstream from the secondary transfer location C1, with respect to the rotation direction of the intermediate transfer belt 70, and between the primary transfer location B1 and the secondary transfer location C1. Moreover, as indicated by the white triangles (Δ) in FIG. 14A, remaining toner (also referred to as "remaining toner D3 not transferred by secondary transfer" is located downstream from the secondary transfer location C1, with respect to the rotation direction of the intermediate transfer belt 70, between the secondary transfer location C1 and the toner removal location C2.

Returning to the flowchart in FIG. 12, the explanation of the operation of the printer 10 is now continued. If the control unit 100 has detected with the above-noted open/closed detection sensor that the cover 12 has been opened and closed again after the jamming (Step s110: Yes), then it lets the medium detection sensors 14*a*, 14*b*, 14*c*, 14*d* detect whether medium is present in the medium transport path 13 (Step s112).

Figure 13:
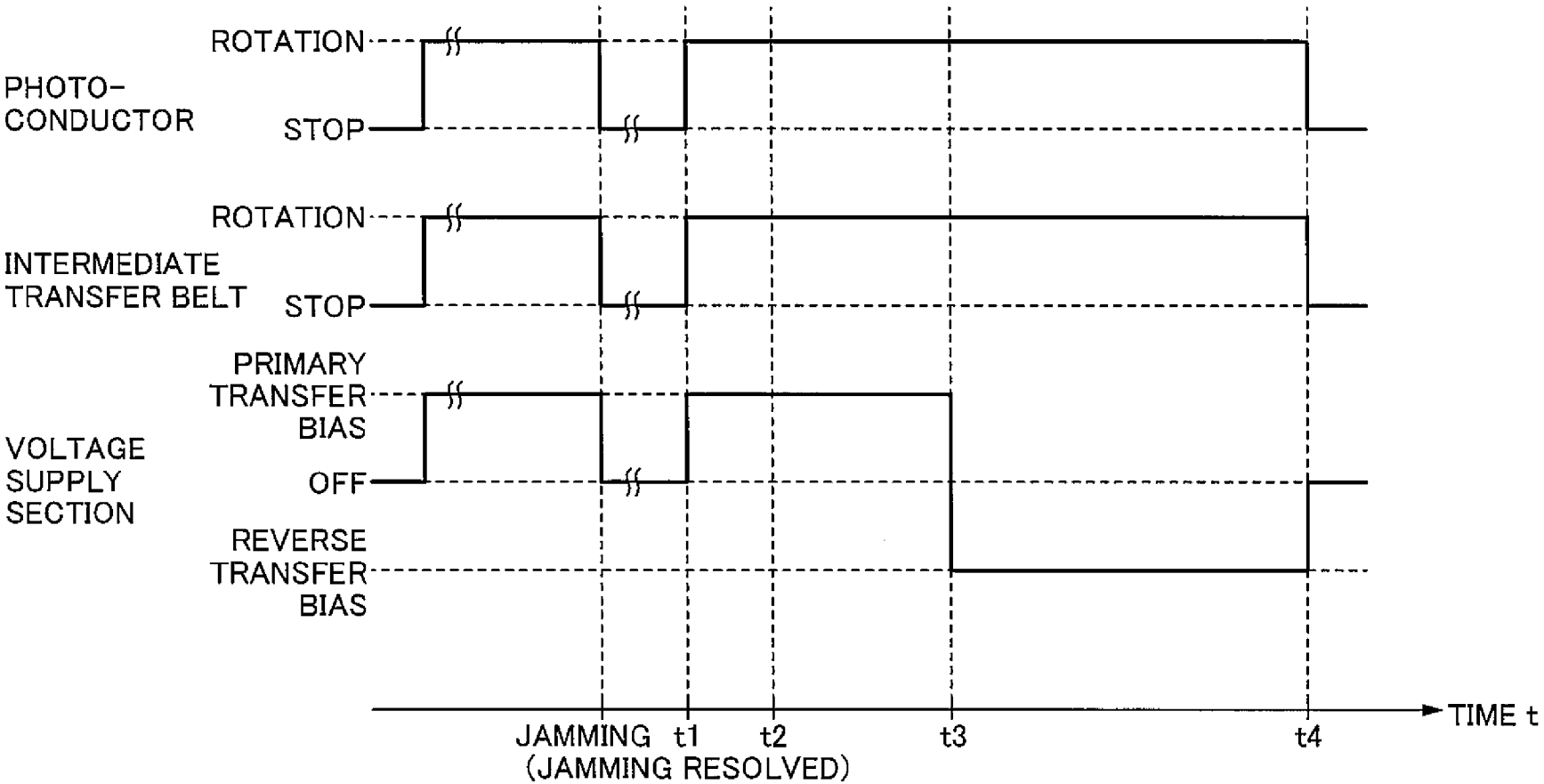
FIG. 13 is a timing chart illustrating the toner removal operation after jamming has been resolved according to a first working example of this second embodiment.
Figure 14B:
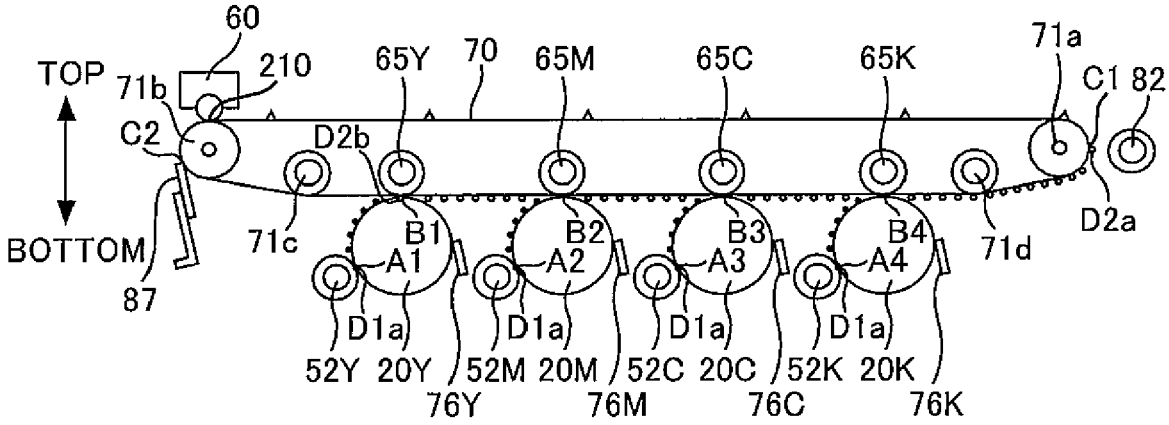
FIG. 14B is a diagram showing the state of the remaining toner at the time t1 in FIG. 13.

In the present working example, it is assumed that the medium has been removed, as shown in FIG. 14B, between the opening and the closing of the cover 12. Accordingly, since the medium detection sensors 14*a*, 14*b*, 14*c* and 14*d* do not detect the medium anymore, the control unit 100 judges that the jammed medium has been removed (Step s112: Yes). That is to say, the control unit 100 judges that the jamming has been resolved (see FIGS. 13 and 15).

When the control unit 100 judges that the jamming has been resolved, it first interrupts the display of the jam information on the display unit 95 (Step s114). Then, the control unit 100 begins the execution of the operation (also referred to as "toner removal operation after jamming has been resolved") for removing the remaining toner that has remained on the photoconductors 20Y, 20M, 20C and 20K and the intermediate transfer belt 70 when the jamming occurred (Step s116). Due to the execution of this "toner removal operation after jamming has been resolved", the intermediate transfer belt cleaning blade 87 removes the toner that has remained on the photoconductors 20Y, 20M, 20C and 20K and the intermediate transfer belt 70 when the jamming occurred (that is, the toner D1 remaining on the photoconductors, the remaining toner D2 not yet transferred by secondary transfer, and the remaining toner D3 not transferred by secondary transfer) when it has reached the toner removal location C2 after being moved there through the rotation of the photoconductors 20Y, 20M, 20C and 20K and the intermediate transfer belt 70 after the jamming has been resolved. The details of this "toner removal operation after jamming has been resolved" are explained further below.

After the control unit 100 has terminated the "toner removal operation after jamming has been resolved", the formation of the color image that could not be formed due to the jamming is executed again (Step s102). Then, if there is no jamming of the medium during this color image forming operation (Step s104: no), the printer 10 carries out the next image formation after the formation of the color image has been terminated (Step s120).

Toner Removal Operation after Jamming Has Been Resolved According to the Second Embodiment The following is an explanation of two working examples of the toner removal operation after jamming has been resolved. It should be noted that in these working examples, mainly the operations of the photoconductors 20Y, 20M, 20C, 20K, the intermediate transfer belt 70, and the voltage supply section 123, as well as the state of the remaining toner on the photoconductors 20Y, 20M, 20C, 20K and the intermediate transfer belt 70 during the toner removal operation after jamming has been resolved are explained.

Figure 14C:
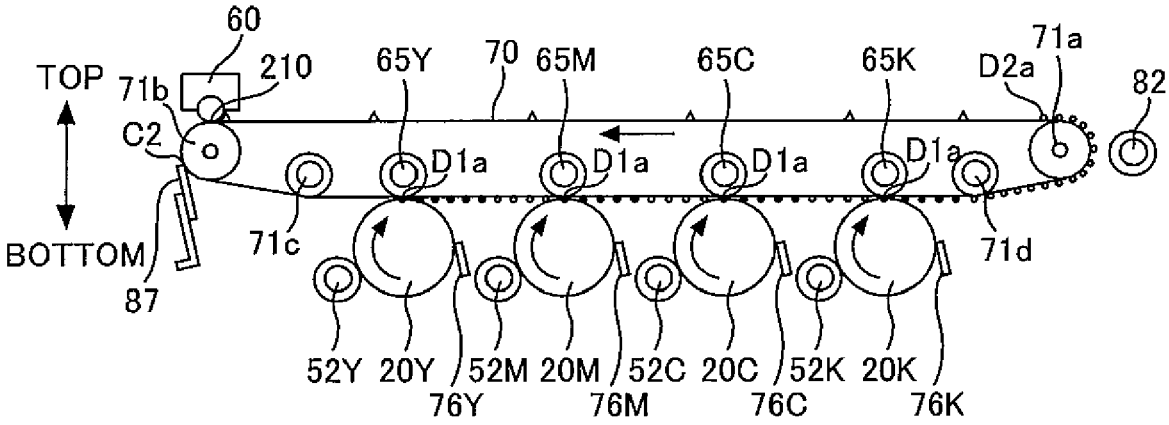
FIG. 14C is a diagram showing the state of the remaining toner at the time t2 in FIG. 13.
Figure 14D:
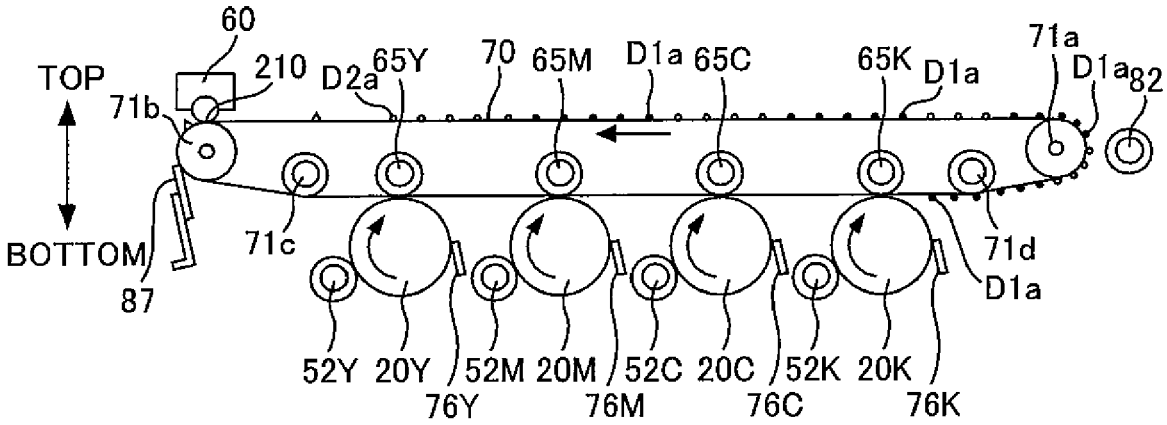
FIG. 14D is a diagram showing the state of the remaining toner at the time t3 in FIG. 13.

First Working Example of Toner Removal Operation After Jamming has been Resolved According to the Second Embodiment The first example of the toner removal operation after jamming has been resolved is explained with reference to FIGS. 13 and 14A and 14D. FIG. 13 is a timing chart illustrating the toner removal operation after jamming has been resolved according to this first working example. FIGS. 14A to 14D are diagrammatic views showing the state of the remaining toner on the photoconductors 20Y, 20M, 20C and 20K and on the intermediate transfer belt 70. FIG. 14A shows the state of the remaining toner when jamming occurs, FIG. 14B shows the state of the remaining toner at the time t1 in FIG. 13, FIG. 14C shows the state of the remaining toner at the time t2 in FIG. 13, and FIG. 14D shows the state of the remaining toner at the time t3 in FIG. 13. It should be noted that in FIG. 13, the arrow indicates time t. The white and black circles and triangles (○, •, Δ, ▲) in FIGS. 14A to 14D represent toner.

As mentioned above, the control unit 100 begins the execution of the toner removal operation after jamming has been resolved when it has judged that jamming has been resolved (at the time t1 in FIG. 13). More specifically, at the time t1, the control unit 100 lets the photoconductors 20Y, 20M, 20C and 20K and the intermediate transfer belt 70 rotate simultaneously. On the other hand, at the time t1, the control unit 100 does not cause the charging units 30Y, 30M, 30C and 30K, the exposing units 40Y, 40M, 40C and 40K or the developing units 50Y, 50M, 50C and 50K to operate. Therefore, no new latent image or toner image is formed on the photoconductors 20Y, 20C, 20M and 20K (see FIGS. 14C and 14D).

When the photoconductors 20Y, 20M, 20C and 20K are rotated at the time t1, also the toner D1 remaining on the photoconductors as the jamming occurred (the remaining toner represented by the dark circles (•) in FIG. 14B) is moved.

In the toner removal operation after jamming has been resolved according to this embodiment, the control unit 100 causes the supply of the primary transfer bias with the primary transfer bias supply section 123*a* of the voltage supply section 123 at the time t1. Then, the control unit 100 continues the supply of the primary transfer bias with the primary transfer bias supply section 123*a* until the toner remaining on the photoconductors at the developing locations A1, A2, A3 and A4 when the jamming occurred (also referred to in the following as "toner D1*a* remaining on the photoconductors") reaches the primary transfer locations B1, B2, B3 and B4 as the photoconductor 20Y rotates. Therefore, the toner D1 remaining on the photoconductors is transferred by primary transfer to the intermediate transfer belt 70 at the primary transfer locations B1, B2, B3 and B4.

In this working example, the toner D1*a* remaining on the photoconductors reaches the primary transfer location B1 at the time t2 and is transferred by primary transfer to the intermediate transfer belt 70. Consequently, the control unit 100 continues to supply the primary transfer bias from the time t1 to the time t2.

The intermediate transfer belt 70 continues to rotate from the time t1 to the time t2. Consequently, the remaining toner D2 not yet transferred by secondary transfer (the remaining toner represented by white circles (O) in FIG. 14B) and the remaining toner D3 not transferred by secondary transfer (the remaining toner represented by white triangles (Δ) in FIG. 14B) is moved due to this rotation of the intermediate transfer belt 70. Moreover, also the toner D1 remaining on the photoconductors that has been transferred by primary transfer to the intermediate transfer belt 70 at the primary transfer locations B1, B2, B3 and B4 is moved through the rotation of the intermediate transfer belt 70. Moreover, as the intermediate transfer belt 70 is rotated, the remaining toner D3 not transferred by secondary transfer reaches the toner removal location C2 and is removed by the intermediate transfer belt cleaning blade 87.

On the other hand, the remaining toner D2 not yet transferred by secondary transfer (the remaining toner located at the secondary transfer location C1 when the jamming occurred (in the following also referred to as "remaining toner D2*a* not yet transferred by secondary transfer")) does not reach the toner removal location C2 shown in FIG. 14C during the period from the time t1 to the time t2. This is because the length in the rotation direction of the photoconductor 20Y (20M, 20C, 20K) from the developing location A1 (A2, A3, A4) to the primary transfer location B1 (B2, B3, B4) is configured to be shorter than the length in the rotation direction of the intermediate transfer belt 70 from the secondary transfer location C1 to the toner removal location C2.

The intermediate transfer belt 70 continues to rotate even after the time t2, and as the intermediate transfer belt 70 rotates, the intermediate transfer belt cleaning blade 87 continues to remove the remaining toner D3 not transferred by secondary transfer that moves and reaches the toner removal location C2. It should be noted that the control unit 100 continues to supply the primary transfer bias while the remaining toner D3 not transferred by secondary transfer is being removed.

Then, when, due to further rotation of the intermediate transfer belt 70, the toner D1*a* remaining on the photoconductor remaining on the photoconductor 20Y when the jamming occurred has passed the primary transfer location B4 corresponding to the photoconductor 20K, the control unit 100 stops the supply of the primary transfer bias with the primary transfer bias supply section 123*a* that has continued thus far. In this working example, the control unit 100 stops the supply of the primary transfer bias with the primary transfer bias supply section 123*a* at the time t3, which is immediately after the toner D1*a* remaining on the photoconductor has passed the primary transfer location B4. The control unit 100 also causes the supply of the reverse transfer bias with the reverse transfer bias supply section 123*b* at the time t3. Moreover, until the intermediate transfer belt 70 has rotated about once since the jamming, the control unit 100 continues to supply the reverse transfer bias with the reverse transfer bias supply section 123*b*.

It should be noted that even at the time t3 (that is, when the toner D1*a* remaining on the photoconductors has passed the primary transfer location B4), the remaining toner D2*a* not yet transferred by secondary transfer does not yet reach the toner removal location C2, as shown in FIG. 14D. This is, because the total of the length in the rotation direction of the photoconductor 20Y, from the developing location A1 to the primary transfer location B1, and the length of the intermediate transfer belt 70 in the rotation direction, from the primary transfer location B1 corresponding to the photoconductor 20Y to the primary transfer location B4 corresponding to the photoconductor 20K, is configured to be shorter than the length of the intermediate transfer belt 70 in the rotation direction from the secondary transfer location C1 to the toner removal location C2.

While supplying the reverse transfer bias with the reverse transfer bias supply section 123*b*, all of the remaining toner D2 not yet transferred by secondary transfer and the toner D1 remaining on the photoconductors is removed by the intermediate transfer belt cleaning blade 87. Here, as mentioned above, the remaining toner D2 not yet transferred by secondary transfer and the toner D1 remaining on the photoconductors is toner that is charged negatively, and the reverse transfer bias supplied to the intermediate transfer belt 70 is a voltage of the same polarity as the charge polarity of the remaining toner D2 not yet transferred by secondary transfer and the toner D1 remaining on the photoconductors. Therefore, a force attempting to separate the remaining toner D2 not yet transferred by secondary transfer and the toner D1 remaining on the photoconductors from the intermediate transfer belt 70 acts on the remaining toner D2 not yet transferred by secondary transfer and the toner D1 remaining on the photoconductors located at the toner removal location C2. Therefore, the remaining toner D2 not yet transferred by secondary transfer and the toner D1 remaining on the photoconductors is suitably removed by the intermediate transfer belt cleaning blade 87. Also the remaining toner D3 not transferred by secondary transfer remaining between the secondary transfer location C1 and the toner removal location C2 at the time t3 is removed by the intermediate transfer belt cleaning blade 87, just like the remaining toner D2 not yet transferred by secondary transfer and the toner D1 remaining on the photoconductors, when the reverse transfer bias is supplied with the reverse transfer bias supply section 123*b*.

It should be noted that in the present working example, the polarities of the reverse transfer bias and the primary transfer bias are different, but the absolute values of the magnitude of the biases are the same. More specifically, the magnitude of the primary transfer bias is −250 V and the magnitude of the reverse transfer bias is 250 V. However, the magnitudes of the reverse transfer bias and the primary transfer bias are not limited to this, and it is also possible to set them such that the absolute value of the magnitude of the reverse transfer bias is smaller than the absolute value of the magnitude of the primary transfer bias. For example, the magnitude of the primary transfer bias can be 250 V and the magnitude of the reverse transfer bias can be −50 V.

Next, the control unit 100 stops the supply of the reverse transfer bias with the reverse transfer bias supply section 123*b* at the time t4. Moreover, at the time t4, the control unit 100 stops the rotation of the photoconductors 20Y, 20M, 20C and 20K and the intermediate transfer belt 70. Thus, the toner removal operation after jamming has been resolved according to the first working example is terminated. Here, the time t4 corresponds to the time in which the intermediate transfer belt 70 is rotated once after the jamming. However, there is no limitation to this, and it is also possible that the time t4 corresponds to the time in which the intermediate transfer belt 70 has rotated twice after the jamming, for example.

Figure 15:
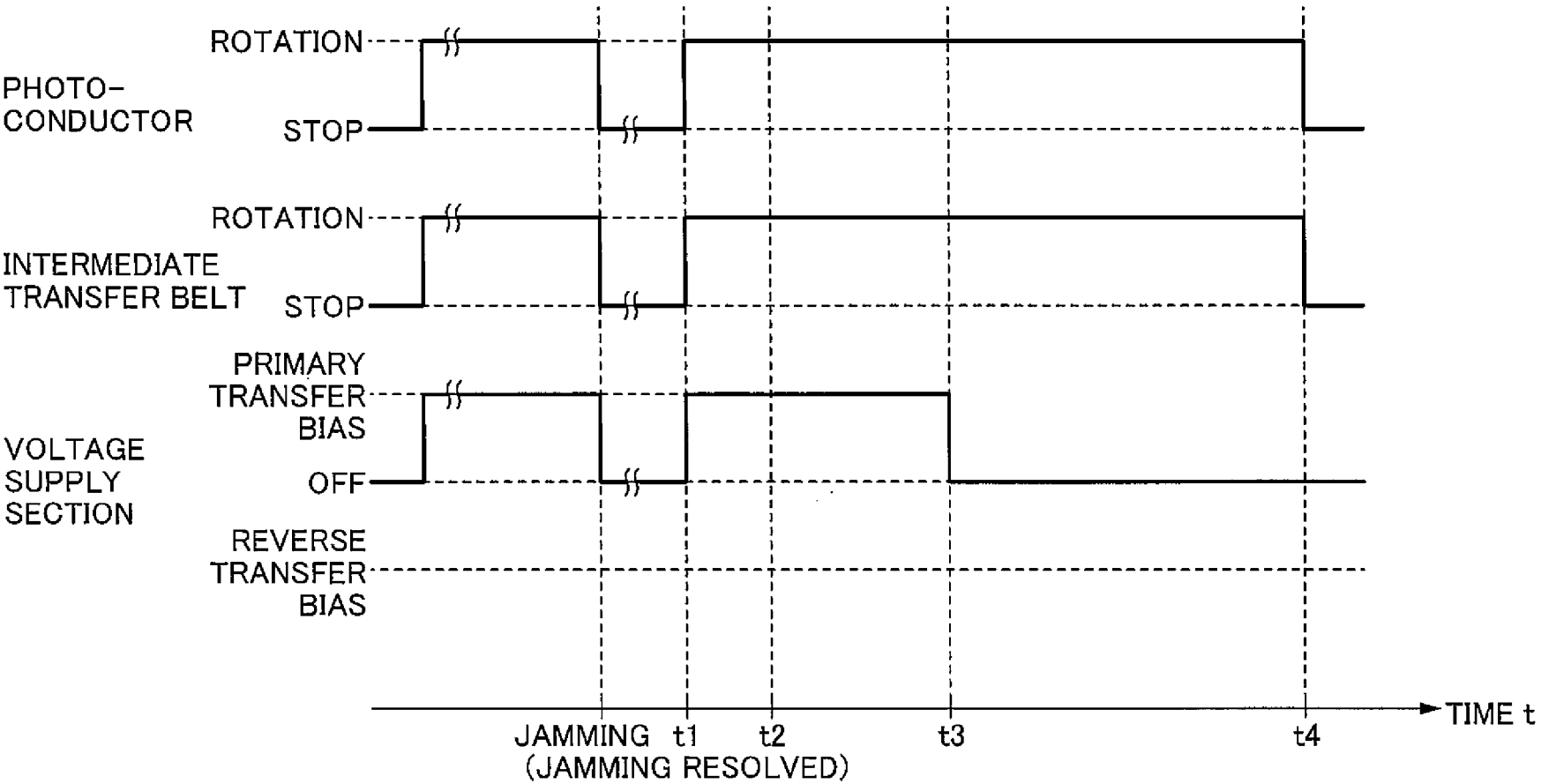
FIG. 15 is a timing chart illustrating the toner removal operation after jamming has been resolved according to a second working example of the second embodiment.

Second Working Example of Toner Removal Operation After Jamming has been Resolved According to the Second Embodiment The second working example of the toner removal operation after jamming has been resolved is explained with reference to FIGS. 14A to 14D and 15. FIG. 15 is a timing chart illustrating the toner removal operation after jamming has been resolved according to this second working example. It should be noted that the times t1 to t4 in FIG. 15 represent the same times as the times t1 to t4 in FIG. 13.

Also in the second working example, the control unit 100 starts the execution of the toner removal operation after jamming has been resolved at the time t1. Moreover, from the start of the toner removal operation after jamming has been resolved up to immediately prior to the time t3, the printer 10 carries out the same operation as the toner removal operation after jamming has been resolved according to the first working example.

That is to say, the toner D1 remaining on the photoconductors on the photoconductors 20Y, 20M, 20C and 20K (the remaining toner represented by the black circles (•) in FIG. 14A) is moved through the rotation of the photoconductors and is transferred to the intermediate transfer belt 70 by primary transfer at the primary transfer locations B1, B2, B3 and B4 (see FIGS. 14B and 14C). Moreover, the remaining toner D3 not transferred by secondary transfer remaining on the intermediate transfer belt 70 is moved to the toner removal location C2 as the intermediate transfer belt 70 rotates and is removed by the intermediate transfer belt cleaning blade 87 (see FIGS. 14B and 14C).

On the other hand, the operation of the printer 10 from the time t3 onward differs from the operation of the printer 10 according to the first working example. Accordingly, the following is an explanation of the operation of the printer 10 from the time t3 onward.

First of all, different to the toner removal operation after jamming has been resolved according to the first working example, the control unit 100 does not cause the supply of the primary transfer bias with the primary transfer bias supply section 123*a* and does not cause the supply of the reverse transfer bias with the reverse transfer bias supply section 123*b* at the time t3. That is to say, the voltage supply section 123 does not supply any voltage to the intermediate transfer belt 70. Moreover, the voltage supply section 123 does not supply any voltage to the intermediate transfer belt 70 until the intermediate transfer belt 70 has rotated about once after the jamming.

Then, while no voltage is supplied with the voltage supply section 123, all of the remaining toner D2 not yet transferred by secondary transfer and the toner D1 remaining on the photoconductors is removed by the intermediate transfer belt cleaning blade 87. Here, the voltage (primary transfer bias) from the voltage supply section 123 is not supplied to the intermediate transfer belt 70, so that no force attracting the remaining toner D2 not yet transferred by secondary transfer or the toner D1 remaining on the photoconductors to the intermediate transfer belt 70 acts on the remaining toner D2 not yet transferred by secondary transfer or the toner D1 remaining on the photoconductors at the toner removal location C2. Therefore, the remaining toner D2 not yet transferred by secondary transfer and the toner D1 remaining on the photoconductors is suitably removed by the intermediate transfer belt cleaning blade 87. Also the remaining toner D3 not transferred by secondary transfer remaining between the secondary transfer location C1 and the toner removal location C2 at the time t3 is removed by the intermediate transfer belt cleaning blade 87, just like the remaining toner D2 not yet transferred by secondary transfer and the toner D1 remaining on the photoconductors, while no voltage is supplied with the voltage supply section 123.

Then, at the time t4, that is, after the toner D1 remaining on the photoconductors has been removed by the intermediate transfer belt cleaning blade 87, the control unit 100 stops the photoconductors 20Y, 20M, 20C and 20K and the intermediate transfer belt 70. Thus, the toner removal operation after jamming has been resolved according to the second working example is terminated. It should be noted that, as in the first working example, the time t4 corresponds to the time at which the intermediate transfer belt 70 has rotated once after the jamming.

Advantageous Effects of the Printer 10 According to the Second Embodiment

As explained above, when a situation has arisen in which the image forming operation is stopped midway (in the following this situation is explained with jamming of the medium as an example), the controller (control unit 100) of the image forming apparatus (printer 10) according to this embodiment causes the supply of a transfer voltage (primary transfer bias) with the voltage supply section 123 until the toner D1*a* remaining on the photoconductors at the developing locations A1, A2, A3 and A4 when jamming occurred has reached the primary transfer locations B1, B2, B3 and B4 due to the rotation of the image bearing members (photoconductors 20Y, 20M, 20C and 20K) after the jamming has been resolved, and stops the supply of the primary transfer bias with the voltage supply section 123 after the toner D1*a* remaining on the photoconductors at the developing locations A1, A2, A3 and A4 when the jamming occurred has reached the primary transfer locations B1, B2, B3 and B4 and before the remaining toner D2*a* not yet transferred by secondary transfer located at the secondary transfer location C1 when the jamming occurred has been moved to the developer removal location (toner removal location C2) through the rotation of the intermediate transfer member (intermediate transfer belt 70) and removed with the removal member (intermediate transfer belt cleaning blade 87). Thus, the toner D1 remaining on the photoconductors remaining on the photoconductors 20Y, 20M, 20C and 20K when the jamming occurred is suitably transferred to the intermediate transfer belt 70 and the toner D1 remaining on the photoconductors and the remaining toner D2 not yet transferred by secondary transfer, which has remained on the photoconductors and the intermediate transfer belt 70 when the jamming occurred, is suitably removed by the intermediate transfer belt cleaning blade 87 in order to resume the image forming operation. This is described in greater detail in the following.

As explained above, the following two aspects are desirable with regard to the remaining toner remaining on the photoconductors 20Y, 20M, 20C and 20K and the intermediate transfer belt 70 when jamming of the medium occurred (toner D1 remaining on the photoconductors and remaining toner D2 not yet transferred by secondary transfer).

Firstly, the toner D1 remaining on the photoconductors remaining on the photoconductors 20Y, 20M, 20C and 20K when jamming occurred should be suitably transferred to the intermediate transfer belt 70 after the jamming has been resolved. The following explains the reasons for this. If the toner D1 remaining on the photoconductors is transferred to the intermediate transfer belt 70, then the toner D1 remaining on the photoconductors is not removed with the photoconductor cleaning blades 76Y, 76M, 76C and 76K, so that the containers containing the removed remaining toner, which are provided in the photoconductor cleaning units 75Y, 75M, 75C and 75K can be made more compact. Moreover, the amount of toner to be removed by the photoconductor cleaning blades is small, so that the toner remaining on the photoconductors 20Y, 20M, 20C and 20K is suitably removed even if the performance of the photoconductor cleaning blades is poor. Thus, if the toner D1 remaining on the photoconductors is transferred to the intermediate transfer belt 70, the configuration of the photoconductor cleaning units 75Y, 75M, 75C and 75K can be simplified.

The following is an explanation of a second reason. As explained above, when the jamming occurs, toner D1 remaining on the photoconductors, remaining toner D2 not yet transferred by secondary transfer and remaining toner D3 not transferred by secondary transfer are present on the photoconductors 20Y, 20M, 20C and 20K and on the intermediate transfer belt 70. Here, the distributions of the toner D1 remaining on the photoconductors and the remaining toner D2 not yet transferred by secondary transfer are denser than the distribution of the remaining toner D3 not transferred by secondary transfer, so that the toner D1 remaining on the photoconductors and the remaining toner D2 are more difficult to remove with the intermediate transfer belt cleaning blade 87. Therefore, in order to resume the image forming operation, it is desirable to suitably remove the toner D1 remaining on the photoconductors and the remaining toner D2 not yet transferred by secondary transfer with the intermediate transfer belt cleaning blade 87 after the jamming has been resolved.

Figure 16A:
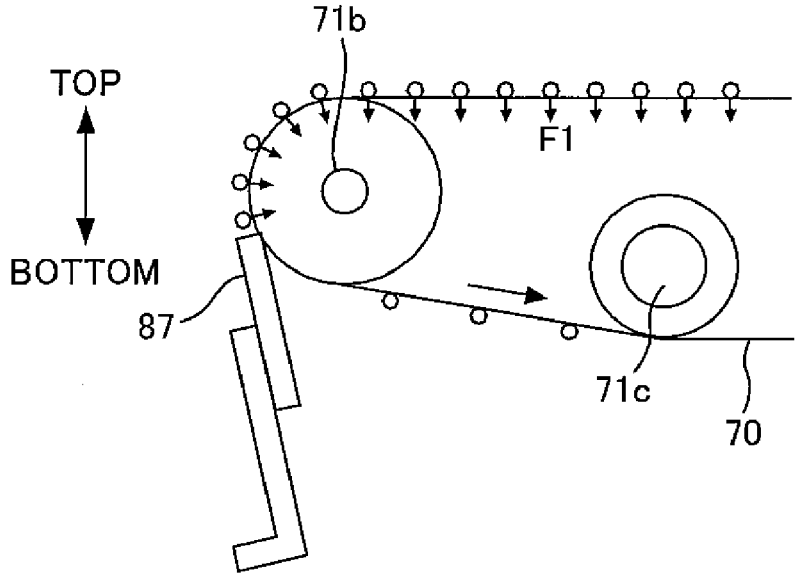
FIG. 16A is a diagram illustrating a comparative example according to the second embodiment.

This is explained in more detail with reference to FIG. 16A. In the comparative example shown in FIG. 16A, when the toner D1 remaining on the photoconductors and the remaining toner D2 not yet transferred by secondary transfer are removed by the intermediate transfer belt cleaning blade 87, the primary transfer bias is supplied to the intermediate transfer belt 70 in order to let the toner advance to the intermediate transfer belt 70. Thus, as shown in FIG. 16A, when the primary transfer bias is supplied to the intermediate transfer belt 70, a force attracting the remaining toner D2 not yet transferred by secondary transfer (or the toner D1 remaining on the photoconductors) located at the toner removal location C2 to the intermediate transfer belt 70 (the force F1 in FIG. 16) acts on that toner. The reason why this force F1 acts is that the remaining toner D2 not yet transferred by secondary transfer and the toner D1 remaining on the photoconductors is toner that is negatively charged, and the polarity of the primary transfer bias is opposite to that charge polarity of the remaining toner D2 not yet transferred by secondary transfer and the toner D1 remaining on the photoconductors. Therefore, at the toner removal location C2, a portion of the remaining toner D2 not yet transferred by secondary transfer and the toner D1 remaining on the photoconductors is not removed by the intermediate transfer belt cleaning blade 87 and this portion passes the toner removal location C2. Thus, the toner D1 remaining on the photoconductors and the remaining toner D2 not yet transferred by secondary transfer is not suitably removed by the intermediate transfer belt cleaning blade 87. It should be noted that the distribution of the remaining toner D3 not transferred by secondary transfer is coarse, so that even when the primary transfer bias is supplied to the intermediate transfer belt 70 when removing the remaining toner D3 not transferred by secondary transfer, the remaining toner D3 not transferred by secondary transfer can be easily removed with the intermediate transfer belt cleaning blade 87. FIG. 16A is a diagram illustrating a comparative example, and in FIG. 16A, the primary transfer unit 60 is not depicted for illustrative reasons (the same is true for FIG. 16B explained below).

On the other hand, in the present embodiment, the primary transfer bias is supplied with the voltage supply section 123 until the toner D1*a* remaining on the photoconductors reaches the primary transfer locations B1, B2, B3 and B4 due to the rotation of the photoconductor 20Y, as shown in FIGS. 13 and 15. Moreover, after the toner D1*a* remaining on the photoconductors has reached the primary transfer locations B1, B2, B3 and B4 and prior to the removal of the remaining toner D2*a* not yet transferred by secondary transfer with the intermediate transfer belt cleaning blade 87, the supply of the primary transfer bias with the voltage supply section 123 is stopped.

Thus, if the primary transfer bias is supplied until the toner D1*a* remaining on the photoconductors reaches the primary transfer location, it becomes possible to reliably transfer the toner remaining on the photoconductors remaining on the photoconductors 20Y, 20M, 20C and 20K when the jamming occurred to the intermediate transfer belt 70. Moreover, if the supply of the primary transfer bias with the voltage supply section 123 is stopped after the toner D1*a* remaining on the photoconductors has reached the primary transfer location and prior to the removal of the remaining toner D2*a* not yet transferred by secondary transfer with the intermediate transfer belt cleaning blade 87, then a force F1 attracting the remaining toner D2 not yet transferred by secondary transfer and the toner D1 remaining on the photoconductors that has reached the toner removal location C2 to the intermediate transfer belt 70 is not effected. Therefore, the remaining toner D2 not yet transferred by secondary transfer and the toner D1 remaining on the photoconductors is suitably removed by the intermediate transfer belt cleaning blade 87.

Figure 16B:
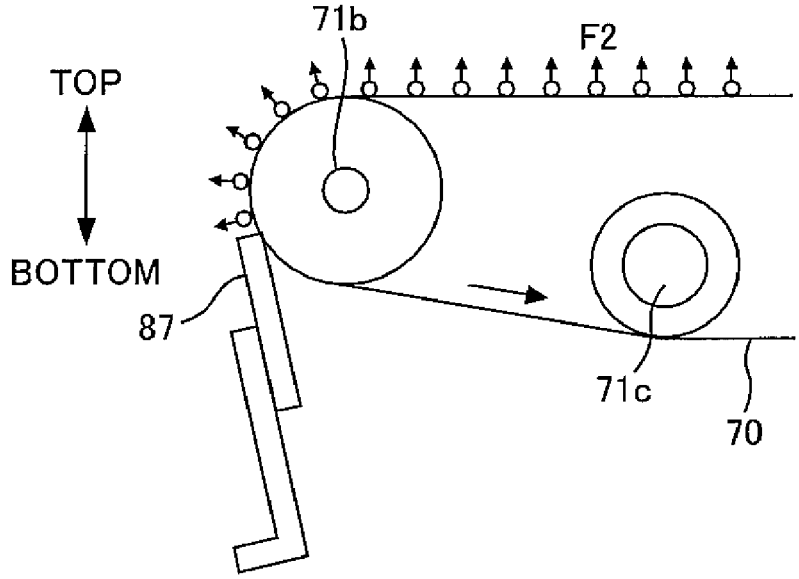
FIG. 16B illustrates the advantageous effect of the printer 10 according to the second embodiment.

It should be noted that in the first working example shown in FIG. 13, after the toner D1*a* remaining on the photoconductors has reached the primary transfer location and prior to the removal of the remaining toner D2*a* not yet transferred by secondary transfer with the intermediate transfer belt cleaning blade 87, the supply of the primary transfer bias with the primary transfer bias supply section 123*a* of the voltage supply section 123 is stopped and the reverse transfer bias is supplied with the reverse transfer bias supply section 123*b*, so that the following effects are achieved. That is, if the reverse transfer bias, which is a voltage of the same polarity as the charge polarity of the remaining toner D2 not yet transferred by secondary transfer and the toner D1 remaining on the photoconductors, is supplied to the intermediate transfer belt 70, then a force F2 repelling the remaining toner D2 not yet transferred by secondary transfer (or the toner D1 remaining on the photoconductors) at the toner removal location C2 from the intermediate transfer belt 70 is effected, as shown in FIG. 16B. Therefore, the remaining toner D2 not yet transferred by secondary transfer and the toner D1 remaining on the photoconductors is easily removed by the intermediate transfer belt cleaning blade 87. It should be noted that FIG. 16B illustrates the advantageous effect of the printer 10 according to the present embodiment.

Modified Example of the Printer 10 According to the Second Embodiment

The following is an explanation of the printer 10 according to a modified example, which is different from the above-explained printer 10 (for convenience, also referred to below as "printer 10 according to the unmodified example").

Configuration of Modified Example of the Printer 10 According to the Second Embodiment First, the configuration of the printer 10 according to the modified example is explained. The configuration of the intermediate transfer belt 70 and the components surrounding it in the printer 10 according to the modified example is different from their configuration in the printer 10 according to the unmodified example. Accordingly, the following is an explanation of the configuration of the intermediate transfer belt 70 and the components surrounding it. It should be noted that the configuration of components of the printer 10 according to the modified example that are not discussed below is the same as the configuration of those components in the printer 10 according to the unmodified example.

Figure 17:
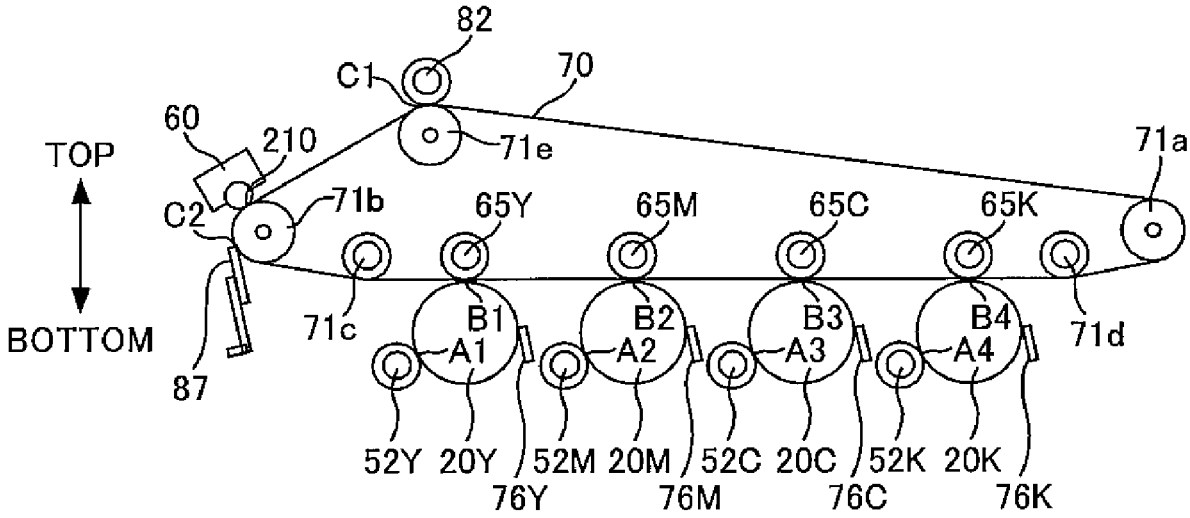
FIG. 17 is a diagram showing the intermediate transfer belt 70 of the printer 10 according to a modified example.

FIG. 17 is a diagram showing the intermediate transfer belt 70 of the printer 10 according to the modified example. As in the unmodified example, the intermediate transfer belt 70 includes a resistive layer 70*a* and an electrode layer 70*b* (see FIG. 5). Moreover, the electrode roller 210 of the primary transfer unit 60 abuts against the electrode layer 70*b* (see FIG. 6), as in the unmodified example. Furthermore, the voltage supply section 123 supplies the primary transfer bias or the reverse transfer bias to intermediate transfer belt 70 via the primary transfer unit 60.

On the other hand, in addition to the above-described backup rollers 65Y, 65M, 65C and 65K, the driving roller 71*a*, the following roller 71*b*, the roller 71*c*, and the roller 71*d*, a roller 71*e* is arranged on the inner side of the intermediate transfer belt 70. Moreover, in the unmodified example, the secondary transfer roller 82 is separated from and abutted against the driving roller 71*a* via the intermediate transfer belt 70 (see FIGS. 14A and 14B), but in the modified example, the secondary transfer roller 82 is separated from and abutted against the driving roller 71*e* via the intermediate transfer belt 70. Due to this configuration, the distance that the toner located at the primary transfer location B4 travels to the secondary transfer location C1 is longer than in the unmodified example. On the other hand, the distance that the toner located at the secondary transfer location C1 travels to the toner removal location C2 is shorter than in the unmodified example.

Toner Removal Operation After Jamming has been Resolved in the Modified Example of the Printer 10 According to the Second Embodiment Also in the printer 10 according to the modified example, the above-noted "operation of the printer 10 when jamming occurs during image formation" is carried out. However, in this operation, the toner removal operation after jamming has been resolved differs from that of the unmodified example.

The following is an explanation of two working examples of the toner removal operation after jamming has been resolved according to the modified example. In these working examples, mainly the operations of the photoconductors 20Y, 20M, 20C, 20K, the intermediate transfer belt 70 and the voltage supply section 123, as well as the state of the remaining toner on the photoconductors 20Y, 20M, 20C, 20K and the intermediate transfer belt 70 during the toner removal operation after jamming has been resolved are explained. It should be noted that in order to distinguish them from the first working example and the second working example of the toner removal operation after jamming has been resolved according to the unmodified example, the two working examples of the toner removal operation after jamming has been resolved according to the modified example are referred to as the third working example and the fourth working example.

Figure 18:
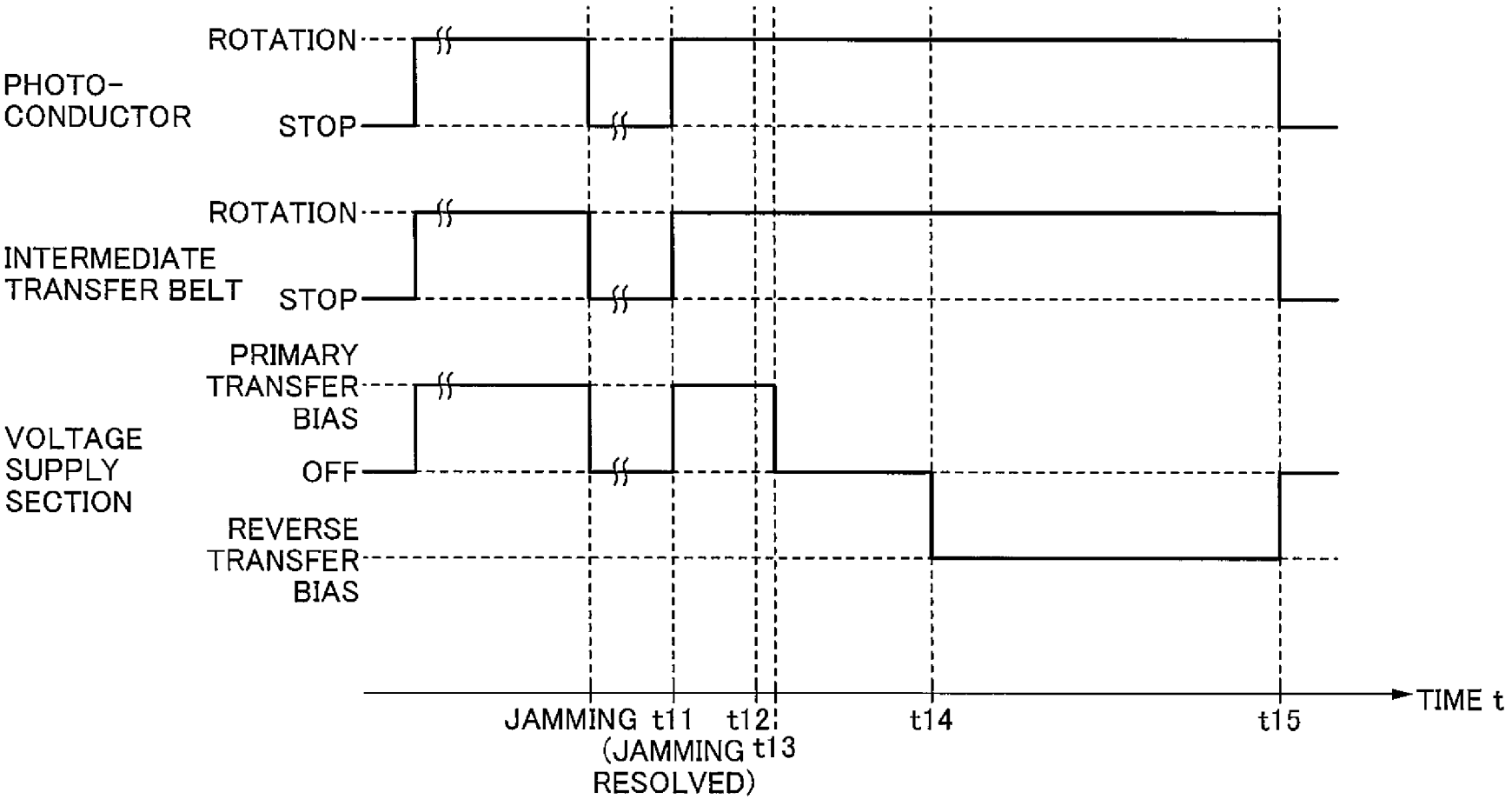
FIG. 18 is a timing chart illustrating the toner removal operation after jamming has been resolved according to a third working example of the second embodiment.
Figure 19A:
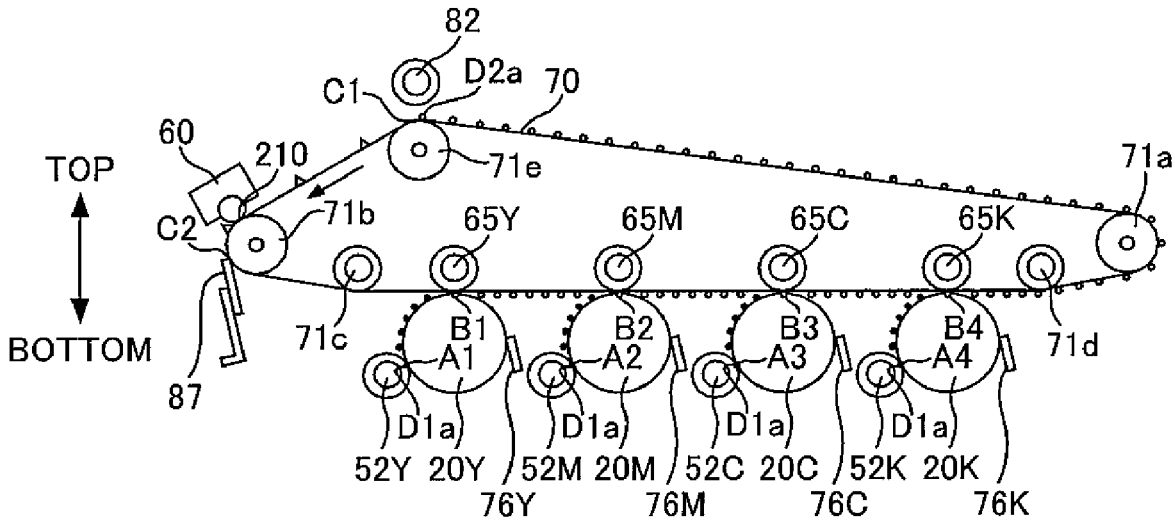
FIG. 19A is a diagram showing the state of the remaining toner at the time t11 in FIG. 18.
Figure 19B:
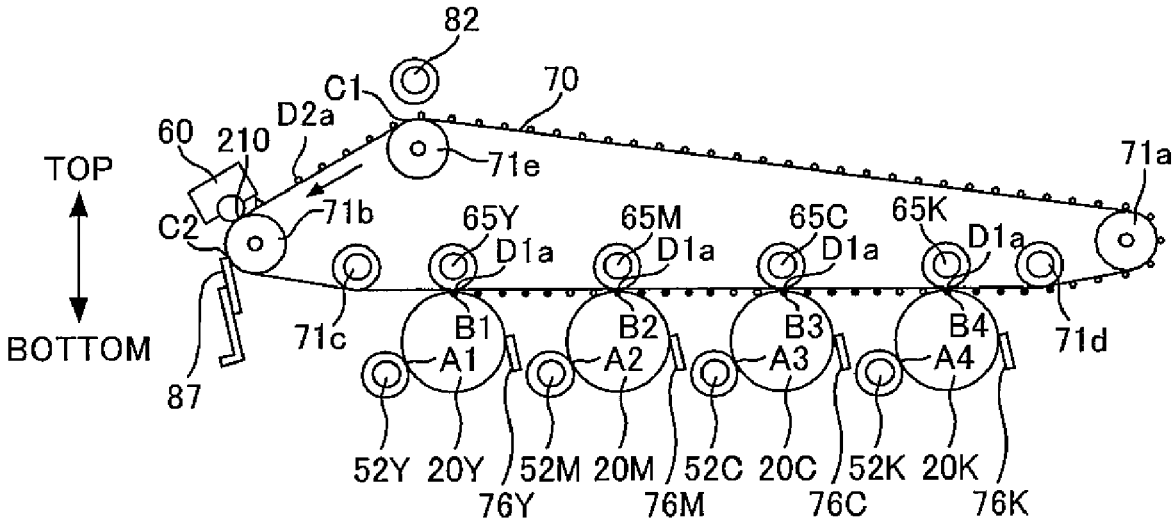
FIG. 19B is a diagram showing the state of the remaining toner at the time t12 in FIG. 18.
Figure 19C:
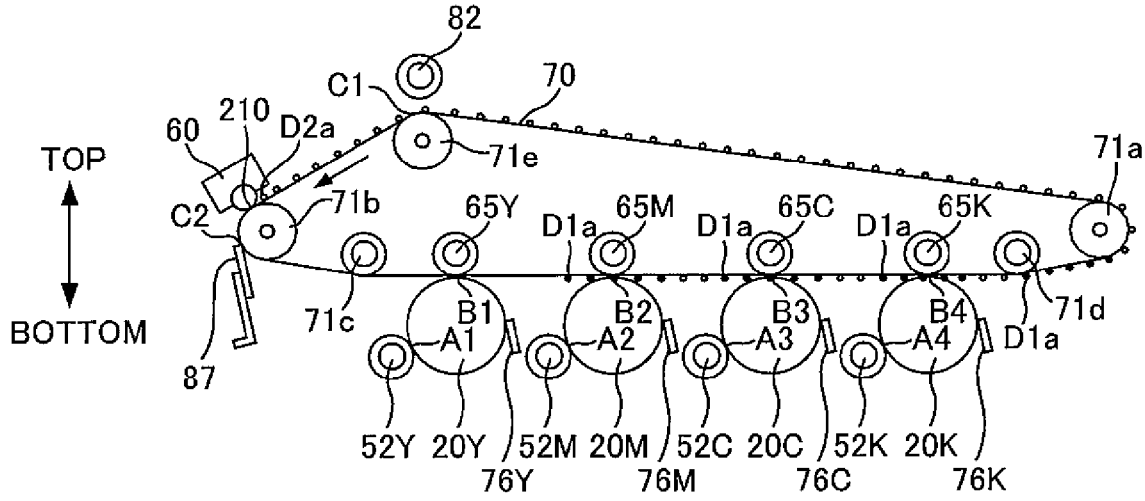
FIG. 19C is a diagram showing the state of the remaining toner at the time t13 in FIG. 18.
Figure 19D:
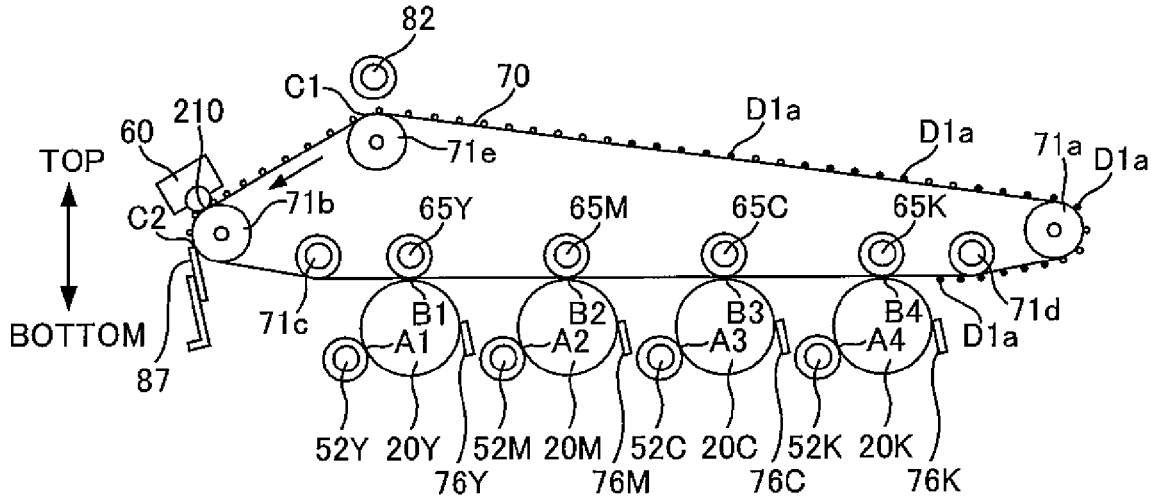
FIG. 19D is a diagram showing the state of the remaining toner at the time t14 in FIG. 18.

Third Working Example of Toner Removal Operation after Jamming has been Resolved in the Modified Example of the Printer 10 According to the Second Embodiment The third working example of the toner removal operation after jamming has been resolved is explained with reference to FIGS. 18 and 19A to 19D. FIG. 18 is a timing chart illustrating the toner removal operation after jamming has been resolved according to this third working example. FIGS. 19A to 19D are diagrammatic views showing the state of the remaining toner on the photoconductors 20Y, 20M, 20C and 20K and on the intermediate transfer belt 70. FIG. 19A shows the state of the remaining toner at the time t11 in FIG. 18, FIG. 19B shows the state of the remaining toner at the time t12 in FIG. 18, FIG. 19C shows the state of the remaining toner at the time t13 in FIG. 18, and FIG. 19D shows the state of the remaining toner at the time t14 in FIG. 18. It should be noted that in FIG. 18, the arrow indicates time t. The white and black circles and triangles (○, •, Δ) in FIGS. 19A to 19D represent toner.

As mentioned above, the control unit 100 begins the execution of the toner removal operation after jamming has been resolved when it has judged that jamming has been resolved (at the time t11 in FIG. 18). More specifically, at the time t11, the control unit 100 causes the photoconductors 20Y, 20M, 20C and 20K and the intermediate transfer belt 70 to rotate simultaneously. On the other hand, at the time t11, the control unit 100 does not cause the charging units 30Y, 30M, 30C and 30K, the exposing units 40Y, 40M, 40C and 40K or the developing units 50Y, 50M, 50C and 50K to operate. Therefore, no new latent image or toner image is formed on the photoconductors 20Y, 20C, 20M and 20K (see FIGS. 19C and 19D).

When the photoconductors 20Y, 20M, 20C and 20K are rotated at the time t11, also the toner D1 remaining on the photoconductors remaining on the above photoconductors when the jamming occurred (the remaining toner represented by the dark circles (•) in FIG. 19A) is moved.

It should be noted that in the toner removal operation after jamming has been resolved according to this embodiment, the control unit 100 causes the supply of the primary transfer bias with the primary transfer bias supply section 123*a* of the voltage supply section 123 at the time t11. Then, the control unit 100 continues the supply of the primary transfer bias with the primary transfer bias supply section 123*a* until the toner remaining on the photoconductors at the developing locations A1, A2, A3 and A4 when the jamming occurred (also referred to in the following as "toner D1*a* remaining on the photoconductors") reaches the primary transfer locations B1, B2, B3 and B4 due to the rotation of the photoconductor 20Y. Therefore, the toner D1 remaining on the photoconductors is transferred by primary transfer to the intermediate transfer belt 70 at the primary transfer locations B1, B2, B3 and B4.

In this working example, the toner D1*a* remaining on the photoconductors reaches the primary transfer location B1 at the time t12 and is transferred by primary transfer to the intermediate transfer belt 70. Consequently, the control unit 100 continues to supply the primary transfer bias from the time t11 to the time t12.

The intermediate transfer belt 70 continues to rotate from the time t11 to the time t12. Consequently, the remaining toner D2 not yet transferred by secondary transfer (the remaining toner represented by white circles (O) in FIG. 19A) and the remaining toner D3 not transferred by secondary transfer (the remaining toner represented by white triangles (Δ) in FIG. 19A) is moved due to this rotation of the intermediate transfer belt 70. Moreover, also the toner D1 remaining on the photoconductors that has been transferred by primary transfer to the intermediate transfer belt 70 at the primary transfer locations B1, B2, B3 and B4 is moved through the rotation of the intermediate transfer belt 70. Then, as the intermediate transfer belt 70 is rotated, the remaining toner D3 not transferred by secondary transfer reaches the toner removal location C2 and is removed by the intermediate transfer belt cleaning blade 87.

On the other hand, the remaining toner D2 not yet transferred by secondary transfer (the remaining toner located at the secondary transfer location C1 when the jamming occurred (in the following also referred to as "remaining toner D2*a* not yet transferred by secondary transfer")) does not reach the toner removal location C2 shown in FIG. 19B during the period from the time t11 to the time t12. This is because the length in rotation direction of the photoconductor 20Y (20M, 20C, 20K) from the developing location A1 (A2, A3, A4) to the primary transfer location B1 (B2, B3, B4) is configured to be shorter than the length in rotation direction of the intermediate transfer belt 70 from the secondary transfer location C1 to the toner removal location C2.

The intermediate transfer belt 70 continues to rotate even after the time t12, and as the intermediate transfer belt 70 rotates, the intermediate transfer belt cleaning blade 87 continues to remove the remaining toner D3 not transferred by secondary transfer that moves and reaches the toner removal location C2. The control unit 100 continues to supply the primary transfer bias even after the time t12.

Moreover, at the time t13, which is immediately before the remaining toner D2*a* not yet transferred by secondary transfer reaches the toner removal location C2, the control unit 100 stops the supply of the primary transfer bias that has continued up to that time. Furthermore, the control unit 100 maintains the stop of the supply of the primary transfer bias with the primary transfer bias supply section 123*a* up to the time t14, which is immediately after the time when, due to further rotation of the intermediate transfer belt 70, the toner D1*a* remaining on the photoconductor remaining on the photoconductor 20Y when the jamming occurred has passed the primary transfer location B4 corresponding to the photoconductor 20K.

From the time t13 to the time t14, the remaining toner D3 not transferred by secondary transfer and the remaining toner D2 not yet transferred by secondary transfer that has reached the toner removal location C2 is removed by the intermediate transfer belt cleaning blade 87. Here, no primary transfer bias is supplied to the intermediate transfer belt 70, so that no force attracting the remaining toner D3 not transferred by secondary transfer or the remaining toner D2 not yet transferred by secondary transfer at the toner removal location C2 to the intermediate transfer belt 70 acts on the remaining toner D3 not transferred by secondary transfer or the remaining toner D2 not yet transferred by secondary transfer. Therefore, the remaining toner D3 not transferred by secondary transfer and the remaining toner D2 not yet transferred by secondary transfer is suitably removed by the intermediate transfer belt cleaning blade 87.

Then, the control unit 100 causes the supply of the reverse transfer bias with the reverse transfer bias supply section 123*b* at the time t14. Moreover, until the intermediate transfer belt 70 has rotated about once since the jamming, the control unit 100 continues to supply the reverse transfer bias with the reverse transfer bias supply section 123*b*.

While supplying the reverse transfer bias with the reverse transfer bias supply section 123*b*, the remaining toner D2 not yet transferred by secondary transfer and the toner D1 remaining on the photoconductors is removed by the intermediate transfer belt cleaning blade 87. Here, as mentioned above, the remaining toner D2 not yet transferred by secondary transfer and the toner D1 remaining on the photoconductors is toner that is charged negatively, and the reverse transfer bias supplied to the intermediate transfer belt 70 is a voltage of the same polarity as the charge polarity of the remaining toner D2 not yet transferred by secondary transfer and the toner D1 remaining on the photoconductors. Therefore, a force attempting to separate the remaining toner D2 not yet transferred by secondary transfer and the toner D1 remaining on the photoconductors from the intermediate transfer belt 70 acts on the remaining toner D2 not yet transferred by secondary transfer and the toner D1 remaining on the photoconductors at the toner removal location C2. Therefore, the remaining toner D2 not yet transferred by secondary transfer and the toner D1 remaining on the photoconductors is suitably removed with the intermediate transfer belt cleaning blade 87.

The following is an explanation of the reason why the reverse transfer bias is supplied immediately after the toner D1*a* remaining on the photoconductor remaining on the photoconductor 20Y when the jamming occurred has passed the primary transfer location B4 corresponding to the photoconductor 20K. As explained above, when the reverse transfer bias is supplied to the intermediate transfer belt 70, a force attempting to separate the toner D1 remaining on the photoconductors and the remaining toner D2 not yet transferred by secondary transfer on the intermediate transfer belt 70 from the intermediate transfer belt 70 acts on that toner. As long as this force acts, there is the risk that the toner D1 remaining on the photoconductors and the remaining toner D2 not yet transferred by secondary transfer is transferred (reversely transferred) to the photoconductors 20M, 20C or 20K at the primary transfer locations. By contrast, when the reverse transfer bias is supplied immediately after the toner D1*a* remaining on the photoconductors has passed the primary transfer location B4, then reverse transfer of the toner D1 remaining on the photoconductors and the remaining toner D2 to the photoconductors 20M, 20C and 20K is prevented.

Next, the control unit 100 stops the supply of the reverse transfer bias with the reverse transfer bias supply section 123*b* at the time t15. Moreover, at the time t15, the control unit 100 stops the rotation of the photoconductors 20Y, 20M, 20C and 20K and the intermediate transfer belt 70. Thus, the toner removal operation after jamming has been resolved according to the third working example is terminated. Here, the time t15 corresponds to the time in which the intermediate transfer belt 70 is rotated once after the jamming. However, there is no limitation to this, and for example, it is also possible that the time t15 corresponds to the time in which the intermediate transfer belt 70 has rotated twice after the jamming.

Figure 20:
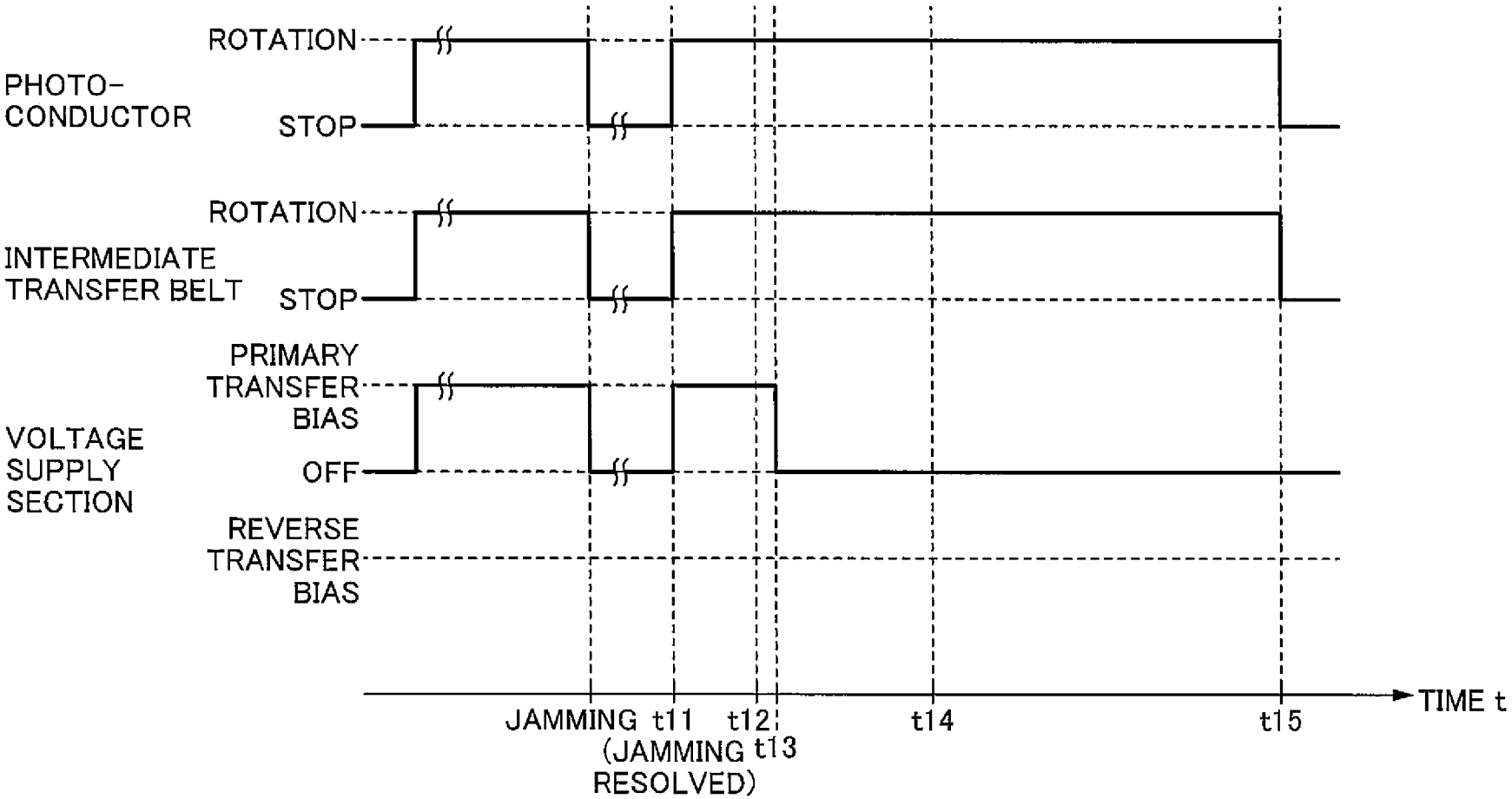
FIG. 20 is a timing chart illustrating the toner removal operation after jamming has been resolved according to a fourth working example of the second embodiment.

Fourth Working Example of Toner Removal Operation after Jamming has been Resolved in the Modified Example of the Printer 10 According to the Second Embodiment The fourth working example of the toner removal operation after jamming has been resolved is explained with reference to FIGS. 19A to 19D and 20. FIG. 20 is a timing chart illustrating the toner removal operation after jamming has been resolved according to this fourth working example. It should be noted that the times t11 to t15 in FIG. 20 represent the same times as the times t11 to t15 in FIG. 18.

Also in the fourth working example, the control unit 100 starts the execution of the toner removal operation after jamming has been resolved at the time t11. Moreover, from the start of the toner removal operation after jamming has been resolved up to immediately prior to the time t14, the printer 10 carries out the same operation as the toner removal operation after jamming has been resolved according to the third working example.

That is to say, the toner D1 remaining on the photoconductors remaining on the photoconductors 20Y, 20M, 20C and 20K (the remaining toner represented by the black circles (•) in FIG. 19A) is moved through the rotation of the photoconductors and is transferred to the intermediate transfer belt 70 by primary transfer at the primary transfer locations B1, B2, B3 and B4 (see FIGS. 19A and 19B). Moreover, the toner D3 not transferred by secondary transfer and the remaining toner D2 not yet transferred by secondary transfer, which remains on the intermediate transfer belt 70, is moved to the toner removal location C2 as the intermediate transfer belt 70 rotates and is removed by the intermediate transfer belt cleaning blade 87 (see FIGS. 19B and 19C). Moreover, at the time t13, the control unit 100 stops the supply of the primary transfer bias, which has continued from the time t11. More specifically, at the time t13, the control unit 100 stops the supply of a voltage to the intermediate transfer belt 70 with the voltage supply section 123.

On the other hand, the operation of the printer 10 from the time t14 onward differs from the operation of the printer 10 according to the third working example. Accordingly, the following is an explanation of the operation of the printer 10 from the time t14 onward.

First, different to the toner removal operation after jamming has been resolved according to the third working example, the control unit 100 lets the voltage supply section

123 maintain the stop of the supply of a voltage to the intermediate transfer belt 70 even at the time t14. Then, the voltage supply section 123 does not supply any voltage to the intermediate transfer belt 70 until the intermediate transfer belt 70 has rotated about once after the jamming.

Then, while no voltage is supplied by the voltage supply section 123, the remaining toner D2 not yet transferred by secondary transfer and the toner D1 remaining on the photoconductors is removed by the intermediate transfer belt cleaning blade 87. Here, the voltage (primary transfer bias) from the voltage supply section 123 is not supplied to the intermediate transfer belt 70, so that no force attracting the remaining toner D2 not yet transferred by secondary transfer and the toner D1 remaining on the photoconductors to the intermediate transfer belt 70 acts on the remaining toner D2 not yet transferred by secondary transfer and the toner D1 remaining on the photoconductors at the toner removal location C2. Therefore, the remaining toner D2 not yet transferred by secondary transfer and the toner D1 remaining on the photoconductors is suitably removed by the intermediate transfer belt cleaning blade 87.

Then, at the time t15 after the toner D1 remaining on the photoconductors has been removed by the intermediate transfer belt cleaning blade 87, the control unit 100 stops the photoconductors 20Y, 20M, 20C and 20K and the intermediate transfer belt 70. Thus, the toner removal operation after jamming has been resolved according to the fourth working example is terminated. It should be noted that, as in the third working example, the time t15 corresponds to the time in which the intermediate transfer belt 70 is rotated once after the jamming.

Advantageous Effects of the Modified Example of the Printer 10 According to the Second Embodiment Also in the modified example, as in the unmodified example, the control unit 100 supplies a transfer voltage (primary transfer bias) with a voltage supply section 123 (primary transfer bias supply section 123*a*) until the toner D1*a* remaining on the photoconductors has moved through the rotation of the photoconductor 20Y and has reached the primary transfer locations B1, B2, B3 and B4, and stops the supply of the primary transfer bias with the primary transfer bias supply section 123*a* after the toner D1*a* remaining on the photoconductors has reached the primary transfer locations B1, B2, B3 and B4 and before the remaining toner D2*a* not yet transferred by secondary transfer has moved to the toner removal location C2 through the rotation of the intermediate transfer belt 70 and is removed with the intermediate transfer belt cleaning blade 87 (see FIGS. 18 and 20).

Therefore, also in the printer 10 according to the modified example, the same effects as with the printer 10 of the unmodified example are achieved. That is to say, if the primary transfer bias is supplied until the toner D1*a* remaining on the photoconductors reaches the primary transfer location, it becomes possible to reliably transfer the toner remaining on the photoconductors remaining on the photoconductors 20Y, 20M, 20C and 20K when the jamming occurred to the intermediate transfer belt 70. Moreover, if the supply of the primary transfer bias with the voltage supply section 123 is stopped after the toner D1*a* remaining on the photoconductors has reached the primary transfer location and prior to the removal of the remaining toner D2*a* not yet transferred by secondary transfer with the intermediate transfer belt cleaning blade 87, then a force F1 attracting the remaining toner D2 not yet transferred by secondary transfer and the toner D1 remaining on the photoconductors that has reached the toner removal location C2 to the intermediate transfer belt 70 is not effected. Therefore, a large amount of the remaining toner D2 not yet transferred by secondary transfer and the toner D1 remaining on the photoconductors is suitably removed by the intermediate transfer belt cleaning blade 87.

Other Working Examples According to the Second Embodiment

In the foregoing, an image forming apparatus according to the invention was explained based on the second embodiment, but the above-described embodiments of the invention are merely to facilitate the understanding of the invention, and are in no way meant to limit the invention. The invention can of course be altered and improved without departing from the gist thereof and equivalents are intended to be embraced therein.

Also, in the foregoing second embodiment, the photoconductor, which is an image bearing member, was explained as having a photoconductive layer on the outer circumferential surface of a tubular conductive member, but there is no limitation to this. For example, it may also be a so-called photoconductive belt, in which a photoconductive layer is provided on the surface of a belt-shaped photoconductive member.

According to the second embodiment, the intermediate was explained to be a belt, but there is no limitation to this, and the intermediate transfer member may also be a drum. Moreover, the removal member was explained to be a blade, but there is no limitation to this, and the removal member may also be a roller or the like.

Furthermore, in the second embodiment, as shown in FIG. 13 for example, the control unit 100 maintains the stop of the supply of the primary transfer bias with the voltage supply section 123 until the toner D1*a* remaining on the photoconductors at the developing location (more specifically, the developing location A1) when a situation has arisen in which the image forming operation is stopped midway (jamming of the medium) has traveled to the toner removal location C2 through the rotation of the photoconductor 20Y and the intermediate transfer belt 70 and has been removed by the intermediate transfer belt cleaning blade 87, but there is no limitation to this. For example, it is also possible to let it maintain the stop of the supply of the primary transfer bias with the voltage supply section 123 until the remaining toner located at the primary transfer position B1 when the jamming occurred is removed by the intermediate transfer belt cleaning blade 87.

However, if the stop of the supply of the primary transfer bias is maintained until the toner D1*a* remaining on the photoconductor on the photoconductor 20Y is removed, then it is possible that the intermediate transfer belt cleaning blade 87 effectively removes not only the remaining toner D2 not yet transferred by secondary transfer, but also the toner D1 remaining on the photoconductor on the photoconductor 20Y. Consequently, the above-described second embodiment is preferable.

Furthermore, in the second embodiment, the voltage supply section 123 (primary transfer bias supply section 123*a*) supplies the primary transfer bias across the entire intermediate transfer belt 70, but there is no limitation to this. For example, it is also possible that the intermediate transfer belt 70 is an annular belt having a joint section of a constant width extending in the perpendicular belt direction (see FIG. 5), and that the primary transfer bias supply section 123*a* does not supply the primary transfer bias at this joint section of the intermediate transfer belt 70 (that is to say, the primary transfer bias supply section 123*a* does not supply the primary transfer bias across the entire intermediate transfer belt 70).

However, if the configuration is such that the primary transfer bias is supplied across the entire intermediate transfer belt 70, then the force attracting the remaining toner D2 not yet transferred by secondary transfer located at the toner removal location C2 to the intermediate transfer belt 70 (the force F1 shown in FIG. 16A) is constantly effected when the primary transfer bias is supplied to the intermediate transfer belt 70. Therefore, the effect of the above-described printer 10, that is, the effect that the toner D1 remaining on the photoconductors and the remaining toner D2 not yet transferred by secondary transfer is suitably removed by the intermediate transfer belt cleaning blade 87 in order to the resume the image forming operation is achieved more effectively. Consequently, the above-described second embodiment is preferable.

Furthermore, in the above-described second embodiment, it was explained that the electrode layer 70*b* is provided at the end portion of the intermediate transfer belt 70 in the perpendicular direction perpendicular to the rotation direction of the intermediate transfer belt 70, as shown in FIG. 6. Moreover, it was explained that the printer 10 is provided with a conductive member (electrode roller 210) abutting against this electrode layer 70*b*. Moreover, it was explained that the voltage supply section 123 supplies the primary transfer bias via the electrode roller 210 to the intermediate transfer belt 70. However, there is no limitation to this, and any configuration is possible, as long as the primary transfer bias can be supplied from the voltage supply section 123 to the intermediate transfer belt 70.

Furthermore, in the second embodiment, it was explained that the printer 10 is provided with four photoconductors 20Y, 20M, 20C and 20K capable of bearing toners of different colors (that is, yellow toner, magenta toner, cyan toner and black toner), as shown in FIG. 1. And it was explained that the intermediate transfer belt 70 serves as an intermediate medium when transferring the toner on each of these photoconductors 20Y, 20M, 20C and 20K onto the medium. However, there is no limitation to this. For example, it is also possible that the printer 10 is provided only with one photoconductor (for example, the photoconductor 20K), in order to form images of a single color.

However, if the printer 10 is provided with four photoconductors 20Y, 20M, 20C and 20K, then remaining toner D1 on the photoconductors is present on the respective four photoconductors 20Y, 20M, 20C and 20K and remaining toner D2 not yet transferred by secondary transfer, which has been transferred from the four photoconductors, is present on the intermediate transfer belt 70 when jamming occurs. Therefore, the effect of the above-described printer 10, that is, the effect that the toner D1 remaining on the photoconductors when the jamming occurred is suitably transferred to the intermediate transfer belt 70 and the toner D1 remaining on the photoconductors and the remaining toner D2 not yet transferred by secondary transfer, which has remained on the photoconductors and the intermediate transfer belt 70 when the jamming occurred, is suitably removed by the intermediate transfer belt cleaning blade 87 in order to resume the image forming operation, is achieved more effectively. Consequently, the above-described second embodiment is preferable.

Third Embodiment

Operation of Forming an Adjustment Pattern According to the Third Embodiment As mentioned above, the printer 10 adjusts the quality of an image by forming an adjustment pattern on the intermediate transfer belt 70, from the viewpoint of preventing a decrease of the image quality of the image formed on the medium. This adjustment pattern is formed with toner that is advanced to the intermediate transfer belt 70 at the primary transfer locations B1, B2, B3 and B4. Moreover, the printer 10 is provided with a pattern detection sensor 130 for detecting this adjustment pattern (toner), and the printer 10 adjusts the image quality based on the result of detecting the adjustment pattern on the intermediate transfer belt 70 with this pattern detection sensor 130.

The following is an explanation of the operation of the printer 10 when adjustment patterns of four colors (namely a yellow adjustment pattern, a magenta adjustment pattern, a cyan adjustment pattern and a black adjustment pattern) are formed on the intermediate transfer belt 70 (also referred to below as "adjustment pattern forming operation").

Figure 21:
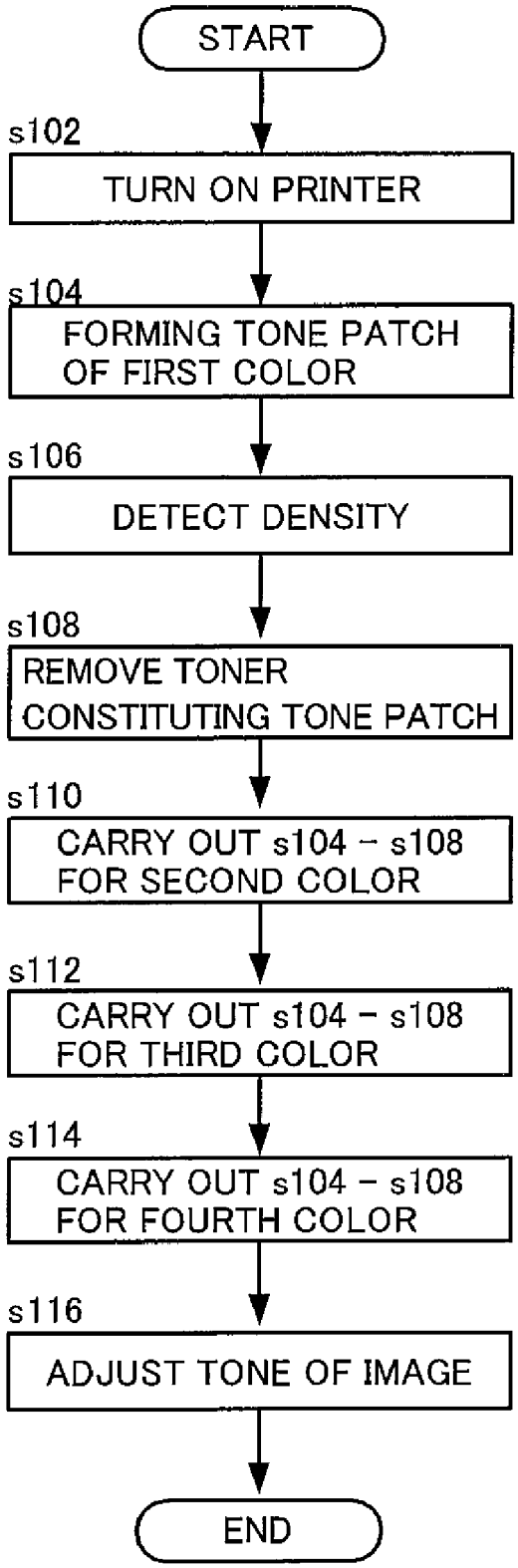
FIG. 21 is a flowchart illustrating the operation of the printer 10 during the formation of an adjustment pattern, in accordance with a third embodiment.
Figure 22:
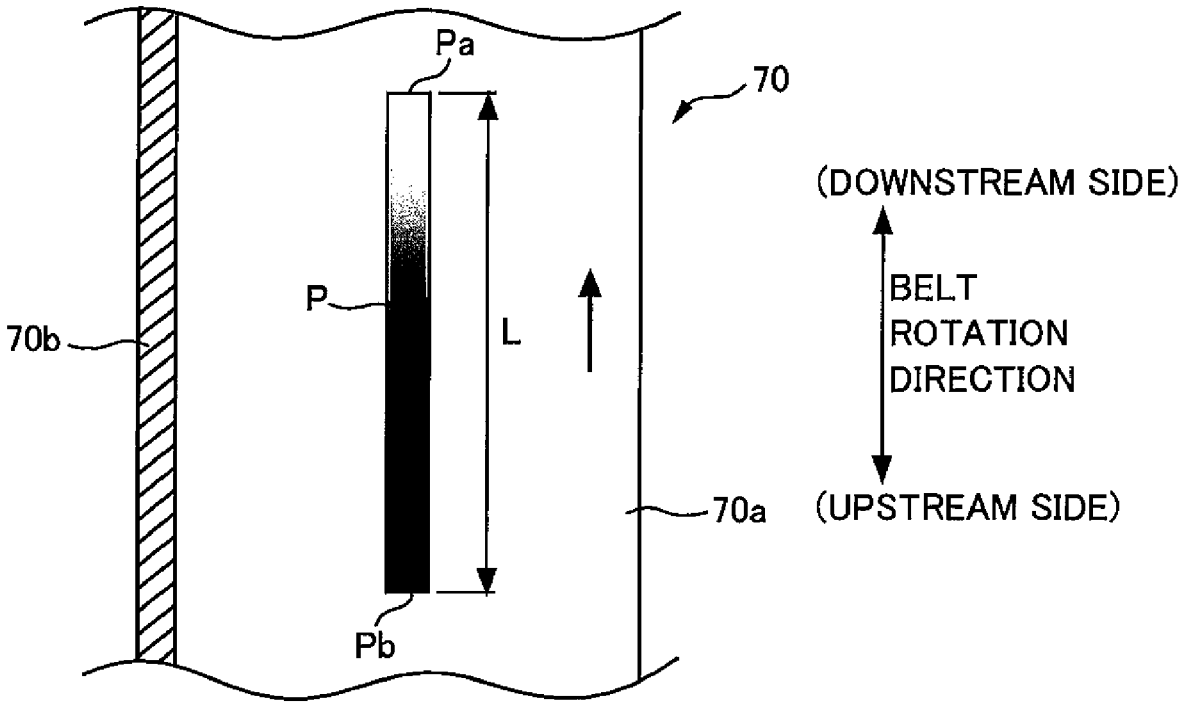
FIG. 22 is a diagrammatic view showing the adjustment pattern formed on the intermediate transfer belt 70 according to the third embodiment.

Operation Example of Printer 10 During Formation of Adjustment Pattern According to the Third Embodiment FIG. 21 is a flowchart illustrating the operation of the printer 10 during the formation of the adjustment pattern. FIG. 22 is a diagrammatic view showing the adjustment pattern formed on the intermediate transfer belt 70.

The various operations that are carried out by the printer 10 are realized mainly by the control unit 100, which is an example of a controller (see FIG. 2). In particular, in the present embodiment, this is achieved by the CPU executing a program stored in a ROM. Also, this program is constituted by code for performing the various operations described below.

When the power of the printer 10 is turned on (Step s102), the control unit 100 carries out the adjustment pattern forming operation. In the present embodiment, the adjustment pattern is formed in each color, so that the control unit 100 first forms the adjustment pattern of the first color (the yellow adjustment pattern) on the intermediate transfer belt 70 (Step s104). Here, the tone patch P shown in FIG. 22 is formed on the intermediate transfer belt 70 as the adjustment pattern.

The following is an explanation of this tone patch P. The tone patch P is a tone adjustment pattern for adjusting the tone of the image formed on the medium. This tone patch P is constituted by toner that has been transferred onto the intermediate transfer belt 70 from the photoconductors 20Y, 20M, 20C and 20K at the primary transfer locations B1, B2, B3 and B4 by supplying the primary transfer bias to the intermediate transfer belt 70 with the voltage supply section 123.

As shown in FIG. 22, the tone patch P is formed on the intermediate transfer belt 70 in such a manner that its longitudinal direction is aligned with the rotation direction of the intermediate transfer belt 70. Moreover, the density of the tone patch P changes gradually along this longitudinal direction. More specifically, the density of the tone patch P increases from one end portion Pa in the longitudinal direction of the tone patch P, which reaches the toner removal location first due to the rotation of the intermediate transfer belt 70, to its other end portion Pb in the longitudinal direction of the tone patch P, which is on the opposite side of the one end portion Pa in the longitudinal direction. Therefore, the density at the one end portion Pa in the longitudinal direction is lowest, whereas the density at the other end portion Pb in the longitudinal direction is highest.

Returning to the flowchart in FIG. 21, the explanation of the adjustment pattern forming operation is continued. The control unit 100 detects the density of the tone patch P with the patch sensor 130 (Step s106). Then, this tone patch P, which has been detected with the patch sensor 130, travels further through the rotation of the intermediate transfer belt 70, and is removed by the intermediate transfer belt cleaning blade 87 (Step s108). That is to say, by abutting against the intermediate transfer belt 70, the intermediate transfer belt cleaning blade 87 removes the toner constituting the tone patch P at the toner removal location C2, after the tone patch P has been detected by the patch sensor 130. It should be noted that the operation of the intermediate transfer belt 70 and the voltage supply section 123 etc. after the formation of the tone patch P of the first color is started up to the removal of the tone patch P with the intermediate transfer belt cleaning blade 87 is explained in detail further below.

Next, the control unit 100 carries out the above-described operation (that is, the Steps s104 to s108) for the second color, the third color, and the fourth color (Steps s110, s112 and s114). Thus, in the printer 10 of the present embodiment, after the tone patch P of one color has been removed with the intermediate transfer belt cleaning blade 87, the tone patch P of the next color is formed on the intermediate transfer belt 70. The tone patches of the second, third and fourth color are the same as the tone patch P of the first color shown in FIG. 22.

Next, the control unit 100 adjusts the tone of the image based on the detection result of the tone patch P detected with the patch sensor 130.

Detailed Operation of Intermediate Transfer Belt 70 and Voltage Supply Section 123 According to the Third Embodiment As noted above, the following two aspects are desired when forming the adjustment pattern on the intermediate transfer belt 70 and removing the toner constituting this adjustment pattern.

Firstly, when the adjustment pattern (adjustment pattern P) is formed, it is desirable that the toner on the photoconductors 20Y, 20M, 20C and 20K is suitably transferred to the intermediate transfer belt 70. The reason for this is that when the toner is not suitably transferred to the intermediate transfer belt 70, the density of the adjustment pattern will not be suitable and the adjustment of the image quality cannot be carried out in a suitable manner.

Secondly, it is desirable that the toner constituting the adjustment pattern formed on the intermediate transfer belt 70 is suitably removed by the intermediate transfer belt cleaning blade 87. For example, when removing the toner with the intermediate transfer belt cleaning blade 87, if the primary transfer bias for letting the toner advance to the intermediate transfer belt 70 is supplied to the intermediate transfer belt 70, then the toner constituting the adjustment pattern is attracted to the intermediate transfer belt 70. In this situation, there is the risk that the toner is not suitably removed by the intermediate transfer belt cleaning blade 87, and remains on the intermediate transfer belt 70.

Accordingly, the following controls are carried out by the printer 10 according to the present embodiment during the adjustment pattern forming operation, in order to achieve the above-noted two requirements. That is, the control unit 100 causes the supply of the primary transfer bias with the voltage supply section 123 (primary transfer bias supply section 123*a*) until the toner constituting the adjustment pattern (tone patch P) has moved and has reached the primary transfer location due to the rotation of the photoconductors 20Y, 20M, 20C and 20K. Then, the control unit 100 stops the supply of the primary transfer bias with the primary transfer bias supply section 123*a* after the toner constituting the adjustment pattern has reached the primary transfer location and before the toner has moved and has reached the toner removal location C2 due to the rotation of the intermediate transfer belt 70. Thus, the adjustment pattern on the intermediate transfer belt 70 is suitably formed and the toner constituting the adjustment pattern is suitably removed by the intermediate transfer belt cleaning blade 87.

The details of this control is explained with four working examples. In these working examples, tone patches P of four colors are formed, but the tone patches P of these four colors are the same (see FIG. 22). Moreover, also the operations of the intermediate transfer belt 70 and the voltage supply section 123 when forming the tone patches P of these colors are the same. Accordingly, in the working examples explained in the following, the detailed operation of the intermediate transfer belt 70 and the voltage supply section 123 is explained from the start of the formation of the tone patch P of the first of those four colors (yellow) up to the removal of this tone patch P.

First Working Example According to the Third Embodiment

Figure 23:
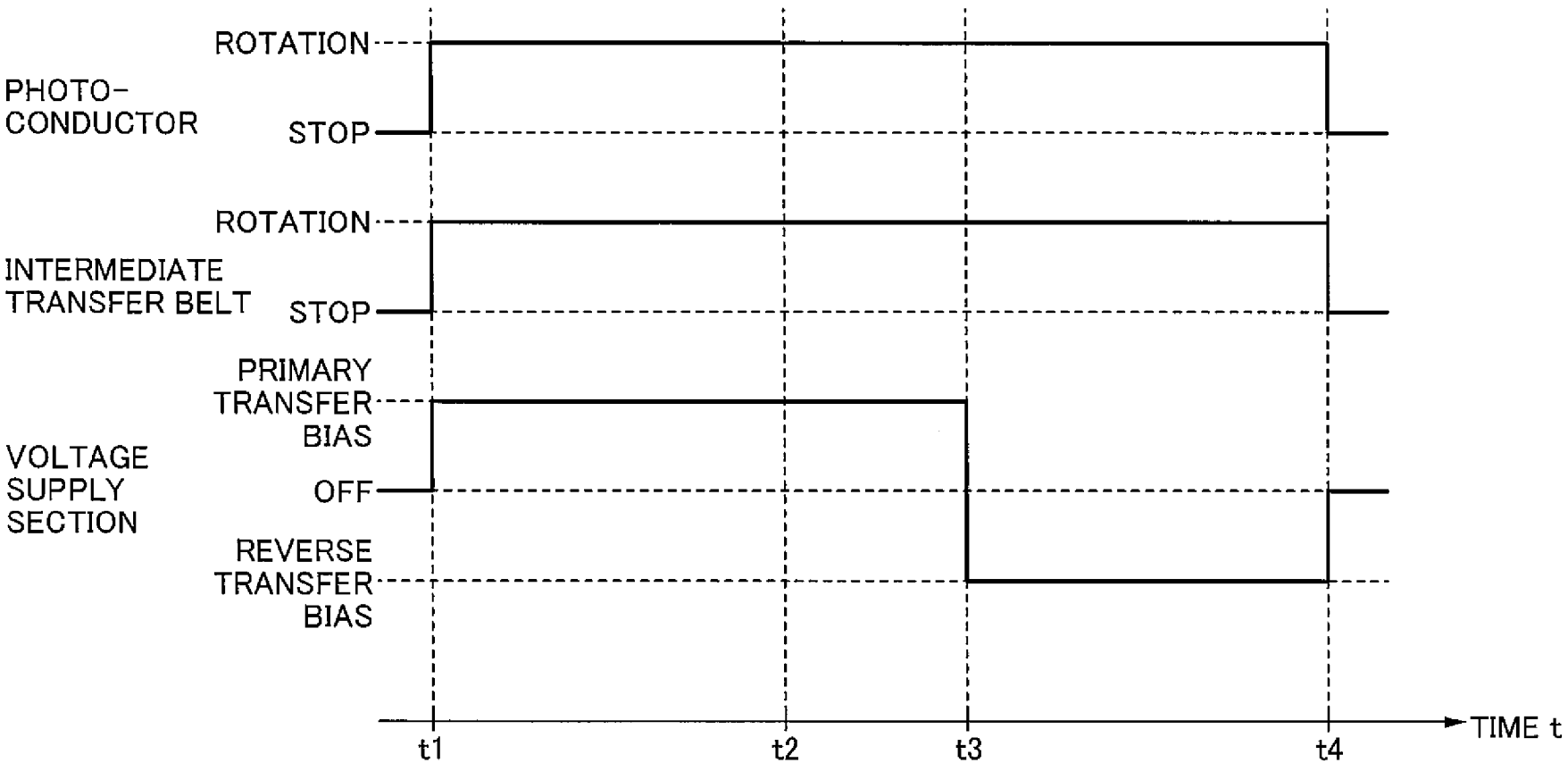
FIG. 23 is a timing chart illustrating a first working example of the third embodiment.
Figure 24A:
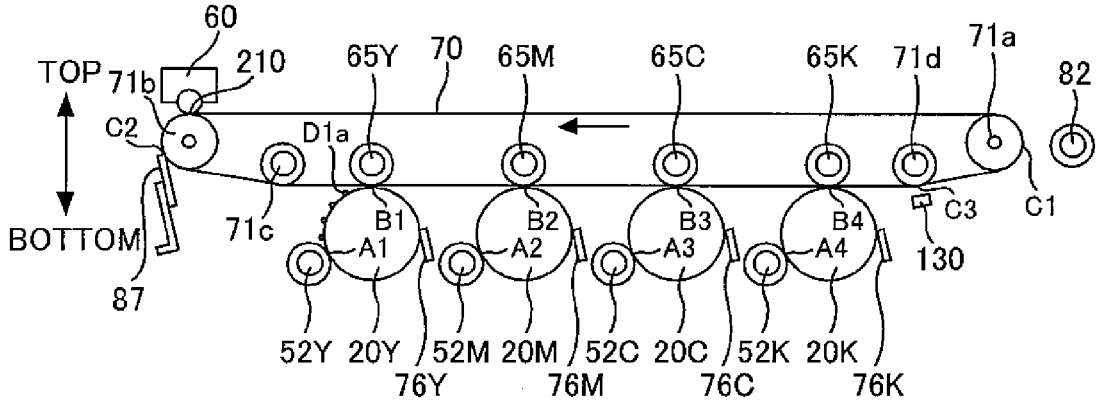
FIG. 24A is a diagram showing the state of the toner at the time t1 in FIG. 23.
Figure 24B:
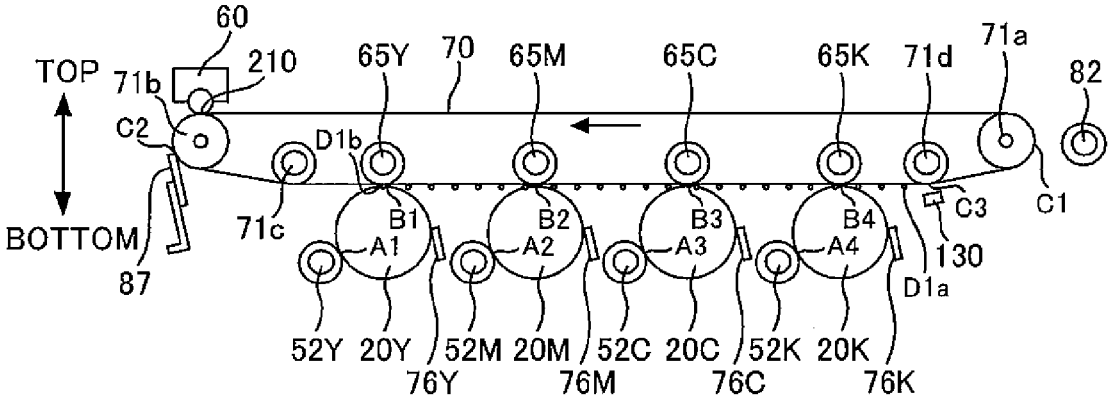
FIG. 24B is a diagram showing the state of the toner at the time t2 in FIG. 23.
Figure 24C:
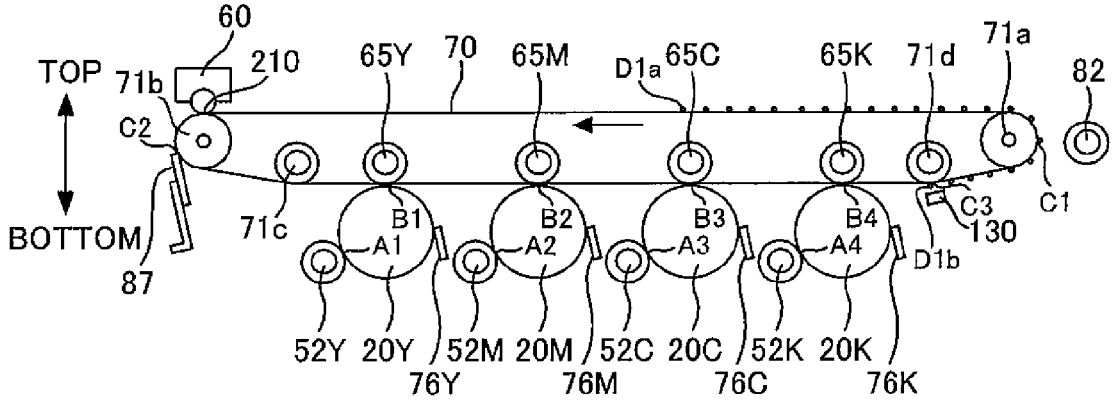
FIG. 24C is a diagram showing the state of the toner at the time t3 in FIG. 23.

The first working example is explained first with reference to FIGS. 23 and 24A to 24C. FIG. 23 is a timing chart illustrating the first working example. FIGS. 24A to 24C are diagrammatic views illustrating the state of the toner on the photoconductor 20Y and on the intermediate transfer belt 70. FIG. 24A shows the state of the toner at the time t1 in FIG. 23, FIG. 24B shows the state of the toner at the time t2 in FIG. 23, and FIG. 24C shows the state of the toner at the time t3 in FIG. 23. It should be noted that the white circles (O) shown in FIGS. 24A to 24C represent the toner constituting the tone patch P.

In this working example, the adjustment pattern forming operation is started at the time t1. Moreover, the control unit 100 causes the photoconductor 20Y and the intermediate transfer belt 70 to rotate at the time t1. And at the time t1, the control unit 100 causes the charging unit 30Y, the exposing unit 40Y, and the developing unit 50Y to operate. Thus, a latent image is formed on the photoconductor 20Y, and by developing this latent image with the developing roller 52Y, toner is borne on the photoconductor 20Y, as shown in FIG. 24A. This toner is the toner constituting the tone patch P formed on the intermediate transfer belt 70. On the other hand, at the time t1, the control unit 100 causes the photoconductors 20M, 20C and 20K to operate, but it does not cause the charging units 30M, 30C and 30K, the exposing units 40M, 40C and 40K or the developing units 50M, 50C and 50K to operate. Therefore, no latent images or toner images are formed on the photoconductors 20M, 20C and 20K (see FIGS. 24A and 24B).

At the time t1, the control unit 100 causes the supply of the primary transfer bias with the primary transfer bias supply section 123*a* of the voltage supply section 123. Then, the control unit 100 causes the supply of the primary transfer bias with the primary transfer bias supply section 123*a* until the toner constituting the adjustment patch P has moved and has reached the primary transfer location B1 due to the rotation of the photoconductor 20Y. Thus, the toner constituting the tone patch P is transferred by primary transfer to the intermediate transfer belt 70 at the primary transfer location B1, and a tone patch P of a first color is formed on the intermediate transfer belt 70 (see FIG. 22).

In this embodiment, the toner D1*b* constituting the other end portion Pb in the longitudinal direction of the tone patch P reaches the primary transfer location B1 at the time t2 (see FIG. 24B) and is transferred by primary transfer to the intermediate transfer belt 70. Consequently, the control unit 100 continues to supply the primary transfer bias from the time t1 to the time t2.

The intermediate transfer belt 70 continues to rotate from the time t1 to the time t2. Consequently, also the toner that has been transferred by primary transfer to the intermediate transfer belt 70 at the primary transfer location B1 (the toner constituting the tone patch P) is moved due to this rotation of the intermediate transfer belt 70. The intermediate transfer belt 70 continues to rotate even after the time t2, and the toner that has reached the sensor detection location C3 due to this rotation is detected with the patch sensor 130.

Then, after the toner D1*b* constituting the other end portion Pb in the longitudinal direction of the tone patch P has reached the primary transfer location B4 corresponding to the photoconductor 20K due to further rotation of the intermediate transfer belt 70 (see FIG. 24C), the control unit 100 stops the supply of the primary transfer bias with the primary transfer bias supply section 123*a* that has continued until then. In the present working example, at the time t3, which is the time when the toner D1*b* reaches the sensor detection location C3, the control unit 100 stops the supply of the primary transfer bias that has continued up to that time.

The control unit 100 causes the supply of the reverse transfer bias with the reverse transfer bias supply section 123*b* at the time t3. Moreover, until the intermediate transfer belt 70 has rotated about once since the beginning of the adjustment pattern forming operation at the time t1, the control unit 100 continues to supply the reverse transfer bias with the reverse transfer bias supply section 123*b*. It should be noted that while the intermediate transfer belt 70 rotates about once from the time t1, all of the toner constituting the tone patch P is moved to the toner removal location C2 through the rotation of the intermediate transfer belt 70. Therefore, until the toner constituting the tone patch P has moved and has reached the toner removal location C2 due to the rotation of the intermediate transfer belt 70, the control unit 100 maintains the stop of the supply of the primary transfer bias with the voltage supply section 123.

Then, while supplying the reverse transfer bias with the reverse transfer bias supply section 123*b*, all of the toner constituting the tone patch P is removed by the intermediate transfer belt cleaning blade 87. Here, as mentioned above, the toner constituting the tone patch P is toner that is charged negatively, and the reverse transfer bias supplied to the intermediate transfer belt 70 is a voltage of the same polarity as the charge polarity of that toner. Therefore, a force attempting to separate the toner at the toner removal location C2 from the intermediate transfer belt 70 acts on that toner. Therefore, the toner constituting the tone patch P is suitably removed by the intermediate transfer belt cleaning blade 87.

It should be noted that in the present working example, the polarities of the reverse transfer bias and the primary transfer bias are different, but the absolute values of the magnitude of the biases are the same. More specifically, the magnitude of the primary transfer bias is −250 V and the magnitude of the reverse transfer bias is 250 V. However, the magnitudes of the reverse transfer bias and the primary transfer bias are not limited to this, and it is also possible to set them such that the absolute value of the magnitude of the reverse transfer bias is smaller than the absolute value of the magnitude of the primary transfer bias. For example, the magnitude of the primary transfer bias can be 250 V and the magnitude of the reverse transfer bias can be −50 V.

Next, the control unit 100 stops the supply of the reverse transfer bias with the reverse transfer bias supply section 123*b* at the time t4. Moreover, the control unit 100 stops the rotation of the photoconductor 20Y and the intermediate transfer belt 70 at the time t4. Here, the time t4 corresponds to the time at which the intermediate transfer belt 70 has rotated once after the time t1. However, there is no limitation to this, and it is also possible that the time t4 corresponds to the time at which the intermediate transfer belt 70 has rotated twice after the time t1.

Second Working Example According to the Third Embodiment

Figure 25:
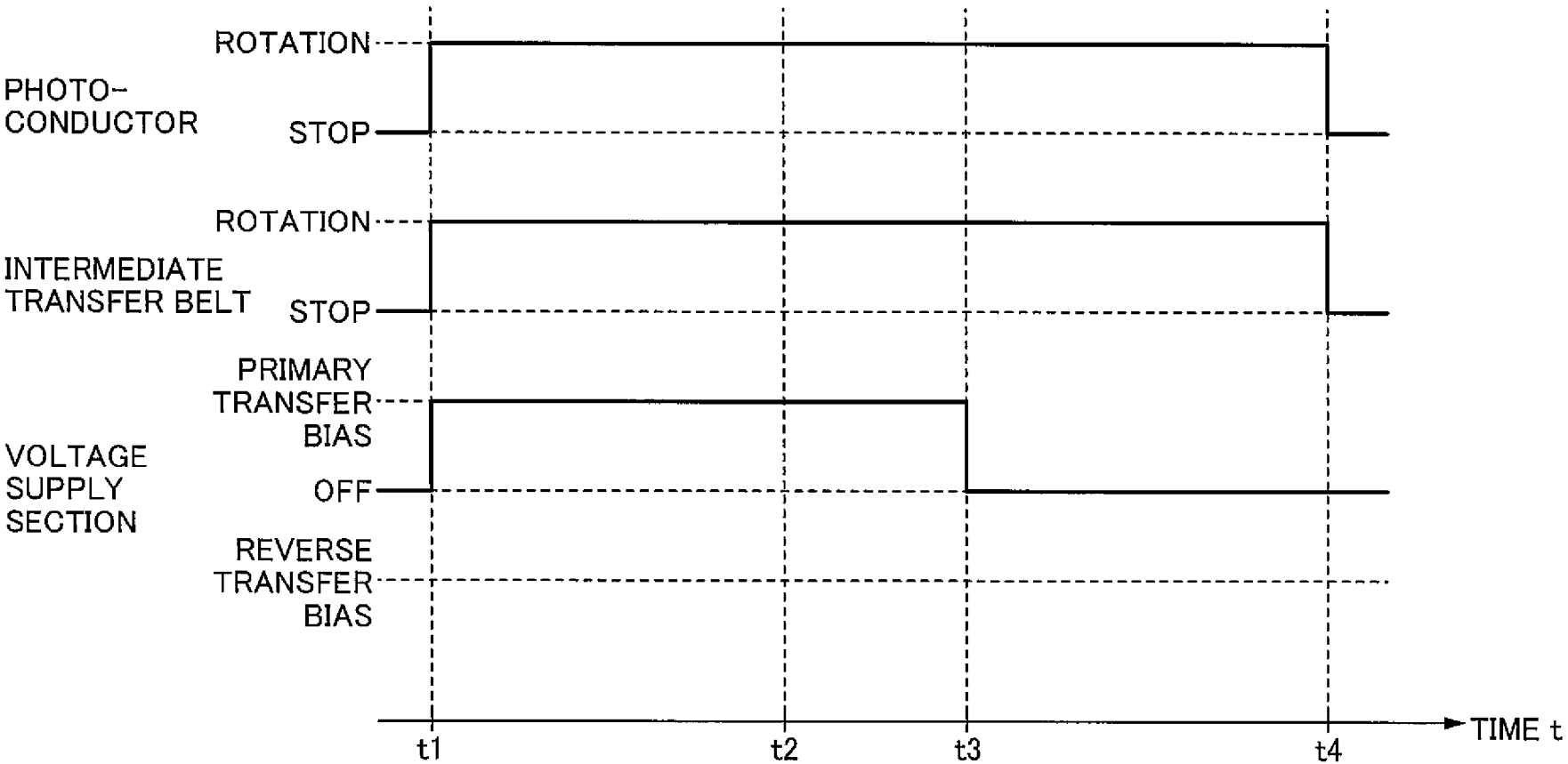
FIG. 25 is a timing chart illustrating a second working example of the third embodiment.

Next, the second working example is explained with reference to FIGS. 24A to 24C and 25. FIG. 25 is a timing chart illustrating the second working example. It should be noted that the times t1 to t4 in FIG. 25 represent the same times as the times t1 to t4 in FIG. 23.

Also in the second working example, the control unit 100 starts the adjustment pattern forming operation at the time t1. Moreover, the printer 10 carries out the same operation as in the first working example from the start of the adjustment pattern forming operation until immediately prior to the time t3.

That is, by supplying the primary transfer bias with the primary transfer bias supply section 123*a* from the time t1 to immediately prior to the time t3, the toner constituting the tone patch P is transferred by primary transfer from the photoconductor 20Y to the intermediate transfer belt 70 at the primary transfer location B1. Thus, the same tone patch P as the tone patch P of the first working example (see FIG. 22) is formed on the intermediate transfer belt 70. Moreover, the toner constituting the tone patch P on the intermediate transfer belt 70 travels to the sensor detection location C3 through the rotation of the intermediate transfer belt 70, and is detected with the patch sensor 130.

On the other hand, the operation of the printer 10 from the time t3 onward differs from the operation of the first working example. Accordingly, the following is an explanation of the operation of the printer 10 from the time t3 onward.

First of all, different to the first working example, the control unit 100 does not cause the supply of the primary transfer bias with the primary transfer bias supply section 123*a* and does not cause the supply of the reverse transfer bias with the reverse transfer bias supply section 123*b* at the time t3. That is to say, the voltage supply section 123 does not supply any voltage to the intermediate transfer belt 70. Moreover, the voltage supply section 123 does not supply any voltage to the intermediate transfer belt 70 from the start of the adjustment pattern forming operation at the time t1 until the intermediate transfer belt 70 has rotated about once.

Moreover, while no voltage is supplied by the voltage supply section 123, all of the toner constituting the tone patch P is removed by the intermediate transfer belt cleaning blade 87. Here, the voltage (primary transfer bias) from the voltage supply section 123 is not supplied to the intermediate transfer belt 70, so that no force attracting the toner at the toner removal location C2 to the intermediate transfer belt 70 acts on that toner. Therefore, the toner constituting the tone patch P is suitably removed by the intermediate transfer belt cleaning blade 87.

Then, at the time t4, after the toner constituting the tone patch P has been removed by the intermediate transfer belt cleaning blade 87, the control unit 100 stops the photoconductors 20Y, 20M, 20C and 20K and the intermediate transfer belt 70. It should be noted that, as in the first working example, the time t4 corresponds to the time at which the intermediate transfer belt 70 has rotated once after the time t1.

Third Working Example According to the Third Embodiment

Figure 26:
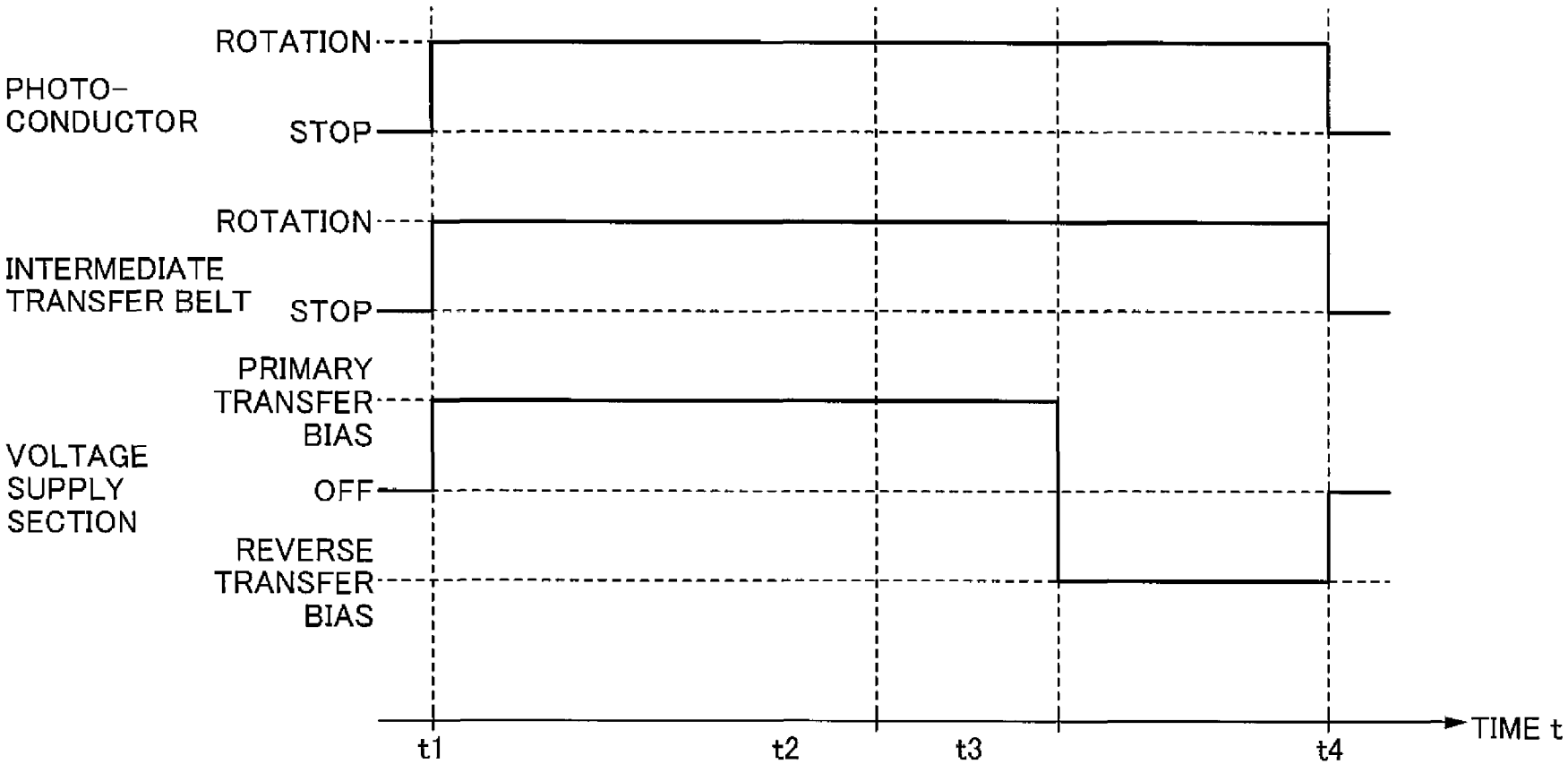
FIG. 26 is a timing chart illustrating a third working example of the third embodiment.
Figure 27A:
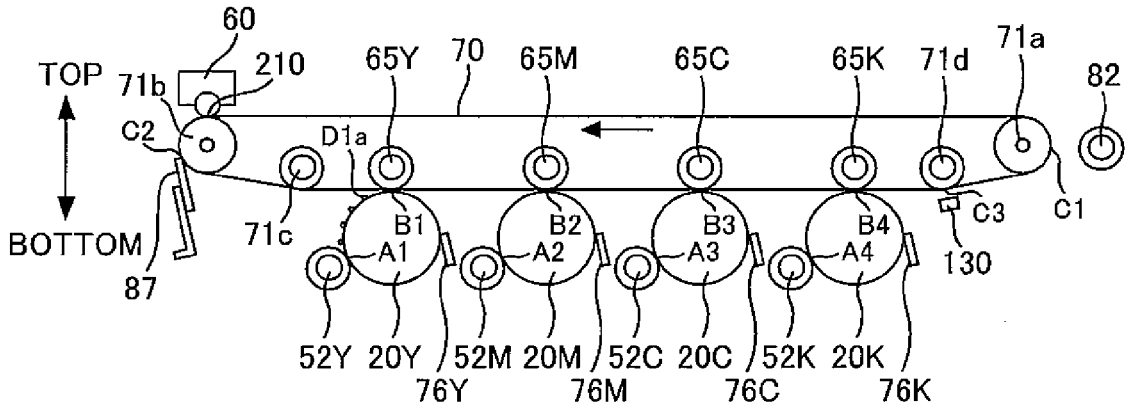
FIG. 27A is a diagram showing the state of the toner at the time t1 in FIG. 26.
Figure 27B:
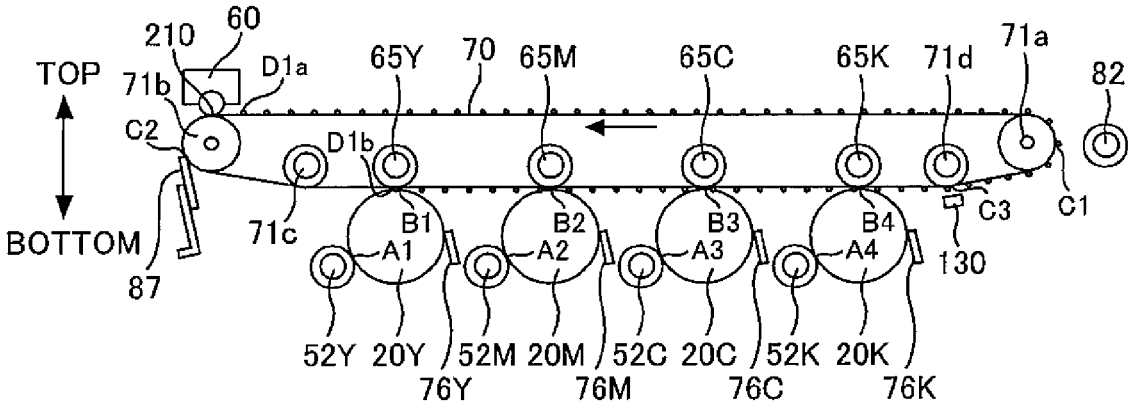
FIG. 27B is a diagram showing the state of the toner at the time t2 in FIG. 26.
Figure 27C:
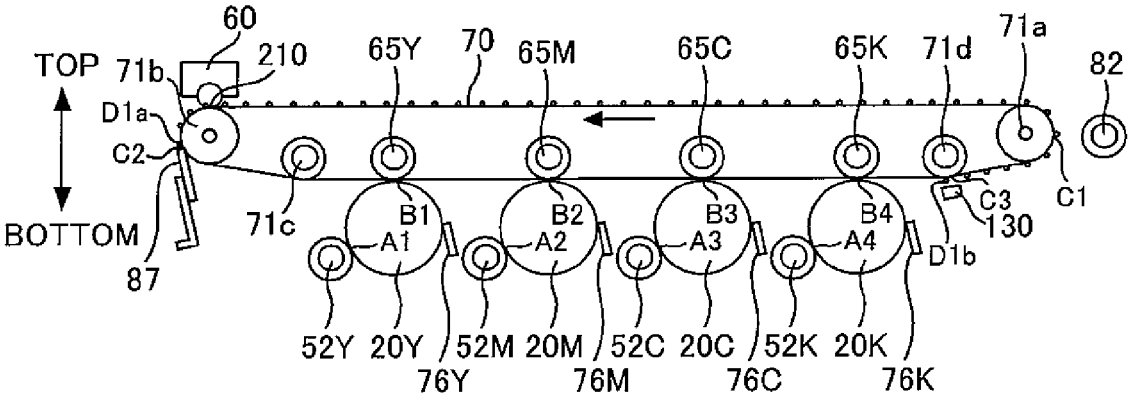
FIG. 27C is a diagram showing the state of the toner at the time t3 in FIG. 26.

Next, the third working example is explained with reference to FIGS. 26 and 27A to 27C. FIG. 26 is a timing chart illustrating the third working example. FIGS. 27A to 27C are diagrammatic views illustrating the state of the toner on the photoconductor 20Y and on the intermediate transfer belt 70.

FIG. 27A shows the state of the toner at the time t1 in FIG. 26, FIG. 27B shows the state of the toner at the time t2 in FIG. 26, and FIG. 27C shows the state of the toner at the time t3 in FIG. 26. It should be noted that the white circles (O) shown in FIGS. 27A to 27C represent the toner constituting the tone patch P.

Here, the tone patch P of the third working example differs from the tone patch P of the first working example and the second working example. That is to say, as can be seen by comparing FIG. 24B and FIG. 27B, the length of the tone patch P of the third working example in the rotation direction of the intermediate transfer belt 70 (as shown in FIG. 22, this is the length L between the one end portion Pa in the longitudinal direction and the other end portion Pb in the longitudinal direction) is larger than the length of the tone patch P of the first working example and the second working example in the rotation direction. Also the control of the voltage supply section 123 and the like according to the third working example differs from the control of the first working example.

Also in the third working example, the control unit 100 starts the adjustment pattern forming operation at the time t1. More specifically, the control unit 100 causes the photoconductor 20Y and the intermediate transfer belt 70 to rotate at the time t1. And at the time t1, the control unit 100 causes the charging unit 30Y, the exposing unit 40Y and the developing unit 50Y to operate. Thus, a latent image is formed on the photoconductor 20Y, and by developing this latent image with the developing roller 52Y, toner is borne on the photoconductor 20Y, as shown in FIG. 27A. This toner is the toner constituting the tone patch P formed on the intermediate transfer belt 70. On the other hand, at the time t1, the control unit 100 causes the photoconductors 20M, 20C and 20K to operate, but it does not cause the charging units 30M, 30C and 30K, the exposing units 40M, 40C and 40K or the developing units 50M, 50C and 50K to operate. Therefore, no latent images or toner images are formed on the photoconductors 20M, 20C and 20K (see FIGS. 27A and 27B).

At the time t1, the control unit 100 causes the supply of the primary transfer bias with the primary transfer bias supply section 123*a* of the voltage supply section 123. Then, the control unit 100 supplies the primary transfer bias with the primary transfer bias supply section 123*a* until the toner constituting the tone patch P has moved and has reached the primary transfer location B1 due to the rotation of the photoconductor 20Y. Thus, the toner constituting the tone patch P is transferred by primary transfer to the intermediate transfer belt 70 at the primary transfer location E1, and a tone patch P is formed on the intermediate transfer belt 70.

In the present embodiment, the toner D1*b* constituting the other end portion Pb in the longitudinal direction of the tone patch P reaches the primary transfer location B1 at the time t2 (see FIG. 27B) and is transferred by primary transfer to the intermediate transfer belt 70. Consequently, the control unit 100 continues to supply the primary transfer bias from the time t1 to the time t2.

Now, as mentioned above, the length L of the tone patch P according to this working example in the rotation direction is larger than the length L of the tone patches P according to the first working example and the second working example in the rotation direction, so that the period from the time t1 to the time t2 in the present working example is longer than the period from the time t1 to the time t2 in the first working example and the second working example.

The intermediate transfer belt 70 continues to rotate from the time t1 to the time t2. Consequently, also the toner that has been transferred by primary transfer to the intermediate transfer belt 70 at the primary transfer location B1 (the toner constituting the tone patch P) is moved due to this rotation of the intermediate transfer belt 70. The toner that reaches the sensor detection location C3 due to the rotation of the intermediate transfer belt 70 from the time t1 to the time t2 is detected with the patch sensor 130.

The intermediate transfer belt 70 continues to rotate even after the time t2. Then, as the intermediate transfer belt 70 is rotated, the toner constituting the tone patch P moves and reaches the toner removal location C2, and is removed with the intermediate transfer belt cleaning blade 87. As mentioned above, the density of the tone patch P at the one end portion Pa side in the longitudinal direction is lower than the density at the other end portion Pb side in the longitudinal direction, so that the amount of toner at the one end portion Pa side in the longitudinal direction of the tone patch P is lower (see FIG. 22). Therefore, even if the primary transfer bias is supplied to the intermediate transfer belt 70 when removing the toner, the toner constituting the one end portion Pa side in the longitudinal direction is suitably removed by the intermediate transfer belt cleaning blade 87.

After the toner D1*b* constituting the other end portion Pb in the longitudinal direction of the tone patch P has reached the primary transfer location B4 corresponding to the photoconductor 20K due to further rotation of the intermediate transfer belt 70, the control unit 100 stops the supply of the primary transfer bias with the primary transfer bias supply section 123*a* that has continued until then. In the present working example, at the time t3, which is the time when the toner D1*b* reaches the sensor detection location C3, the control unit 100 stops the supply of the primary transfer bias that has continued up to that time.

The control unit 100 causes the supply of the reverse transfer bias with the reverse transfer bias supply section 123*b* at the time t3. Moreover, until the intermediate transfer belt 70 has rotated about once since the beginning of the adjustment pattern forming operation at the time t1, the control unit 100 continues to supply the reverse transfer bias with the reverse transfer bias supply section 123*b*. It should be noted that while the intermediate transfer belt 70 rotates about once from the time t1, all of the toner constituting the tone patch P reaches the toner removal location C2 due to the rotation of the intermediate transfer belt 70. Therefore, until the toner constituting the tone patch P has reached the toner removal location C2 due to the rotation of the intermediate transfer belt 70, the control unit 100 maintains the stop of the supply of the primary transfer bias with the voltage supply section 123.

Then, while supplying the reverse transfer bias with the reverse transfer bias supply section 123*b*, the toner constituting the tone patch P (more specifically, the toner constituting the other end portion Pb side in the longitudinal direction) is removed with the intermediate transfer belt cleaning blade 87. Here, as mentioned above, the toner constituting the tone patch P is toner that is charged negatively, and the reverse transfer bias supplied to the intermediate transfer belt 70 is a voltage of the same polarity as the charge polarity of that toner. Therefore, a force attempting to separate the toner at the toner removal location C2 from the intermediate transfer belt 70 acts on that toner. Therefore, the toner constituting the tone patch P is suitably removed by the intermediate transfer belt cleaning blade 87.

Next, the control unit 100 stops the supply of the reverse transfer bias with the reverse transfer bias supply section 123*b* at the time t4. Moreover, the control unit 100 stops the rotation of the photoconductor 20Y and the intermediate transfer belt 70 at the time t4. Here, the time t4 corresponds to the time at which the intermediate transfer belt 70 has rotated once after the time t1. However, there is no limitation to this, and it is also possible that the time t4 corresponds to the time at which the intermediate transfer belt 70 has rotated twice after the time t1, for example.

Fourth Working Example According to the Third Embodiment

Figure 28:
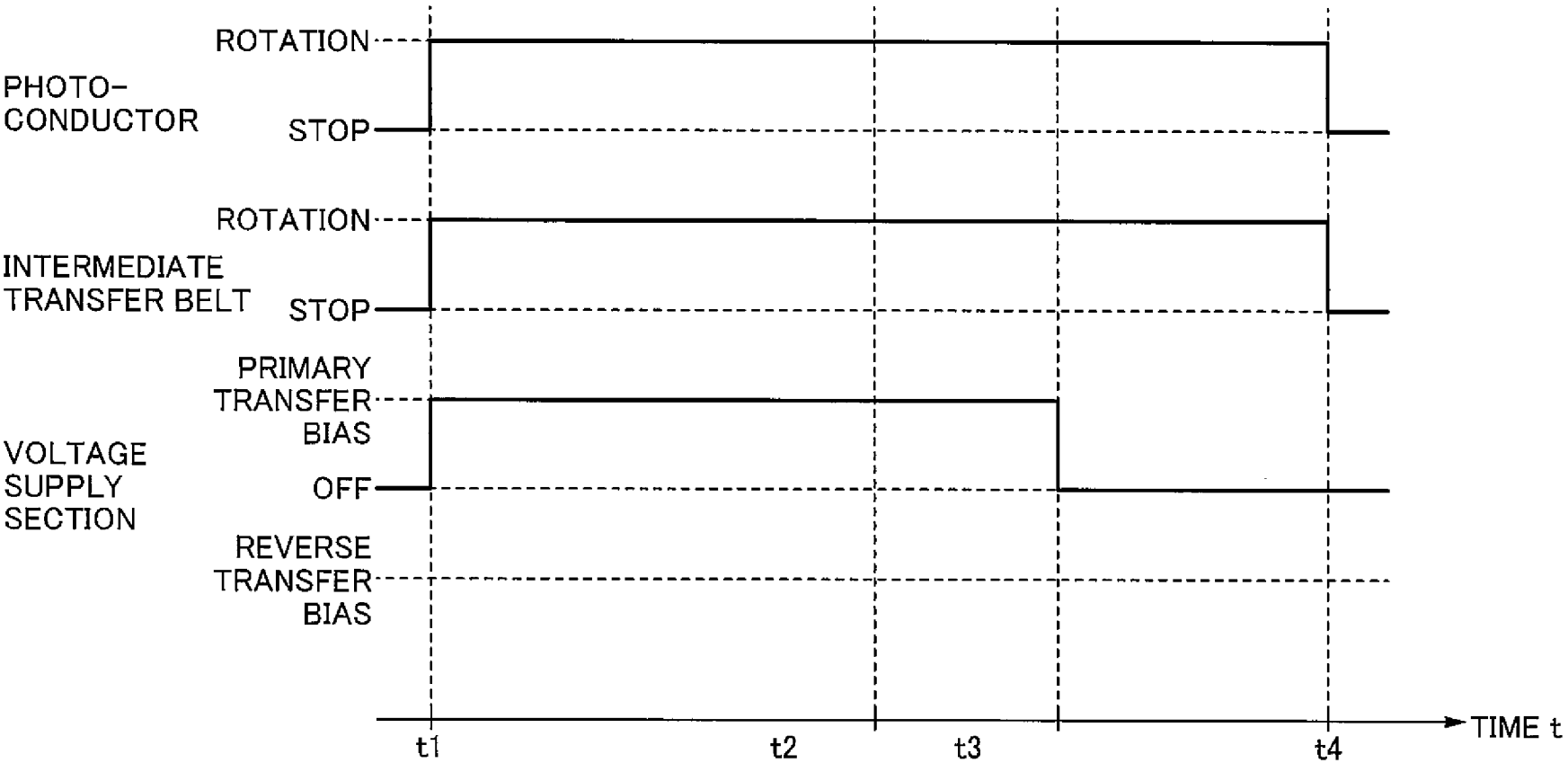
FIG. 28 is a timing chart illustrating a fourth working example of the third embodiment.

Next, the fourth working example is explained with reference to FIGS. 27A to 27C and 28. FIG. 28 is a timing chart illustrating the fourth working example. It should be noted that the times t1 to t4 in FIG. 28 represent the same times as the times t1 to t4 in FIG. 26.

Also in the fourth working example, the control unit 100 starts the adjustment pattern forming operation at the time t1. Moreover, the printer 10 carries out the same operation as in the third working example from the start of the adjustment pattern forming operation until immediately prior to the time t3.

That is, by supplying the primary transfer bias with the primary transfer bias supply section 123*a* from the time t1 to immediately prior to the time t3, the toner constituting the tone patch P is transferred by primary transfer from the photoconductor 20Y to the intermediate transfer belt 70 at the primary transfer location B1. Thus, the same tone patch P as the tone patch P of the third working example is formed on the intermediate transfer belt 70. Moreover, the toner constituting the tone patch P on the intermediate transfer belt 70 travels to the sensor detection location C3 through the rotation of the intermediate transfer belt 70, and is detected with the patch sensor 130. Furthermore, as the intermediate transfer belt 70 is rotated, the toner constituting the one end portion Pa side in the longitudinal direction of the tone patch P moves and reaches the toner removal location C2, and is removed by the intermediate transfer belt cleaning blade 87.

On the other hand, the operation of the printer 10 from the time t3 onward differs from the operation of the third working example. Accordingly, the following is an explanation of the operation of the printer 10 from the time t3 onward.

First of all, different to the third working example, the control unit 100 does not cause the supply of the primary transfer bias with the primary transfer bias supply section 123*a* and does not cause the supply of the reverse transfer bias with the reverse transfer bias supply section 123*b* at the time t3. That is to say, the voltage supply section 123 does not supply any voltage to the intermediate transfer belt 70. Moreover, the voltage supply section 123 does not supply any voltage to the intermediate transfer belt 70 from the start of the adjustment pattern forming operation at the time t1 until the intermediate transfer belt 70 has rotated about once.

Then, while no voltage is supplied with the voltage supply section 123, the toner constituting the tone patch P (more specifically, the toner constituting the other end portion Pb side in the longitudinal direction) is removed by the intermediate transfer belt cleaning blade 87. Here, no voltage (primary transfer bias) is supplied from the voltage supply section 123 to the intermediate transfer belt 70, so that no force attracting the toner at the toner removal location C2 to the intermediate transfer belt 70 acts on that toner. Therefore, the toner constituting the tone patch P is suitably removed by the intermediate transfer belt cleaning blade 87.

Then, at the time t4, after the toner constituting the tone patch P has been removed by the intermediate transfer belt cleaning blade 87, the control unit 100 stops the photoconductors 20Y, 20M, 20C and 20K and the intermediate transfer belt 70. It should be noted that, as in the first working example, the time t4 corresponds to the time at which the intermediate transfer belt 70 has rotated once after the time t1.

Advantageous Effects of the Printer 10 According to the Third Embodiment

As described with the first to fourth working examples above, until the toner (here, this is explained with an example of toner on the photoconductor 20Y) constituting the adjustment pattern (for example a tone patch P) moves and reaches the primary transfer location B1 due to the rotation of the photoconductor 20Y, the controller (control unit 100) of the image forming apparatus (printer 10) according to this embodiment causes the supply of the transfer voltage (primary transfer bias) with the voltage supply section 123 (primary transfer bias supply section 123*a*). Then, the control unit 100 stops the supply of the primary transfer bias with the voltage supply section 123 after all of the toner constituting the adjustment pattern has reached the primary transfer location B1 and before the toner has reached the toner removal location C2 due to the rotation of the intermediate transfer belt 70.

If the control unit 100 causes the supply of the primary transfer bias in this manner until the toner constituting the tone patch P (the toner on the photoconductor 20Y) moves and reaches the primary transfer location B1 due to the rotation of the photoconductor 20Y, then the toner on the photoconductor 20Y is reliably transferred to the intermediate transfer belt 70 at the primary transfer location B1, so that the tone patch P is suitably formed on the intermediate transfer belt 70.

Figure 29A:
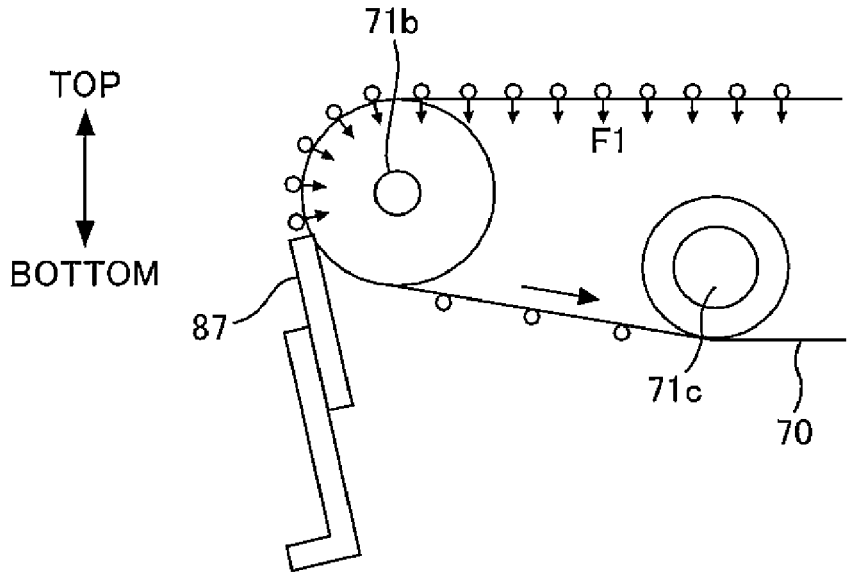
FIG. 29A is a diagram illustrating a comparative example according to the third embodiment.

Moreover, if the control unit 100 stops the supply of the primary transfer bias after the toner constituting the tone patch P (the toner on the photoconductor 20Y) has reached the primary transfer location B1 and before this toner moves and reaches the toner removal location C2 due to the rotation of the intermediate transfer belt 70, then a force F1 attracting the toner that reaches the toner removal location C2 to the intermediate transfer belt 70, as shown in FIG. 29A, is not effected. Therefore, the toner constituting the tone patch P is suitably removed by the intermediate transfer belt cleaning blade 87. Here, this force F1 is a force acting on the toner when the primary transfer bias, which is a voltage of the opposite polarity as the charge polarity of the toner constituting the tone patch P, is supplied to the intermediate transfer belt 70. It should be noted that FIG. 29A is a diagram illustrating a comparative example, and in FIG. 29A, the primary transfer unit 60 is not depicted for illustrative reasons (the same is true for FIG. 29B explained below).

Thus, with the printer 10 according to the present embodiment, the tone patch P on the intermediate transfer belt 70 is suitably formed, and the toner constituting this tone patch P is suitably removed by the intermediate transfer belt cleaning blade 87.

Figure 29B:
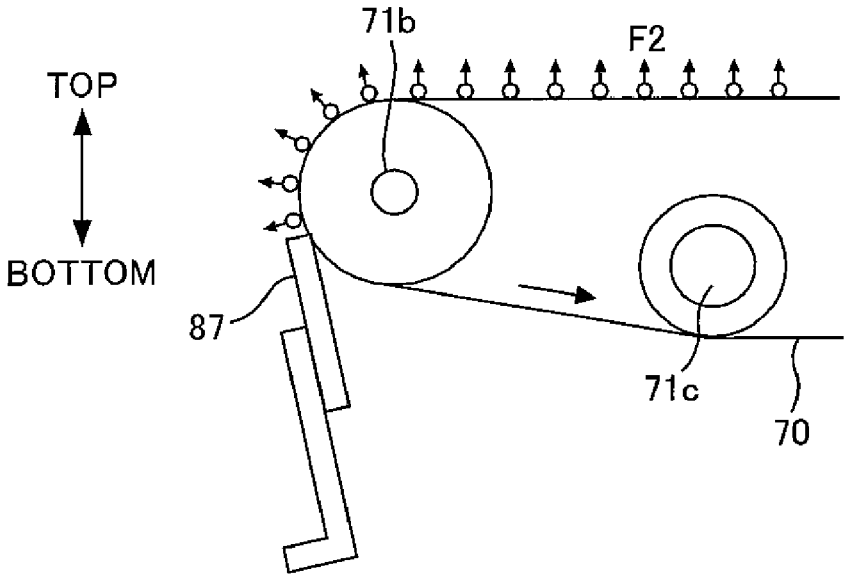
FIG. 29B illustrates the advantageous effect of the printer 10 according to the third embodiment.

In the first working example and in the third working example, the control unit 100 stops the supply of the primary transfer bias with the primary transfer bias supply section 123*a* of the voltage supply section 123 and causes the supply of the reverse transfer bias with the reverse transfer bias supply section 123*b* after the toner constituting the adjustment pattern (tone patch P) has reached the primary transfer location and before this toner reaches the toner removal location C2 due to the rotation of the intermediate transfer belt 70, so that the following effects are achieved. If the reverse transfer bias, which is a voltage of the same polarity as the charge polarity of the toner constituting the tone patch P, is supplied to the intermediate transfer belt 70, then a force F2 repelling this toner at the toner removal location C2 from the intermediate transfer belt 70 is effected, as shown in FIG. 29B. Therefore, the toner constituting the tone patch P is easily removed with the intermediate transfer belt cleaning blade 87. It should be noted that FIG. 29B illustrates the advantageous effect of the printer 10 according to this embodiment.

Other Working Examples According to the Third Embodiment

In the foregoing, an image forming apparatus according to the invention was explained based on the third embodiment, but the above-described embodiments of the invention are merely to facilitate the understanding of the invention, and are in no way meant to limit the invention. The invention can of course be altered and improved without departing from the gist thereof and equivalents are intended to be embraced therein.

Also, in the foregoing third embodiment, the photoconductor, which is an image bearing member, was explained as having a photoconductive layer on the outer circumferential surface of a tubular conductive member, but there is no limitation to this. For example, it may also be a so-called photoconductive belt, in which a photoconductive layer is provided on the surface of a belt-shaped photoconductive member.

According to the third embodiment, the intermediate transfer body was explained to be a belt, but there is no limitation to this, and the intermediate transfer member may also be a drum. Moreover, the removal member was explained to be a blade, but there is no limitation to this, and the removal member may also be a roller or the like.

Furthermore, in the third embodiment, as shown in FIG. 23 and the like for example, the control unit 100 maintains the stop of the supply of the primary transfer bias with the voltage supply section 123 until the toner constituting the tone patch P has moved and has reached the toner removal location C2 due to the rotation of the intermediate transfer belt 70 but there is no limitation to this. For example, it is also possible that the control unit 100 again causes the supply of the primary transfer bias with the voltage supply section 123 immediately before the toner reaches the toner removal location C2.

However, if the control unit 100 maintains the stop of the supply of the primary transfer bias until the toner constituting the tone patch P reaches the toner removal location C2, then the intermediate transfer belt cleaning blade 87 can effectively remove the toner constituting the tone patch P. Consequently, the above-described third embodiment is preferable.

Figure 30:
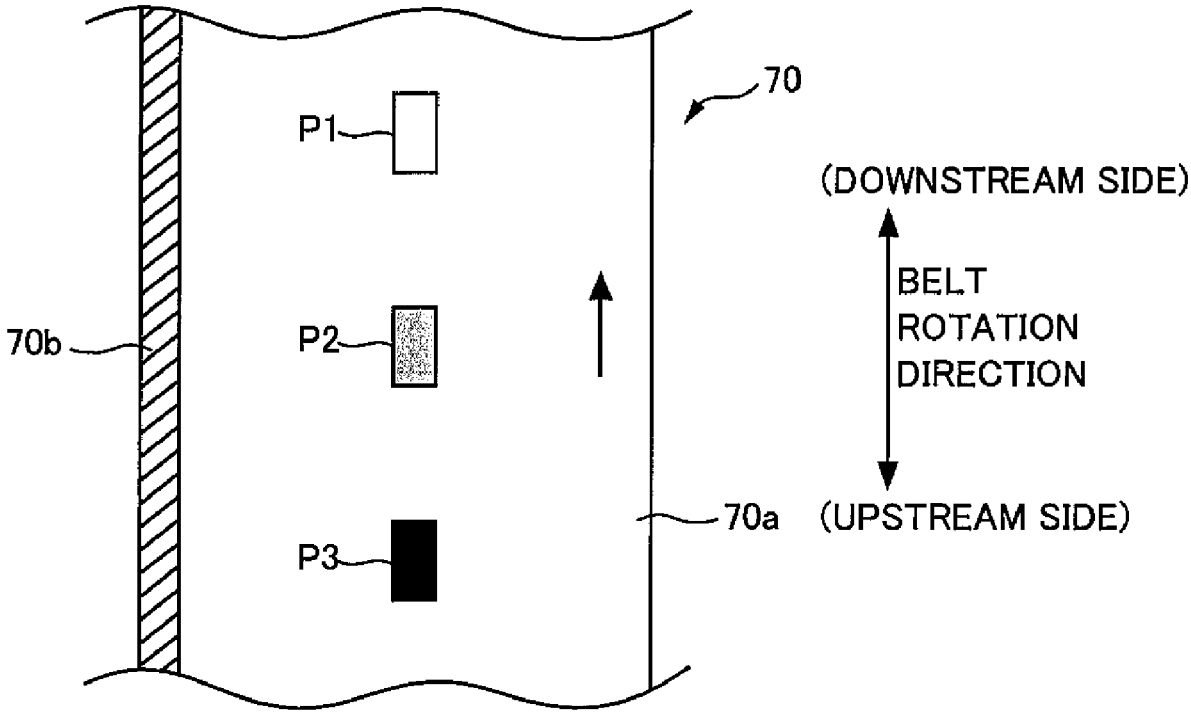
FIG. 30 is a diagrammatic view illustrating another working example of an adjustment pattern according to the third embodiment.

Furthermore, in the third embodiment, as shown in FIG. 22, the adjustment pattern is a tone adjustment pattern (tone patch P) for adjusting the tone of the image, and the longitudinal direction of this tone patch P coincides with the rotation direction of the intermediate transfer belt 70, but there is no limitation to this. For example, as shown in FIG. 30, the adjustment pattern may also be a density adjustment pattern for adjusting the density of the image.

The following is an explanation of such a density adjustment pattern. The tone patch P is one rectangular pattern, as shown in FIG. 22, whereas the density adjustment pattern is a pattern with gaps in the belt rotation direction (longitudinal direction of the pattern), as shown in FIG. 30. More specifically, the density adjustment pattern is constituted by three patches P1, P2 and P3 that are formed at a predetermined spacing. Moreover, the density of the patch P1 of these three patches is lowest and the density of the patch P3 is highest. Moreover, of those three patches, the patch P1 is the first one that reaches the toner removal location C2 and is removed with the intermediate transfer belt cleaning blade 87. FIG. 30 is a diagrammatic view illustrating another working example of an adjustment pattern.

If the adjustment pattern is a tone adjustment pattern (tone patch P), then the amount of toner constituting the tone patch P is higher than if it is a density adjustment pattern. Therefore, the effect of the above-described printer 10, that is, the effect that the toner constituting the adjustment pattern is suitably removed by the intermediate transfer belt cleaning blade 87 is displayed more effectively. Consequently, the above-described third embodiment is preferable.

Furthermore, in the third embodiment, the density of the tone patch P changes gradually along its longitudinal direction, as shown in FIG. 22. And the density at the one end portion Pa in the longitudinal direction of the tone patch P, which moves and reaches the toner removal location C2 first as the intermediate transfer belt 70 rotates, is set to be lowest, and the density of the other end portion Pb in the longitudinal direction of the tone patch P on the opposite side to the one end portion Pa in the longitudinal direction is set to be largest. However, there is no limitation to this. For example, it is also possible to set the density at the one end portion Pa in the longitudinal direction to be highest, and to set the density at the other end portion Pb in the longitudinal direction to be lowest.

If the density at the one end portion Pa in the longitudinal direction is low, that is, if the toner amount constituting the one end portion Pa in the longitudinal direction of the tone patch P is low, then the intermediate transfer belt cleaning blade 87 can suitably remove this toner even if the primary transfer bias is supplied to the intermediate transfer belt 70 while the toner is removed by the intermediate transfer belt cleaning blade 87. And if the density at the other end portion Pb in the longitudinal direction is high, that is, if the toner amount constituting the other end portion Pb in the longitudinal direction of the tone patch P is high, then the intermediate transfer belt cleaning blade 87 can suitably remove this toner by stopping the supply of the primary transfer bias to the intermediate transfer belt 70 while the toner is being removed by the intermediate transfer belt cleaning blade 87. Therefore, in the case of a tone patch P, the effect that the toner constituting the tone patch P is suitably removed with the intermediate transfer belt cleaning blade 87 is displayed more effectively with the above-described configuration. Consequently, the above-described third embodiment is preferable.

Furthermore, in the third embodiment, the voltage supply section 123 (primary transfer bias supply section 123*a*) supplies the primary transfer bias across the entire intermediate transfer belt 70, but there is no limitation to this. For example, it is also possible that the intermediate transfer belt 70 is an annular belt having a joint section of a constant width extending in the perpendicular belt direction (see FIG. 5), and that the primary transfer bias supply section 123*a* does not supply the primary transfer bias at this joint section of the intermediate transfer belt 70 (that is to say, the primary transfer bias supply section 123*a* does not supply the primary transfer bias across the entire intermediate transfer belt 70).

However, if the configuration is such that the primary transfer bias is supplied across the entire intermediate transfer belt 70, then the force attracting the toner at the toner removal location C2 to the intermediate transfer belt 70 (the force F1 shown in FIG. 29A) is constantly effected when the primary transfer bias is supplied to the intermediate transfer belt 70. Therefore, the effect of the above-described printer 10, that is, the effect that the toner constituting the tone pattern P is suitably removed by the intermediate transfer belt cleaning blade 87 is displayed more effectively. Consequently, the above-described third embodiment is preferable.

Furthermore, in the above-described third embodiment, it was explained that the electrode layer 70*b* is provided at the end portion of the intermediate transfer belt 70 in the perpendicular direction perpendicular to the rotation direction of the intermediate transfer belt 70, as shown in FIG. 6. Moreover, it was explained that the printer 10 is provided with a conductive member (electrode roller 210) abutting against this electrode layer 70*b*. Moreover, it was explained that the voltage supply section 123 supplies the primary transfer bias via the electrode roller 210 to the intermediate transfer belt 70. However, there is no limitation to this, and any configuration is possible, as long as the primary transfer bias can be supplied from the voltage supply section 123 to the intermediate transfer belt 70.

Furthermore, in the third embodiment, it was explained that the printer 10 is provided with four photoconductors 20Y, 20M, 20C and 20K capable of bearing toners of different colors (that is, yellow toner, magenta toner, cyan toner and black toner), as shown in FIG. 1. And it was explained that the intermediate transfer belt 70 serves as an intermediate medium when forming an image on the medium by transferring the toner on these respective photoconductors 20Y, 20M, 20C and 20K onto the medium. Furthermore, the adjustment pattern was explained to be formed for each color. However, there is no limitation to this. For example, it is also possible that the printer 10 is provided only with one photoconductor (for example, the photoconductor 20K), in order to form images of a single color.

However, if the printer 10 is provided with four photoconductors 20Y, 20M, 20C and 20K, and the tone patch P is formed for each color on the intermediate transfer belt 70, then the effect of the above-described printer 10, that is, the effect that the tone patch P is suitably formed on the intermediate transfer belt 70 and the toner constituting the tone patch P is suitably removed by the intermediate transfer belt cleaning blade 87 is effectively achieved. Consequently, the above-described third embodiment is preferable.

Configuration of Image Forming System Etc.

Next, an embodiment of an image forming system serving as an example of an embodiment of the invention is described with reference to the drawings.

Figure 31:
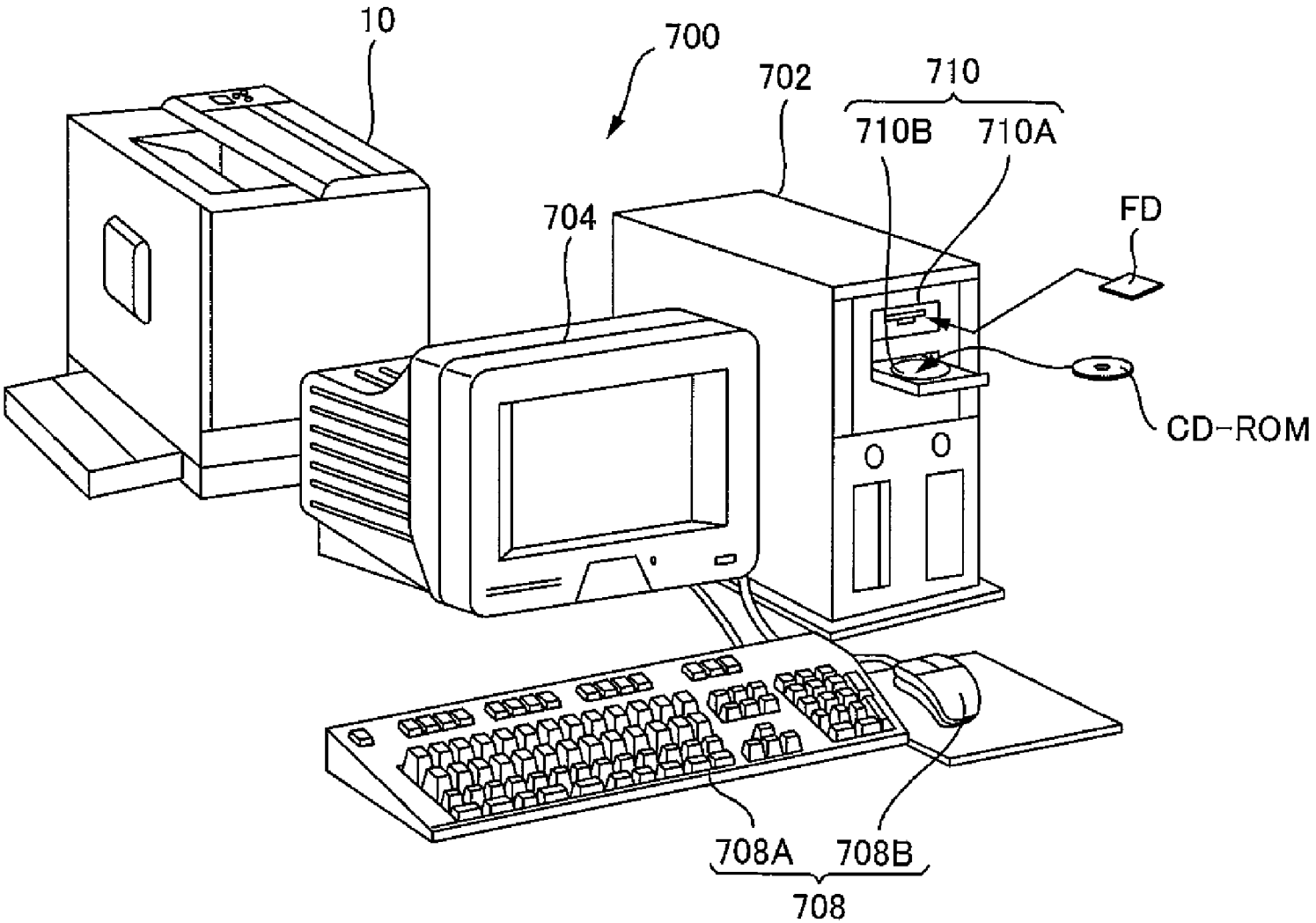
FIG. 31 is an explanatory diagram showing the external configuration of an image forming system.

FIG. 31 is an explanatory diagram showing the external configuration of an image forming system. An image forming system 700 is provided with a computer 702, a display device 704, a printer 10, input devices 708 and reading devices 710.

In this embodiment, the computer 702 is contained within a mini-tower type housing, but there is no limitation to this. A CRT (cathode ray tube), plasma display, or liquid crystal display device, for example, is generally used as the display device 704, but there is no limitation to this. As the printer 10, the printer described above is used. In this embodiment, the input devices 708 are a keyboard 708A and a mouse 708B, but there is no limitation to these. In this embodiment, a flexible disk drive device 710A and a CD-ROM drive device 710B are used as reading devices 710, but the reading device 710 is not limited to these, and they may also be a MO (magnet optical) disk drive device or a DVD (digital versatile disk), for example.

Figure 32:
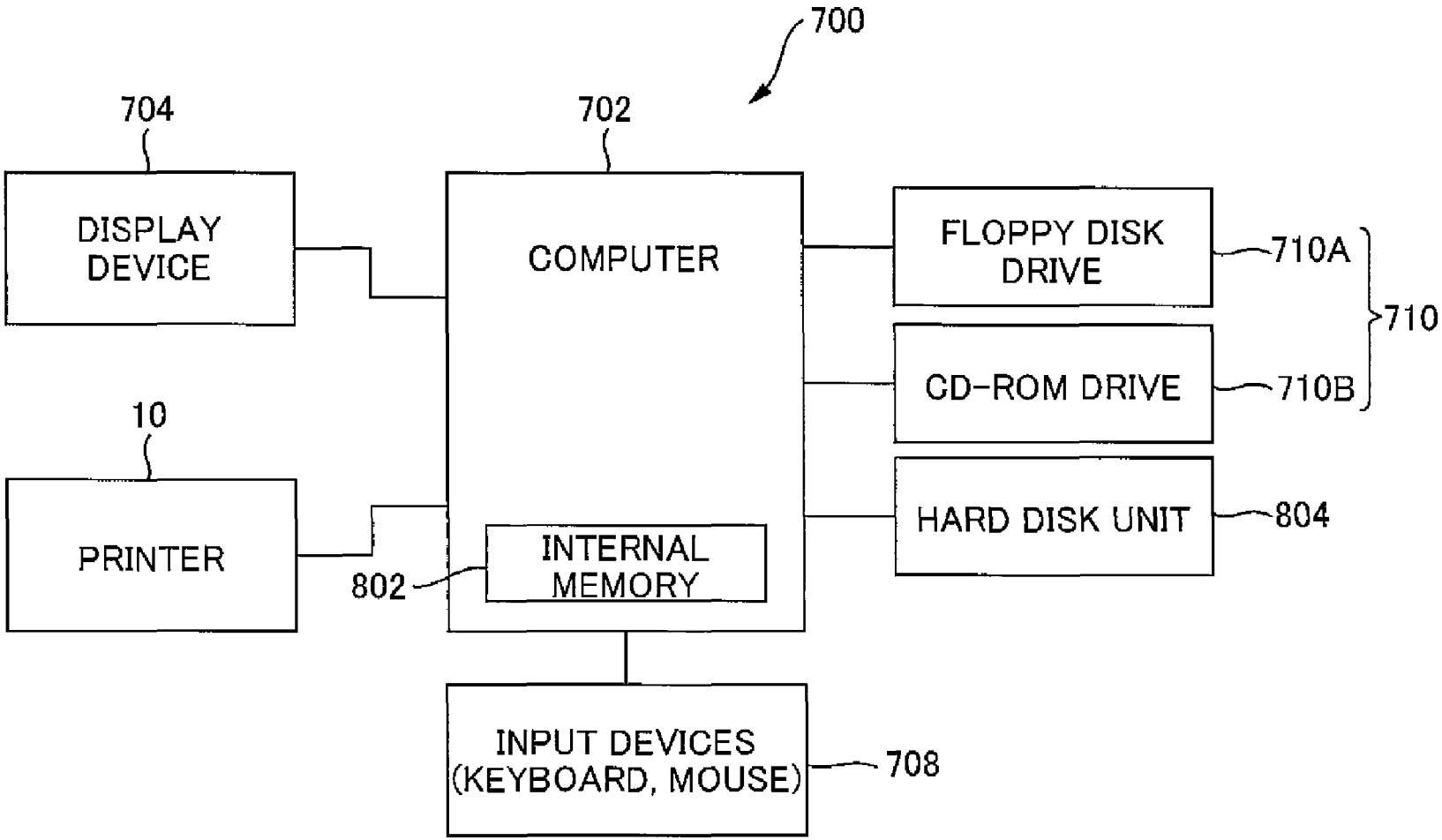
FIG. 32 is a block diagram showing the configuration of the image forming system shown in FIG. 31.

FIG. 32 is a block diagram showing the configuration of the image forming system shown in FIG. 31. An internal memory 802 such as a RAM is provided within the casing containing the computer 702, and furthermore an external memory such as a hard disk drive unit 804 is provided.

In the above explanations, an example was given in which the image forming system is constituted by connecting the printer 10 to the computer 702, the display device 704, the input devices 708 and the reading devices 710, but there is no limitation to this. For example, the image forming system may also be made of the computer 702 and the printer 10, and the image forming system does not have to be provided with any of the display device 704, the input devices 708, and the reading devices 710.

It is also possible that the printer 10 has some of the functions or mechanisms of the computer 702, the display device 704, the input devices 708 and the reading devices 710. For example, the printer 10 may be configured so as to have an image processing section for carrying out image processing, a display section for carrying out various types of displays, and a recording media mount/dismount section into and from which recording media storing image data captured by a digital camera or the like are inserted and taken out.

As an overall system, the image forming system that is thus achieved is superior to conventional systems.

What is claimed is:

1. An image forming apparatus comprising:

a photoconductor capable of bearing developer;

a rotatable intermediate transfer member serving as an intermediate medium when transferring the developer on the photoconductor to a medium;

a voltage supply section supplying to the intermediate transfer member a transfer voltage for letting the developer on the photoconductor advance to the intermediate transfer member at a primary transfer location;

a secondary transfer member for transferring to the medium the developer that has moved to a secondary transfer location through rotation of the intermediate transfer member;

a removal member arranged downstream from the secondary transfer location, with respect to a rotation direction of the intermediate transfer member, the removal member abutting against the intermediate transfer member and removing remaining developer remaining on the intermediate transfer member; and a controller that controls the voltage supply section, which does not cause the supply of the transfer voltage with the voltage supply section during the removal, with the removal member, of the remaining developer located upstream from the secondary transfer location, with respect to the rotation direction of the intermediate transfer member, and located between the primary transfer location and the secondary transfer location when a situation has arisen in which an image forming operation is stopped midway, in order to resume the image forming operation, wherein the voltage supply section is capable of supplying to the intermediate transfer member the transfer voltage for letting the developer advance to the intermediate transfer member and of supplying to the intermediate transfer member a reverse transfer voltage having a polarity opposite to a polarity of the transfer voltage for repelling the developer from the intermediate transfer member, and the controller causes the supply of the reverse transfer voltage with the voltage supply section during the removal, with the removal member, of the remaining developer located upstream from the secondary transfer location, with respect to the rotation direction of the intermediate transfer member, and located between the primary transfer location and the secondary transfer location when said situation has arisen in which an image forming operation is stopped midway, in order to resume the image forming operation.

2. An image forming apparatus according to claim 1, wherein the voltage supply section supplies the transfer voltage across the entire intermediate transfer member.

3. An image forming apparatus according to claim 2 wherein an electrode layer is arranged at an end portion of the intermediate transfer member in a perpendicular direction that is perpendicular to the rotation direction of the intermediate transfer member, the image forming apparatus further includes a conductive member abutting the electrode layer, and the voltage supply section supplies the transfer voltage via the conductive member to the intermediate transfer member.

4. An image forming apparatus according to claim 1, comprising four photoconductors capable of bearing developer of four different colors, wherein the intermediate transfer member serves as an intermediate medium when transferring the developer on each of these photoconductors to the medium.

5. An image forming apparatus comprising:

a rotatable image bearing member for bearing a latent image;

a developing device for developing the latent image borne by the image bearing member with developer at a developing location;

a rotatable intermediate transfer member serving as an intermediate medium when transferring the develouer on the image bearing member to a medium;

a voltage supply section supplying to the intermediate transfer member a transfer voltage for letting the developer on the image bearing member advance to the intermediate transfer member at a primary transfer location;

a secondary transfer member for transferring to the medium the developer that has moved to a secondary transfer location through a rotation of the intermediate transfer member;

a removal member arranged downstream from the secondary transfer location, with respect to a rotation direction of the intermediate transfer member, the removal member removing remaining developer on the intermediate transfer member without being transferred by the secondary transfer member, by abutting against the intermediate transfer member, the removal member removing remaining developer that has remained on the image bearing member and the intermediate transfer member when a situation has arisen in which an image forming operation is stopped midway, and that has been moved through the rotation of the image bearing member and the intermediate transfer member and has reached a developer removal location at which the remaining developer is removed by the removal member, in order to resume the image forming operation; and a controller that controls the voltage supply section, the controller causing the supply of the transfer voltage with the voltage supply section until the remaining developer located at the developing location when said situation has arisen has been moved through the rotation of the image bearing member and has reached the primary transfer location, and stopping the supply of the transfer voltage with the voltage supply section after the remaining developer located at the developing location when said situation has arisen has reached the primary transfer location and before the remaining developer located at the secondary transfer location when said situation has arisen is moved to the developer removal location through the rotation of the intermediate transfer member and removed by the removal member, wherein the voltage supply section is capable of supplying to the intermediate transfer member the transfer voltage for letting the developer advance to the intermediate transfer member and of supplying to the intermediate transfer member a reverse transfer voltage having a polarity opposite to a polarity of the transfer voltage for repelling the developer from the intermediate transfer member, and the controller stops the supply of the transfer voltage with the voltage supply section and causes the supply of the reverse transfer voltage with the voltage supply section after remaining developer located at the developing location when said situation has arisen in which an image forming operation is stopped midway has reached the primary transfer location and before remaining developer located at the secondary transfer location when said situation has arisen is moved to the developer removal location through rotation of the intermediate transfer member and is removed by the removal member.

6. An image forming apparatus according to claim 5, wherein the controller lets the voltage supply section maintain the stop of the supply of the transfer voltage until the remaining developer located at the developing location when said situation has arisen in which an image forming operation is stopped midway has been moved to the developer removal location through the rotation of the image bearing member and the intermediate transfer member and is removed by the removal member.

7. An image forming apparatus according to claim 5, wherein a length of the image bearing member, in its rotation direction, from the developing location to the primary transfer location is shorter than a length of the intermediate transfer member, in its rotation direction, from the secondary transfer location to the developer removal location.

8. An image forming apparatus according to claim 5, comprising four of the rotatable image bearing members capable of bearing developer of different colors;

wherein the intermediate transfer member serves as an intermediate medium when transferring the developer on these image bearing members to a medium.

9. An image forming apparatus according to claim 8, wherein the four rotatable image bearing members are provided along the rotation direction of the intermediate transfer member, and the controller causes the supply of the transfer voltage with the voltage supply section until the remaining developer located at the developing location corresponding to a first image bearing member of the four rotatable image bearing members, which is furthest removed from the secondary image location on the upstream side, with respect to the rotation direction, of the intermediate transfer member when said situation has arisen in which an image forming operation is stopped midway is moved through the rotation of the image bearing members and the intermediate transfer member and passes the primary transfer location corresponding to a second image bearing member of the four rotatable image bearing members, which is closest to the secondary image location on the upstream side, with respect to the rotation direction, of the intermediate transfer member, and stops the supply of the transfer voltage with the voltage supply section after the remaining developer located at the developing location corresponding to the first image bearing member when said situation has arisen has passed the primary transfer location corresponding to the second image bearing member, and before the remaining developer located at the secondary transfer location when said situation has arisen is moved to the developer removal location through the rotation of the intermediate transfer member and removed with the removal member.

10. An image forming apparatus according to claim 9, wherein a total of a length, in a rotation direction, of the first image bearing member from the developing location to the primary transfer location and a length, in the rotation direction, of the intermediate transfer member from the primary transfer location corresponding to the first image bearing member to the primary transfer location corresponding to the second image bearing member is shorter than a length, in the rotation direction, of the intermediate transfer member from the secondary transfer location to the developer removal location.

* * * * *